United States Patent [19]

Hall et al.

[11] 4,433,601

[45] Feb. 28, 1984

[54] ORCHESTRAL ACCOMPANIMENT TECHNIQUES

[75] Inventors: George R. Hall, Sherman Oaks; Robert J. Hall, Chatsworth; Jack C. Cookerly, Saugus, all of Calif.

[73] Assignee: Norlin Industries, Inc., White Plaines, N.Y.

[21] Appl. No.: 307,161

[22] Filed: Sep. 30, 1981

Related U.S. Application Data

[63] Continuation of Ser. No. 3,584, Jan. 15, 1979, abandoned.

[51] Int. Cl.³ ..... G10F 1/00

[52] U.S. Cl. ..... 84/1.03; 84/1.01; 84/DIG. 12; 84/1.24

[58] Field of Search ..... 84/1.03, 1.01, 1.24, 84/1.19, DIG. 12, DIG. 22

[56] References Cited

U.S. PATENT DOCUMENTS 4,112,802 9/1978 Robinson et al. ..... 84/1.03
4,120,225 10/1978 Dietrich et al. ..... 84/1.03
4,129,055 12/1978 Whittington et al. ..... 84/1.03
4,144,788 3/1979 Bione et al. ..... 84/1.03
4,152,965 5/1979 Howell ..... 84/1.03
4,186,639 2/1980 Robinson et al. ..... 84/1.03

*Primary Examiner*—F. W. Isen
*Attorney, Agent, or Firm*—Allegretti, Newitt, Witcoff & McAndrews

[57] ABSTRACT

An electronic musical instrument by which a performer can provide a musical accompaniment in different musical styles. The performer selects a desired musical style and plays on a standard keyboard in order to express a desired harmony. The instrument translates the keyboard playing into a chord type and root that defines the harmony expressed by the performer. A processor generates parameter signals defining a segment of music including a plurality of accompaniment notes arranged in the selected musical style and related harmonically to the selected chord type and root. Output circuitry converts the parameter signals to sound so that a performer of limited skill or musical knowledge can play an appropriately-styled accompaniment to a melody written in any one of a variety of musical keys.

52 Claims, 34 Drawing Figures

TECHNIQUES EMPLOYED 1 2 3 4 6 8 9

I SELECTED STYLE-BAROQUE
II PLAYED BY PERFORMER:

III INSTRUMENT ACCOMPANIMENT:

TECHNIQUES EMPLOYED 1 2 3 4 6 7 8 9

I SELECTED STYLE-BAROQUE
II PLAYED BY PERFORMER:

III INSTRUMENT ACCOMPANIMENT:

I SELECTED STYLE-JAZZ GUITAR
II PLAYED BY PERFORMER:

III INSTRUMENT ACCOMPANIMENT:

I STYLE SELECTED-CONTEMPORARY GUITAR & CELLI
II PLAYED BY PERFORMER:

CHORD NAME- F MAJ.
NOTES
P
CHORD TYPE -MAJOR
ROOT -F
ROOT GROUP -2
III INSTRUMENT ACCOMPANIMENT:
MELODIC CONTOUR
CHORD NAMES
FMAJ7 F6
ACOUSTIC GUITAR
F
ACOUSTIC GUITAR
I
CELLI
BASS GUITAR
ADDED NOTES
MAJ 7 6th
RHYTHM PATTERN
TECHNIQUES EMPLOYED 1 2 3 4 6 7 8 9

Fig. 17

| | CY | MSB | | 226 | | | | | | | 224 | | LSB | SHIFT COUNTER | |
|---|---|---|---|---|---|---|---|---|---|---|---|---|---|---|---|
| A | 0 | 1 | 0 | 0 | 0 | 0 | 1 | 0 | 0 | 0 | 1 | 0 | 0 | 0 | 228 |
| | | C | C# | D | D# | E | F | F# | G | G# | A | A# | B | | |
| B | 1 | 0 | 0 | 0 | 0 | 1 | 0 | 0 | 0 | 1 | 0 | 0 | 0 | 1 | AFTER 1 SHIFT |
| | C | C# | D | D# | E | F | F# | G | G# | A | A# | B | — | | |
| C | 0 | 0 | 0 | 1 | 0 | 0 | 0 | 1 | 0 | 0 | 0 | 0 | 0 | 1 | AFTER 2 MORE SHIFTS (GROUP 0) |
| | D | D# | E | F | F# | G | G# | A | A# | B | — | — | — | | |
| D | 0 | 0 | 1 | 0 | 0 | 0 | 1 | Q | 0 | 0 | 0 | 0 | 0 | 1 | AFTER 1 MORE SHIFT |
| | D# | E | F | F# | G | G# | A | A# | B | — | — | — | — | | |
| E | 1 | 0 | 0 | 0 | 0 | 1 | 0 | 0 | 0 | 1 | 0 | 0 | 1 | 1 | AFTER RESTORATION DATA |
| | C | C# | D | D# | E | F | F# | G | G# | A | A# | B | C | | |
| F | 0 | 0 | 0 | 0 | 1 | 0 | 0 | 0 | 1 | 0 | 0 | 1 | 0 | 2 | AFTER NEXT SHIFT |
| | C# | D | D# | E | F | F# | G | G# | A | A# | B | C | — | | |
| G | 0 | 1 | 0 | 0 | 0 | 1 | 0 | 0 | 1 | 0 | 0 | 0 | 0 | 5 | AFTER 3 MORE DATA ROTATIONS |
| | E | F | F# | G | G# | A | A# | B | C | C# | D | D# | E | | |
| H | 1 | 0 | 0 | 0 | 1 | 0 | 0 | 1 | 0 | 0 | 0 | 0 | 0 | 6 | AFTER NEXT SHIFT |
| | F | F# | G | G# | A | A# | B | C | C# | D | D# | E | — | | |
| I | 0 | 0 | 1 | 0 | 0 | 1 | 0 | 0 | 0 | 0 | 0 | 0 | 0 | 6 | AFTER 2 MORE SHIFTS (GROUP 0) |
| | G | G# | A | A# | B | C | C# | D | D# | E | — | — | — | | |
| J | 0 | 1 | 0 | 0 | 1 | 0 | 0 | 0 | 0 | 0 | 0 | 0 | 0 | 6 | AFTER 1 MORE SHIFT |
| | G# | A | A# | B | C | C# | D | D# | E | — | — | — | — | | |

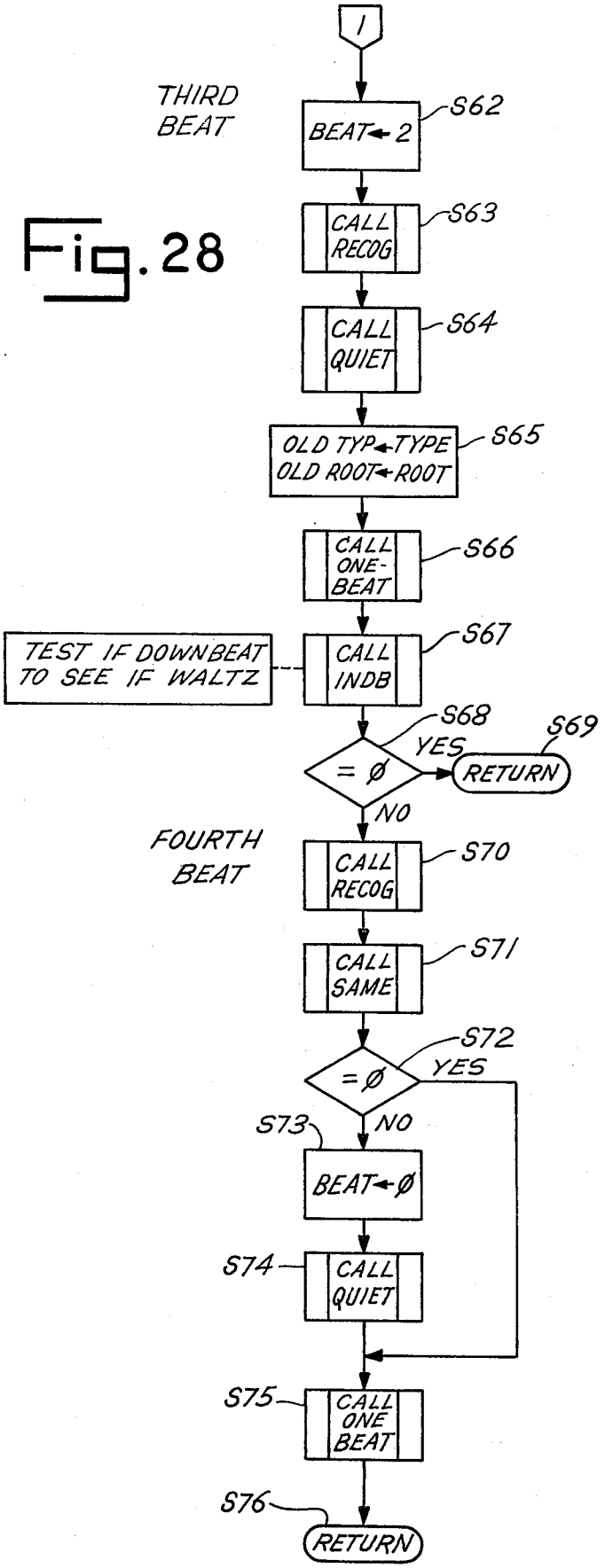
Fig. 28
Fig. 29
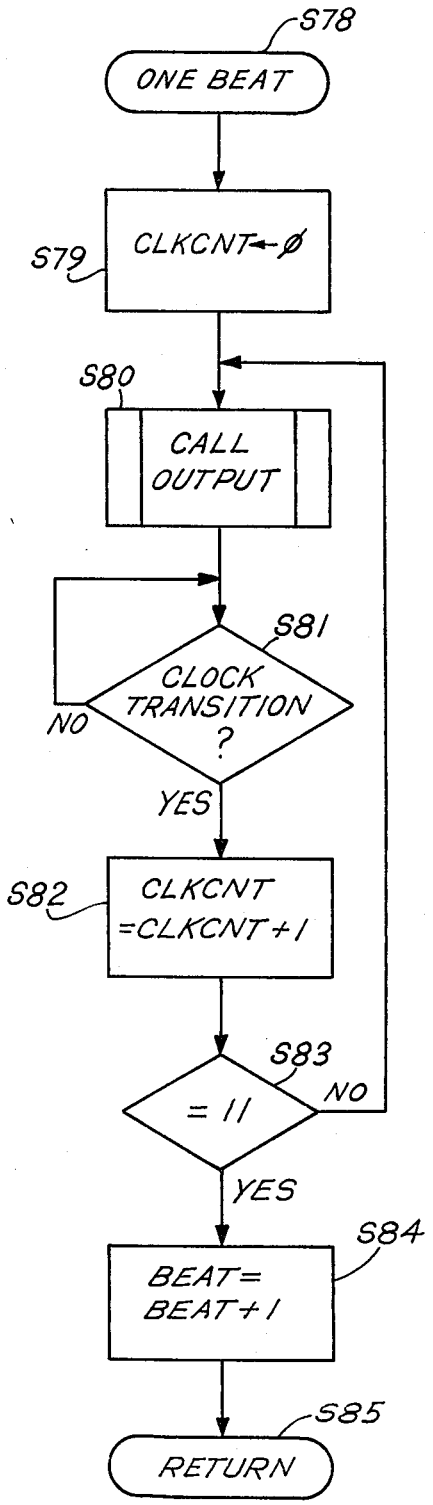

ORCHESTRAL ACCOMPANIMENT TECHNIQUES

This is a continuation of application Ser. No. 3,584 filed on Jan. 15, 1979, now abandoned.

BACKGROUND AND SUMMARY OF THE INVENTION

This invention relates to electronic musical instruments, and more particularly relates to such instruments capable of providing an accompaniment to a melody played by a performer.

Electronic musical instruments, such as keyboard-controlled electronic organs, have experienced wide acceptance among musicians. Since many of these instruments are sold to amateurs, manufacturers have placed special emphasis on the ease of playing and on the variety of voices (i.e., sound qualities or timbres) available to the performer. In particular, the electronic musical instrument industry has long sought a method of producing a full orchestral accompaniment which can be controlled easily by a performer of limited skill or musical knowledge.

Past attempts in this direction have met with only limited success. For example, it is possible to play a complete accompaniment chord on some instruments (e.g., chord organs) by pressing only one key. The drone of such instruments may sound good to the novice, but it soon becomes monotonous. The drone of the chord organs has been reduced somewhat by a variety of rhythm devices consisting of synthetically created drum, brush and cymbal sounds which are selectively gated on and off in accordance with a rhythm clock. Bass tones consisting of a root note, a fifth, or similar elementary harmonic structures, have been generated by prior rhythm devices, but they have not relieved the monotony inherent in such devices. Other instruments, such as the Yamaha Model E-70 electronic organ, gate solid pitched chords on and off with a rhythm clock and simultaneously generate a running base line which keys a variety of pitches on and off with the rhythm clock. The solid chords sound in the registration selected on a lower keyboard manual and the bass line sounds in the registration selected on the pedal board. For any given chord selected by the performer, the gated chords remain the same and the melodic pattern of the base line remains the same during a prescribed musical segment of about two measures.

More recent instruments such as the Lowrey Model D-325, key a melody line and a running bass line on and off with a rhythm clock. Solid chords also can be controlled by the same rhythm clock. The solids chords and melody line sound in selectable registration and the bass line sounds in another selectable registration.

There have been attempts to synthesize music on a digital computer. For example, the May, 1961 *Bell System Technical Journal* contains a description by Max V. Mathews of "An Acoustic Compiler For Music And Psychological Stimuli". A related device was developed at Dartmouth College and is described in a May, 1975 paper by Paul Tobias entitled, "An Introduction To The Dartmouth Music Language". Such music synthesizers are able to simulate orchestral affects to a greater extent than the instruments described above. However, it is believed that no one has been able to incorporate such synthesizers into a performing instrument capable of responding to the touch of a performing musician.

Although the foregoing devices are a step in the right direction, the resulting sound does not compare with the results obtained when a skilled organist plays an instrument by adding correct counterpoint, countermelody, variable rhythm patterns and other embellishments that only a skilled musician can employ. Even a skilled keyboard player cannot duplicate or effectively emulate a group of different instruments or an orchestra, because, at any one time, each key of a single keyboard controls tones having the same voice or timbre. That is, the player cannot produce totally different timbres of sound on keys played simultaneously on the same keyboard. As a result, he cannot hope to produce a truly orchestral effect.

Accordingly, it is a principal object of the present invention to enable a performer to create an accompaniment in a proper harmony and in a variety of different styles types of music, such as bossa nova, big band, baroque, jazz guitar, contemporary guitar and celli, country and western, hillbilly, bluegrass, rock and roll, etc. in which one or more of the instrumentation pattern, rhythm pattern, chord pattern pattern and melodic contour can be changed under performer control in order to add variety to the accompaniment.

Another object is to produce a musical instrument of the foregoing type in which one or more of the rhythm pattern, chord pattern pattern and melodic contour are changed in response to a change in harmony by the performer.

Yet another object is to provide an instrument of the foregoing type in which one or more of the instrumentation pattern, chord pattern pattern and melodic contour are changed in response to a change in musical style by the performer.

Still another object is to provide an instrument of the foregoing type in which the performer can use a keyboard in order to select the proper harmony for the accompaniment.

Still another object is to provide an instrument of the foregoing type in which mistakes in musical phrasing by the performer are corrected or minimized.

Yet another object is to provide an instrument of the foregoing type in which multiple voice lines are individually controlled in order to simulate the sound of a true orchestra.

An electronic musical instrument built according to this specification combines great ease of playing with an improved tone production system that faithfully reproduces the various instruments and rhythm patterns of an orchestra. The instrument automatically creates an accompaniment in the pitch range and rhythmic patterns that the experienced music arranger or orchestrator uses to define different styles of music. As a result, a performer of limited skill or musical knowledge can easily play a complete orchestral accompaniment in any one of a variety of musical styles. In order to achieve this result, the inventors have discovered new techniques for storing musical parameter information in a memory and processing that information according to the playing of the instrument by the performer.

DESCRIPTION OF THE DRAWINGS

These and other objects, advantages and features of the present invention will appear for purposes of illustration, but not of limitation, in connection with the accompanying drawings, wherein like numbers refer to like parts throughout, and wherein:

FIG. 17 is a block diagram illustrating the operation of certain registers in the microprocessor;

FIGS. 25–30 and 32 are flow charts illustrating the overall operation of the preferred embodiment.

DESCRIPTION OF THE PREFERRED EMBODIMENT

I. Musical Organization and Capabilities

Figure 1:
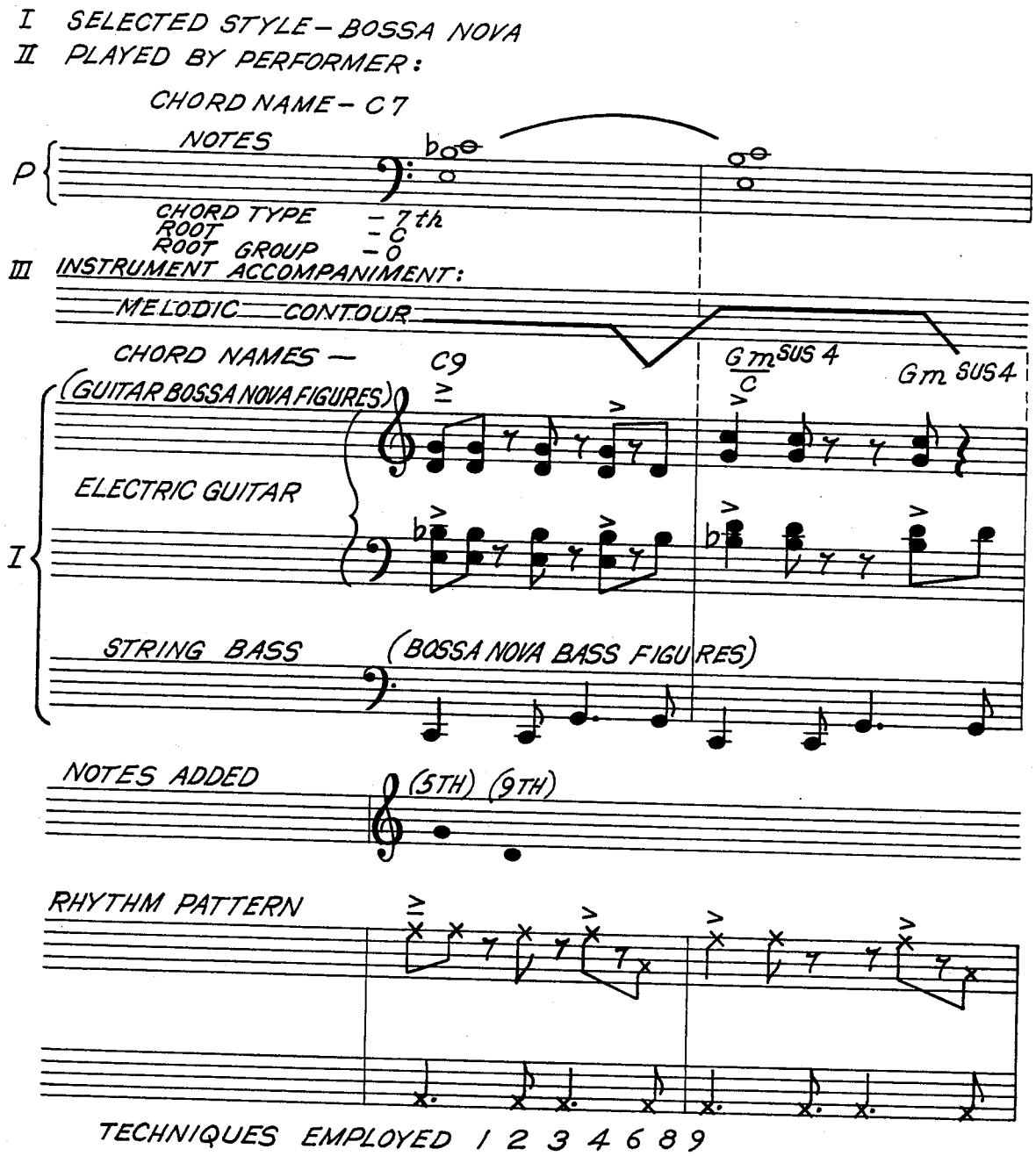
FIGS. 1–14 illustrate musical techniques which the preferred embodiment of the invention is capable of producing.

An electronic musical instrument made in accordance with the preferred embodiment of the invention is capable of providing a full orchestral accompaniment to a melody played in any one of the 12 possible harmonic keys. The accompaniment easily can be controlled by the left hand of a performer who is playing the melody with his right hand on a melody keyboard. The accompaniment is "played" by the instrument in any one of a variety of different musical "styles", such as bossa nova, big band, baroque, jazz guitar, or contemporary guitar and ceili. The musical style desired by the performer is selected by a switch located on the instrument console. The performer also adjusts a tempo clock so that the accompaniment is "played" by the instrument in time with the melody being played by the performer.

The instrument automatically relates the accompaniment to the harmony selected by the left hand of the performer on a harmony keyboard. Thus, the accompaniment is "played" both in the style and harmony selected by the performer as most appropriate for the melody he is playing.

The instrument normally generates a segment or orchestrated accompaniment music which is repeated after every two musical bars. That is, a normal segment of accompaniment music consists of two musical measures or bars, and each bar contains four musical beats. A waltz segment consists of two bars, and each bar contains three beats.

The instrument analyzes the manipulation of the harmony keyboard in order to ascertain the accompaniment harmony desired by the performer. In particular, the instrument identifies a specified chord type and root note. The chord types recognized by the instrument are major, minor, diminished, augmented and seventh, and the root note can be any of the twelve notes of the musical chromatic scale.

In order to add variety to the musical accompaniment segments, the twelve possible roots are divided into four groups as follows:

| Group Number | Root Note |
|---|---|
| 0 | C, C#, E |
| 1 | D#, F#, and D |
| 2 | F, G#, and A |
| 3 | G, A#, and B |

(Throughout this specification, a musical sharp is indicated by the symbol #.)

Assuming the musical style selected by the performer remains constant, the segment of accompaniment music produced by the instrument changes each time the performer plays a new chord type or a chord in a new root group. Since there are five possible chord types and four possible root groups, twenty different and unique musical segments can be produced for each musical style. In other words, for any given style of music, there are twenty different music segments arranged to express the style. This is a unique feature which causes the expression of any musical style to change as the harmony desired by the performer changes, thereby adding vitality and variety to the accompaniment.

An electronic musical instrument made in accordance with the preferred embodiment enables a performer easily to produce a wide variety of musical techniques which cannot be achieved at any level of complexity by existing electronic musical instruments. Many of these techniques are illustrated in FIGS. 1–14. Each of FIGS. 1–14 is subdivided into three sections:

Section I identifies the musical style selected by the performer;

Section II illustrates the notes played by the performer on the harmony keyboard in order to indicate the harmony he desires, as well as the chord type, root and root group which the instrument identifies based on the notes played by the performer;

Section III illustrates (a) the two bar accompaniment produced by the instrument in response to the notes played by the performer, (b) the notes added by the instrument which are not in the chord played by the performer, and (c) the rhythm pattern produced by the instrument.

An electronic musical instrument made in accordance with the preferred embodiment is capable of generating unique accompaniment musical segments employing one or more of the following musical techniques:

1. The rhythm pattern of the musical segment changes when the performer changes from one root group or one chord type to another;

2. The melodic contour of the musical segment changes when the performer changes from one root group or chord type to another;

3. The chord pattern pattern of the musical segment changes when the performer changes from one root group or chord type to another;

4. Harmonies different from the harmony nominally selected by the performer are played (e.g., a chord is played having a different name from the chord played by the performer);

5. Chord progressions result from a single chord played by the performer;

6. The octave positions of the notes of a chord played by the performer are changed depending on the tone quality or instrument being simulated in order to achieve chord voicing;

7. Musical figures are presented in contrapuntal form with the melody played by the performer functioning as a cantus firmus (i.e., primary melody), or the musical segment is presented as an accompaniment having two or more contrapuntal parts;

8. The instrumentation pattern of the notes of the musical segment changes when the performer changes from one style to another, so that instruments appropriate to the selected style can be simulated.

9. The rhythm pattern, melodic contour or chord pattern pattern produced by the instrument change when the performer changes from one style to another, so that the musical segment accurately expresses the style.

No known prior electronic instrument is capable of implementing any of these techniques under playing control by a performer. The ability of the present instrument to produce musical segments employing these techniques is a significant advance in the art which dramatically increases the ability of a performer to make interesting and vital music. Those able to read music will recognize from FIGS. 1–14 additional musical techniques which enhance the orchestrated accompaniment produced by the present instrument.

Figure 2:
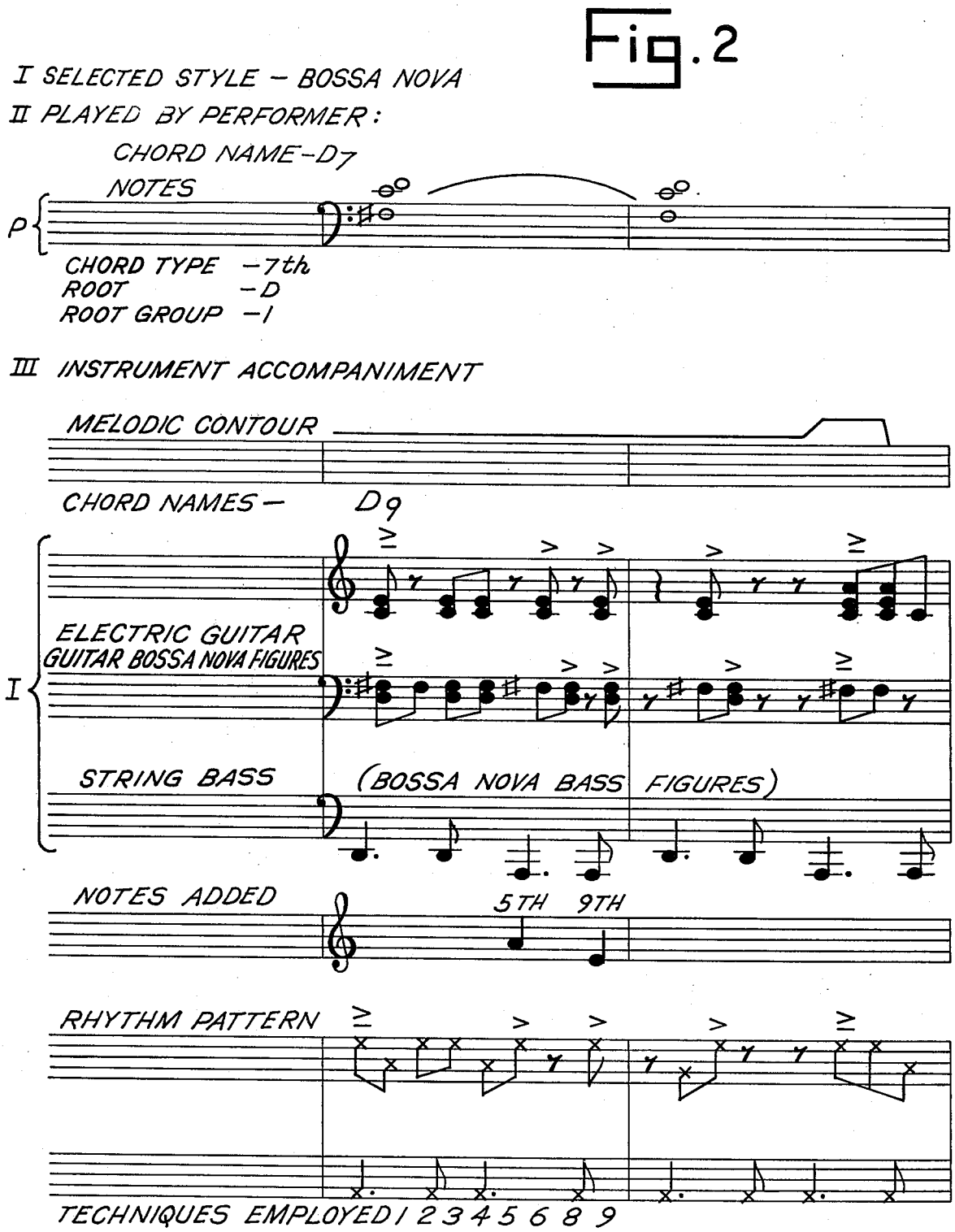
Figure 3:
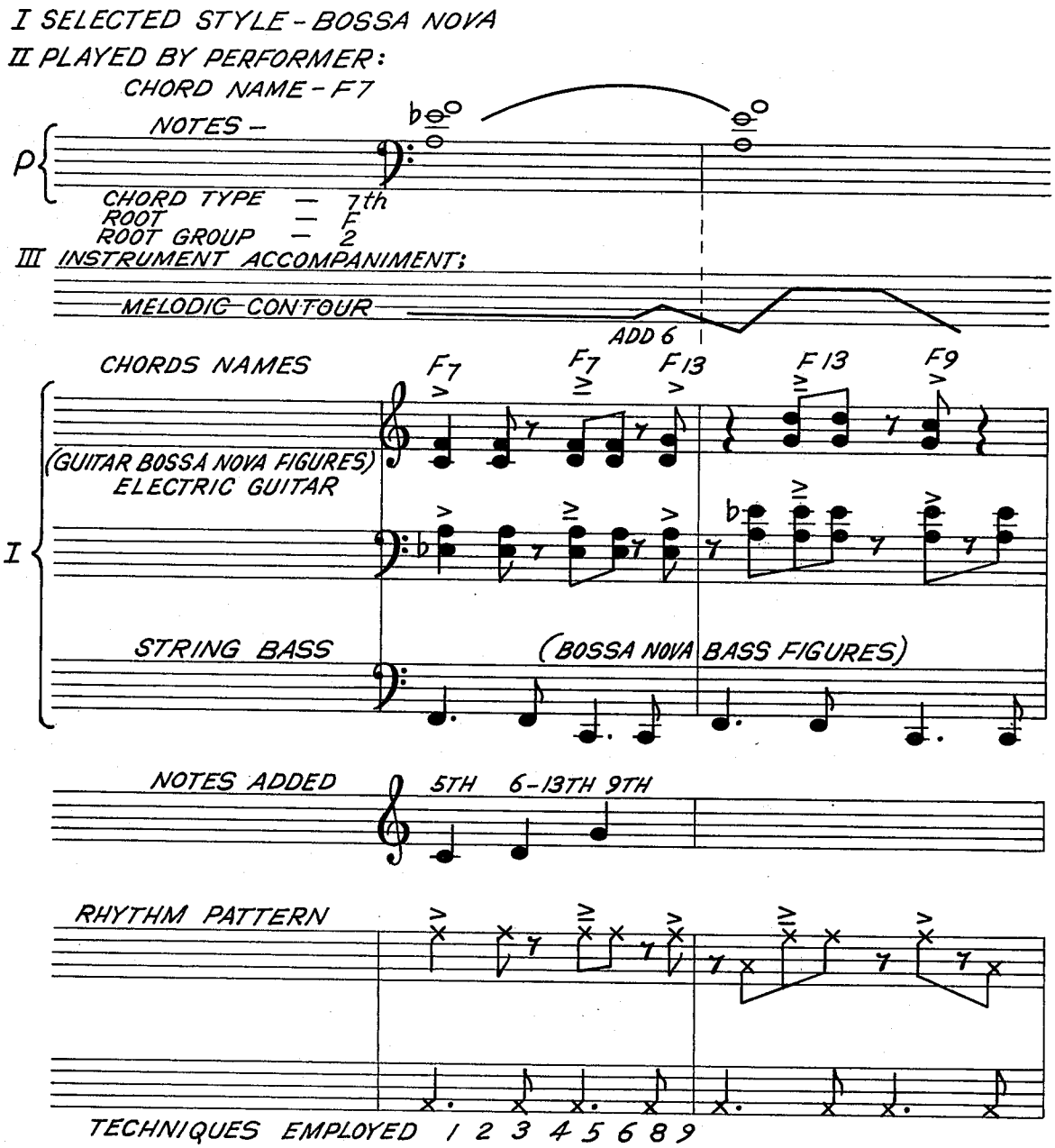
Figure 4:
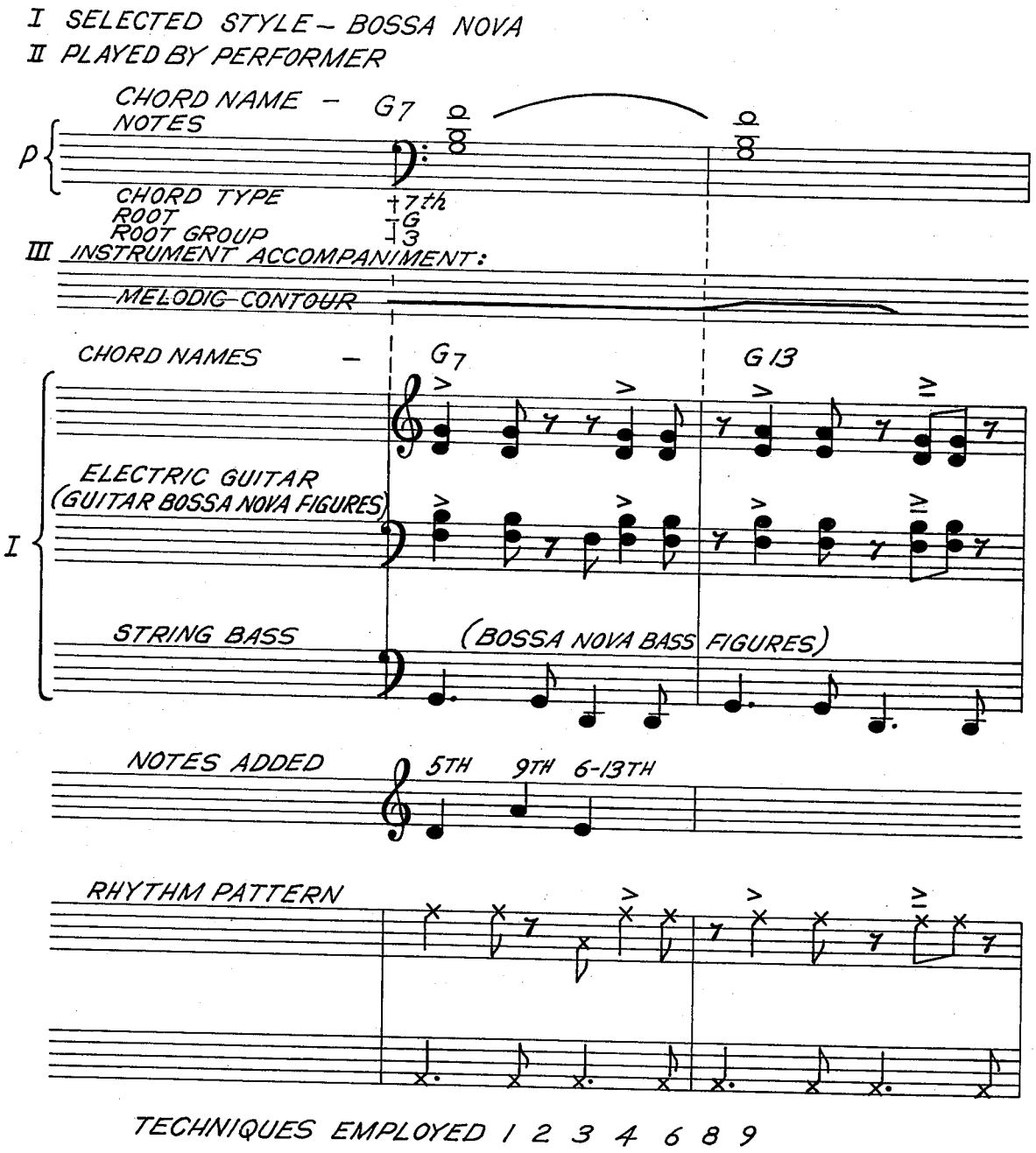
Figure 5:
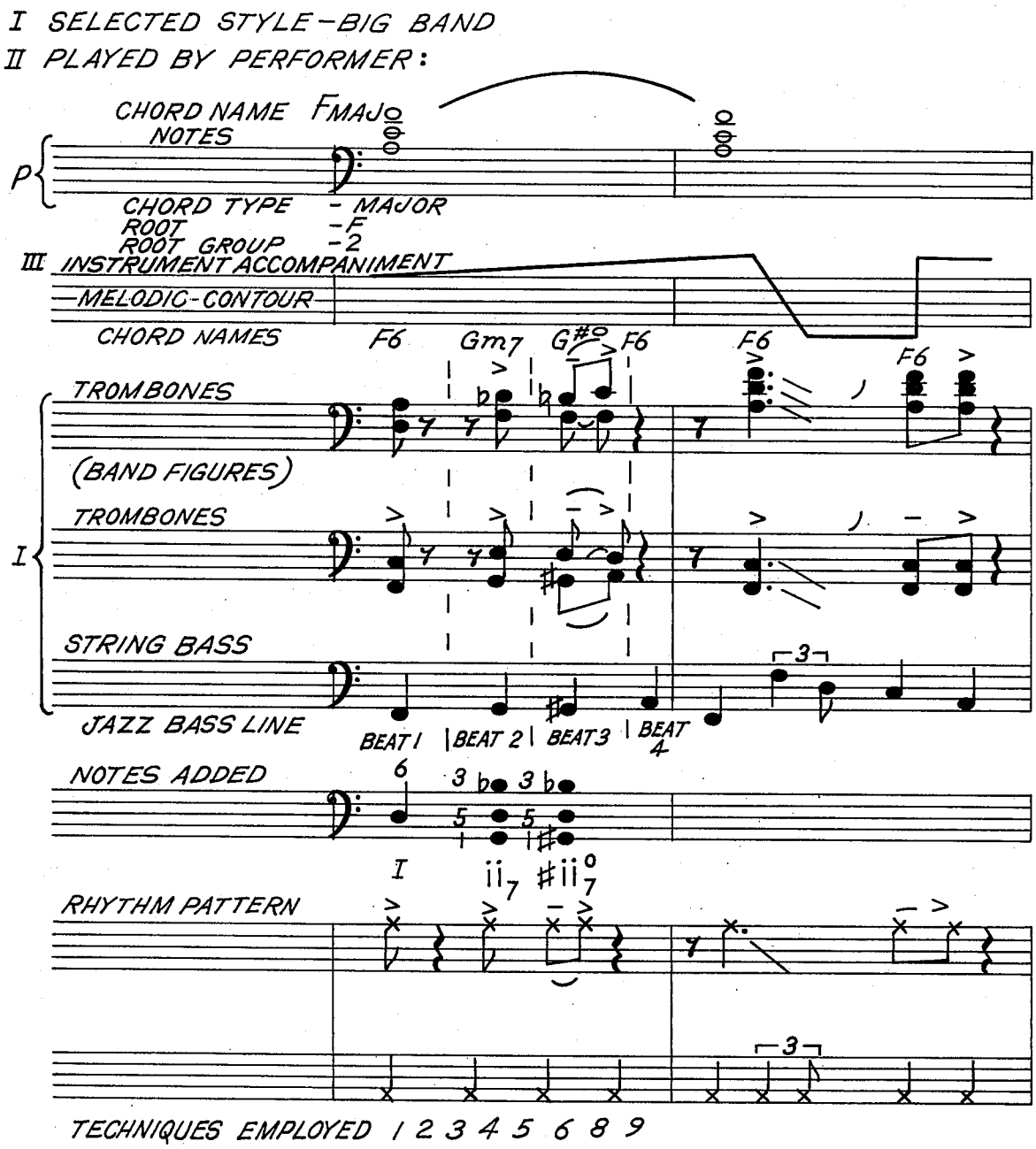
Figure 6:
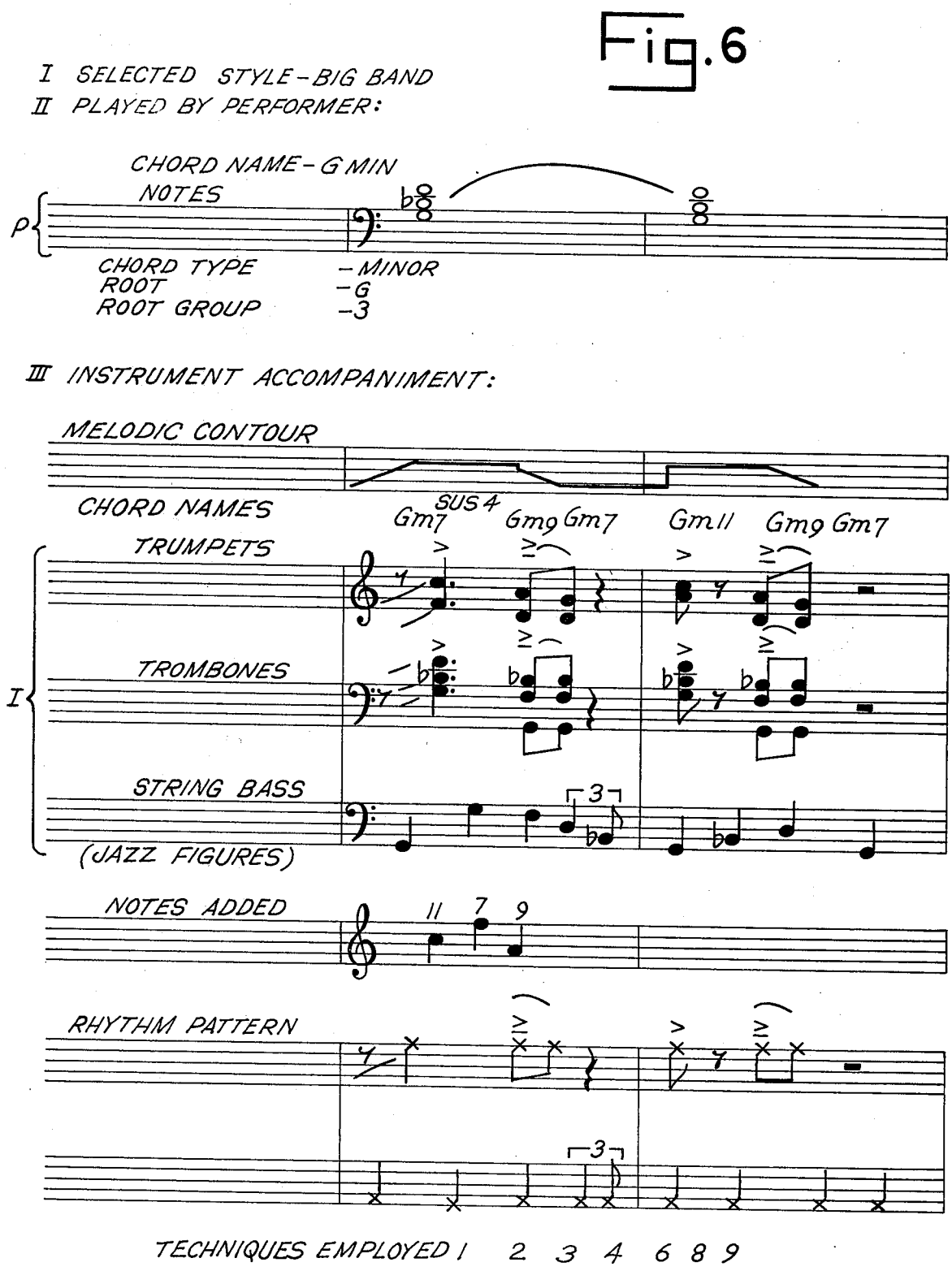
Figure 7:
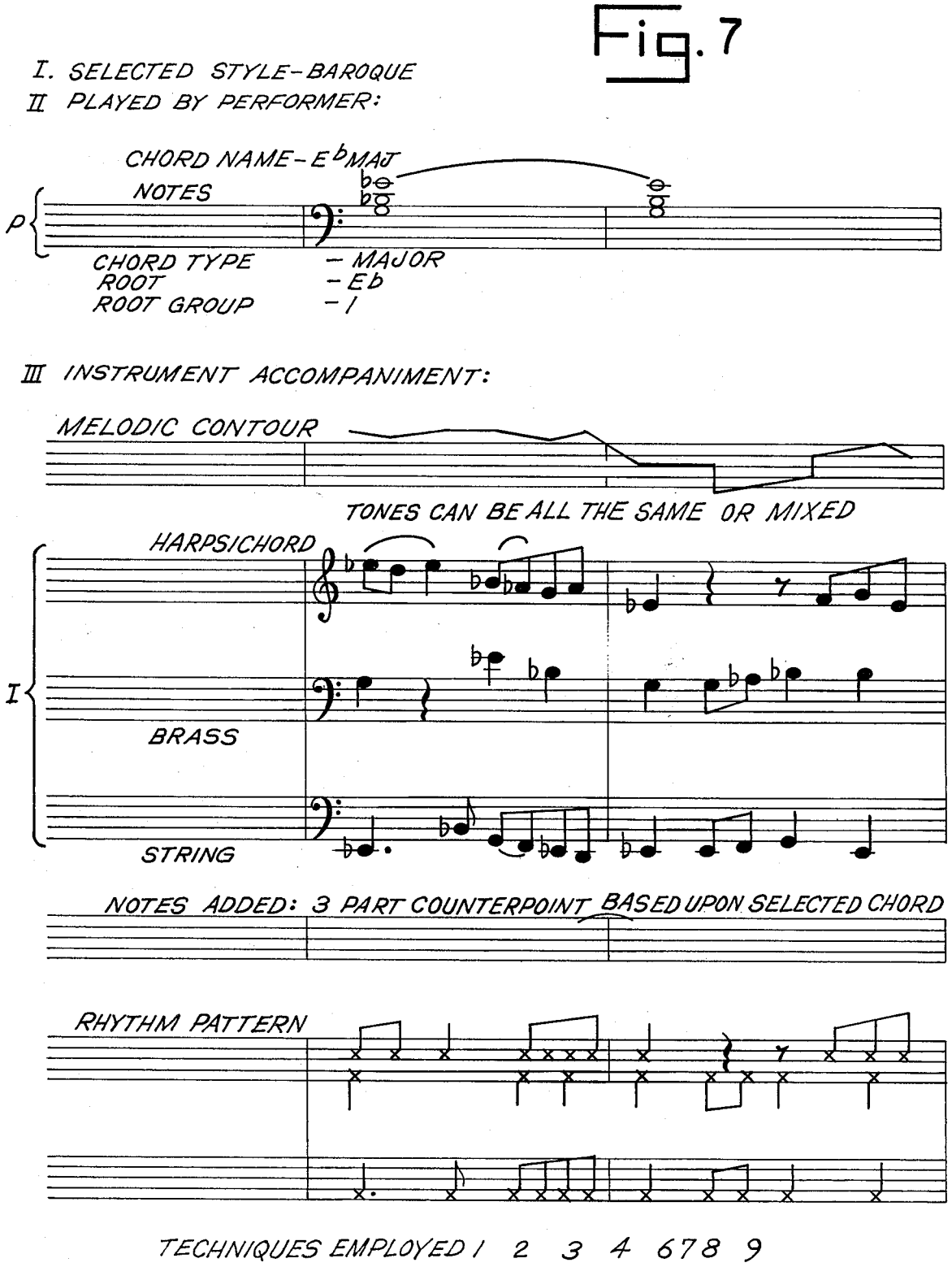

Regarding musical technique 1, FIGS. 5 and 6 illustrate the fact that the rhythm pattern for the big band style changes when the performer switches from a major chord type to a minor chord type. FIGS. 1 and 2 indicate that the rhythm patterns also change when the performer switches from one root group to another, even though the chord type remains the same. This is an important feature which adds a great deal of variety and interest to the resulting music.

Regarding technique 2, each of FIGS. 1–14 illustrate the fact that the melodic contour is varied when the performer changes either from one root group or one chord type to another. As used in this specification and these claims, melodic contour refers to the relative pitch intervals of a melody line of the accompaniment. Transposing a melody line from one harmonic key to another would not change the melodic contour because the relative pitch intervals in the different keys would remain the same. Changing the pitch interval of one note in a melody line relative to another note in the melody line would change the melodic contour.

Regarding technique 3, FIGS. 1–14 each illustrate the chord pattern changing ability of the instrument in musical segments employing a plurality of chords having different chord component structures these claims, harmonic pattern refers to the relative. As used in this specification and these claims, changing the chord component structure of a chord refers to changing the relative pitch intervals of the notes in the chord, by adding, deleting or modifying notes in the chord, other than by changing the octave locations of one or more notes of the chord. As used in this specification and claims, chord pattern refers to the order in which chords of different chord component structures are sounded. Transposing a segment of the accompaniment from one harmonic key to another would not involve a change in chord interval structure or chord pattern. Changing the pitch interval of one note in a chord relative to another note in the chord, other than by changing the octave location of one or more notes of the chord, would change the chord interval structure. For example, harmonic inversions, as shown by chords X and Y of FIG. 10, change only the octave locations of the notes of the chords and therefore do not change the chord interval structure. As used in this specification and these claims, to harmonically modulate means to change a chord pattern in ways other than those required to accommodate a change in chord type selected by the performer. In a musical segment generated in response to a major chord which includes as major 6th chord followed by a minor seventh chord, altering the segment to a minor 6th chord followed by a minor 7th chord in response to the selection of a minor chord by the performer would not harmonically modulate the segment. Altering the segment to a minor 7th chord followed by a minor ninth chord would harmonically modulate the segment.

Regarding techniques 4 and 5, FIG. 5 is a particularly good illustration of the chord progression and harmony changing capabilities of the instrument.

Regarding technique 6, each of FIGS. 1–14 illustrates the chord voicing capabilities of the instrument.

Regarding technique 7, FIGS. 7–10 and 13 illustrate various contrapuntal forms of music, as well as counter melodies, which can be produced by the instrument.

Each of FIGS. 1–14 illustrates techniques 8 and 9. As used in this specification and these claims, instrumentation pattern refers to the combination of different instrument sounds or timbres in which a style is expressed by pitched notes. For example, if the timbre of sound expressing one voice line of pitched notes in a segment of music is changed to a different timbre, the instrumentation pattern also is changed.

Figure 15:
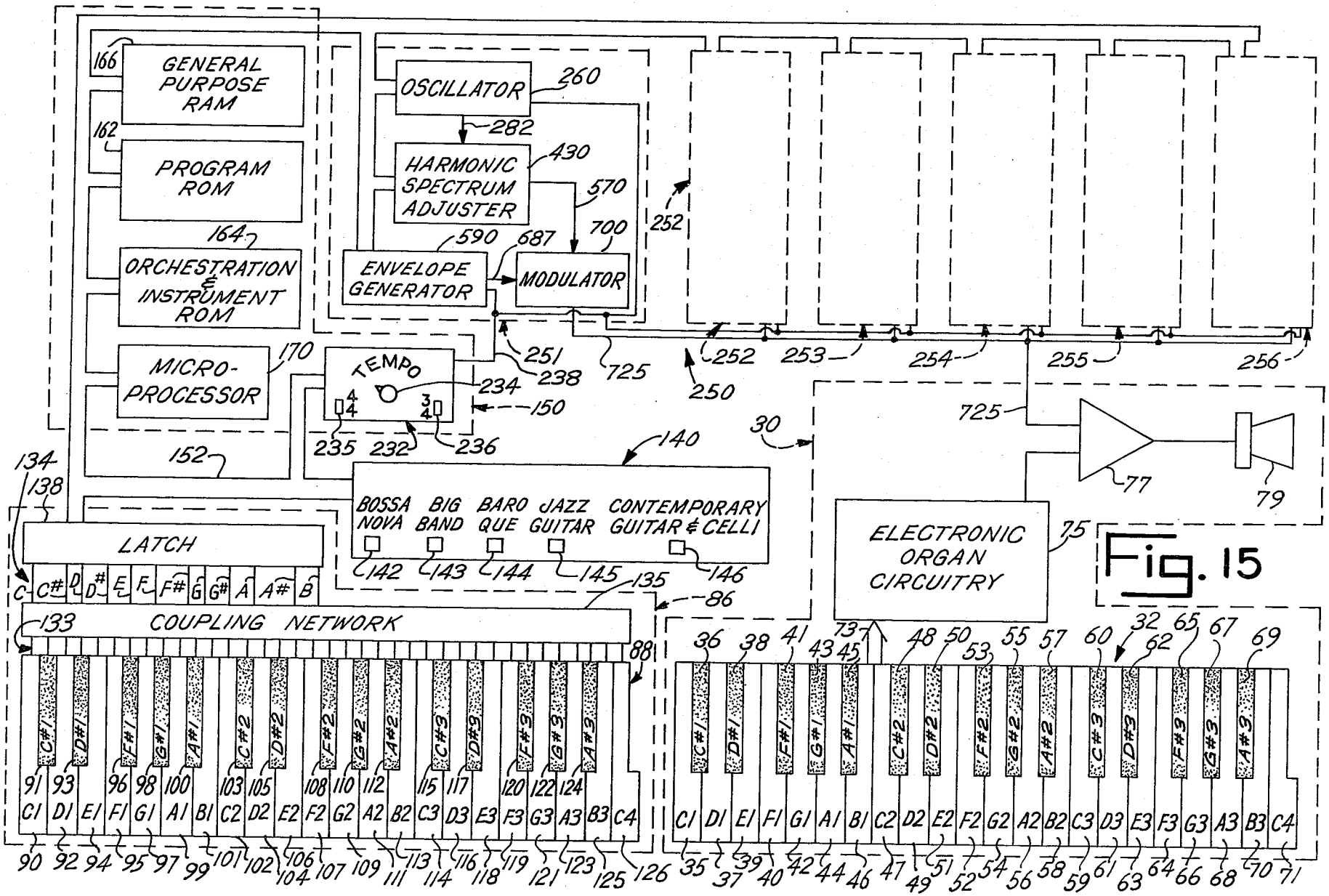
FIG. 15 is a logical block diagram of a preferred form of musical instrument made in accordance with the present invention.

II. Description Of Harmony Selection, Style Selection And Processing Apparatus Referring to FIG. 15, a preferred form of electronic musical musical instrument capable of producing the foregoing musical techniques under the control of a performer basically comprises a melody system 30, a harmony selection system 86, a musical style selector 140, a processing system 150 and an output system 250. As shown in FIG. 15, melody system 30 includes a conventional melody keyboard 32 which comprises playing keys 35–71. Each of the keys represents at least one note which is pitched in at least one octave. Keyboard 32 is connected through a cable 73 to conventional electronic organ circuitry 75. The circuitry produces audio tone signals based on the melody keys depressed by the performer in a well-known manner. The tone signals are transmitted through an output amplifier 77 to a conventional loud-speaker transducer 79 which converts the signals to sound.

Harmony selection system 86 comprises a harmony keyboard 88, including playing keys 90–126. The keys operate switch contacts 133 which correspond to switches 23 described in U.S. Pat. No. 3,745,225 (Hall- July 10, 1973, hereafter the "'225 Patent"). The switch contacts are connected to output conductors 134 (corresponding to conductors 24 of the '225 Patent) by a coupling network 135 of the same type described in that patent. Conductors 134 are connected to a conventional 12 bit latch 138 which can be addressed and read by processing system 150.

Each of the keys of keyboard 88 represents at least one note pitched in at least one octave. One such note and octave is printed on the keys in FIG. 15. For example, key 90 is used to produce at least a C note pitched in octave 1, and key 106 is used to produce at least an E note pitched in octave 2. As explained in the '225 Patent, coupling network 135 is arranged so that the playing of any key on keyboard 88 which corresponds to a C note results in a logical one signal on the C conductor of group 134, irrespective of the octave in which the C note is pitched. For example, the C conductor in group 134 will be raised to a logical one state if any or all of keys 90, 102, 114 or 126 are depressed by a performer. As a result, the input to latch 138 represents each of the notes produced by a performer's manipulation of keyboard 88, but does not indicate in which octave any of the notes are pitched.

Musical style selector 140 comprises switches 142–146 by which a performer can select any one of the musical styles referred to in FIGS. 1–14. In response to the depression of one of switches 142–146, an accompaniment-type selection signal, preferably in the form of an eight bit word corresponding to the desired style, is stored in a conventional eight bit register contained within selector 140. The word is read by processing system 150 and is used in a manner described later. Of course, the instrument could be expanded to include other musical styles, depending on the size of the processing system desired. Those skilled in the art readily will be able to expand the scope of the instrument to include other musical styles based on the present teaching.

Figure 16:
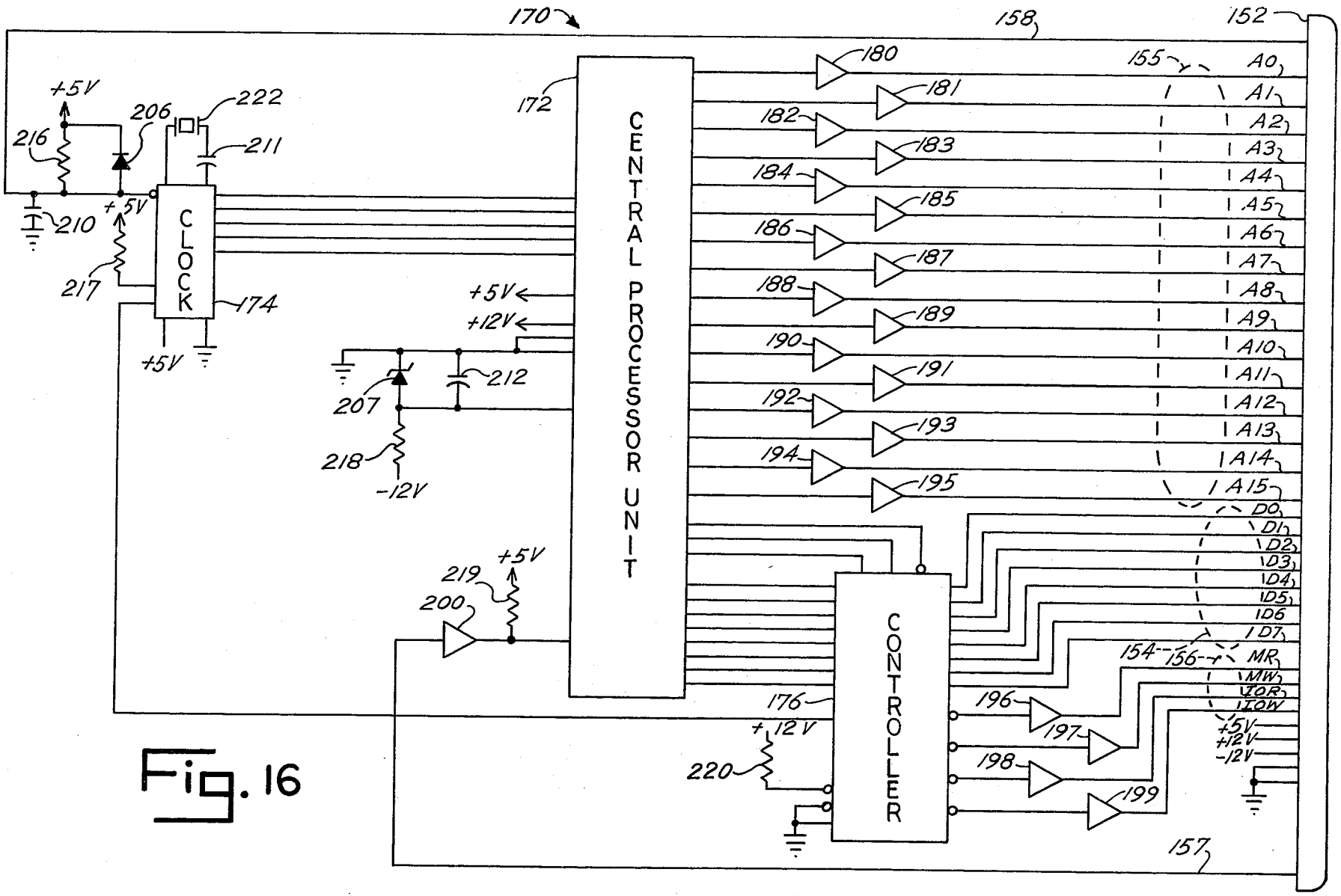
FIG. 16 is an electrical schematic diagram of a preferred form of a microprocessor made in accordance with the present invention.

Referring to FIGS. 15 and 16, processing system 150 comprises a communication bus 152 that is subdivided into an eight bit data bus 154, a sixteen bit address bus 155, a four bit read-write bus 156, an interrupt line 157 and a clock line 158.

The processing system also includes a program read only memory (ROM) 162 which stores instructions for the overall system. An orchestration and instrument ROM 164 stores digital information necessary for the production of the musical segments. A general purpose random access memory (RAM) 166 is used to hold intermediate variables and working data pointers used by a microprocessor 170 which performs sequential programmed logic functions in order to operate the system.

Referring to FIG. 16, microprocessor 170 comprises a central processor unit 172 which may be a general purpose microcomputer, such as model 8080 manufactured by Intel Corporation. The microprocessor also includes a processor clock 174 which may be a model 8224 manufactured by Intel Corporation, and a system controller 176 which may be a model 8228 manufactured by Intel Corporation. The microprocessor also includes amplifiers 180–200, diodes 206–207, capacitors 210–212, resistors 216–220, and a crystal 222, all connected as shown.

Referring to FIG. 17, microprocessor 170 also includes a four bit register 224 and an eight bit register 226 that comprises a carry bit CY, a most significant bit MSB and a least significant bit LSB. The purpose of a shift counter bit 228 is described later.

Referring to FIG. 15, a tempo clock 232 is provided in order to synchronize the system with the performer. The tempo clock may be speeded up or slowed down to suit the tempo at which the performer wishes to play. The tempo is established by rotating knob 234 which adjusts the rate at which tempo clock pulses are generated.

The tempo clock issues twelve tempo clock pulses per musical beat so that it can resolve a quarter note beat into eighth notes, sixteenth notes or triplets. A normal musical bar consists of four beats; each bar is broken into two parts, each of which has two beats. A waltz-type bar consists of three beats; each bar is broken into two parts, the first part being two beats and the second part being one beat.

The tempo clock is used by the system to establish a pattern for the repetition of the two bar musical segments, such as those illustrated in FIGS. 1–14. A segment is repeated after every two bars. That is, a normal segment consists of two normal bars, each made up of four beats so that an eight beat pattern results. A waltz segment consists of two waltz bars having three beats per bar, so that a six beat pattern results. A (4/4) time switch 235 and a (3/4) time switch 236 enable a performer to adjust the output of the tempo clock to the appropriate time pattern. Tempo clock 232 generates a downbeat pulse at the beginning of each musical bar which synchronizes the system in a manner described later. The downbeat pulse and tempo clock pulses are transmitted to other parts of the system over data bus 154 and conductor 238.

III. Harmony Recognition

Harmony selection system 86 cooperates with processing system 150 in order to recognize the harmony indicated by the depression of one or more keys of keyboard 88 by the performer. Of course, the preferred embodiment could be implemented with a chord organ-type pushbutton system in which a separate button is provided for each chord type and root note desired by the performer. However, such a pushbutton system is not satisfying to the more advanced musician who is used to playing on a keyboard in order to establish the harmony of his musical performance.

By using the following technique, the harmony desired by the performer can be recognized solely from his manipulation of keyboard 88. As used in this specification and claims, harmony means chord structure defined by chord type and root note. In order to recognize any chord type, the microprocessor attempts to match a representation of a playing key pattern with a corresponding chord type and root. In order to achieve this result, signal-responsive representations of various playing key patterns are stored in memory. A performer may express a desire for a particular chord type based on a particular root by depressing the playing keys according to a number of different patterns. For example, the performer may express a desire for C minor harmony (i.e., chord type minor, root C) by actuating any one of the following key patterns:

1. C, D#
2. C, D#, G
3. C, D#, G, B
4. C, D#, B
5. D#, F, A#
6. C, D#, F, A#

7. C, D#, F, G

These key patterns can be used by the processor in several ways in order to derive a chord type signal indicating the chord type desired by the performer and a root signal indicating the root note of the harmony desired by the performer. For example, the playing key patterns can be converted to digital signals representing addresses of memory locations which store signals defining the corresponding chord type and root of the key pattern. If the memory locations store the chord type and root signals at addresses corresponding to the key pattern representations, the chord type and root signals may be obtained by merely reading their values from the memory. In such an embodiment, the stored signal-responsive representations of the key patterns are created by the circuitry forming the memory addressing logic. This technique results in rapid processing, but requires a considerable amount of memory.

Alternatively, an algorithm could be developed which would represent each of the key patterns desired to be recognized as a particular chord type. In this case, the algorithm would be stored as a general representation of the key patterns.

As another alternative, the various key pattern representations can be stored as chord pattern signals in memory locations having addresses which indicate the chord type of the pattern. This is the arrangement which has been implemented in the preferred embodiment. More specifically, for each chord type desired to be recognized, a plurality of chord pattern signals representing corresponding key patterns are stored in memory locations having addresses related to that chord type. After the chord pattern signals have been stored, harmony selection system 86 generates a playing key pattern signal identifying the pattern of the playing keys actuated by the performer and also identifying at least one note represented by at least one of the actuated playing keys. The playing key pattern signal then is used in an attempt to locate a corresponding stored chord pattern signal. The chord type signal and root signal are derived from the corresponding chord pattern signal.

The following is a detailed explanation of the preferred form of harmony recognition. As previously explained, harmony selection system 86 produces on conductors 134, a multi-bit representation of the keys of keyboard 88 actuated by a performer. The note represented by an actuated key is represented on one of conductors 134 irrespective of the octave in which it occurs. For example, the C conductor of bus 134 is raised to a logical one state if any one of keys 90, 102, 114 or 126 representing C notes sounded in octaves 1, 2, 3 or 4 respectively, are actuated. Referring to FIG. 15 and 17, the twelve bit representation of the playing key pattern is stored in latch 138 and is transferred by processor 170 into four bit register 224 and eight bit register 226 over bus 152. If microprocessor 170 has a data bus of twelve bits or larger, the playing key pattern signal stored in registers 224 and 226 can be directly compared to the chord pattern signals stored in ROM 164 until a match is found. However, most microprocessors currently available have only an eight bit data bus. It has been discovered that only eight of the bits of the playing key pattern signal need to be compared with the eight bit chord pattern signals stored in memory in order to locate the proper chord type. This is an important feature which enables harmony recognition to be carried out by an eight bit microprocessor with a minimum of memory. The manner in which this unique operation can be achieved by the microprocessor is described in more detail in FIG. 19.

Figure 19:
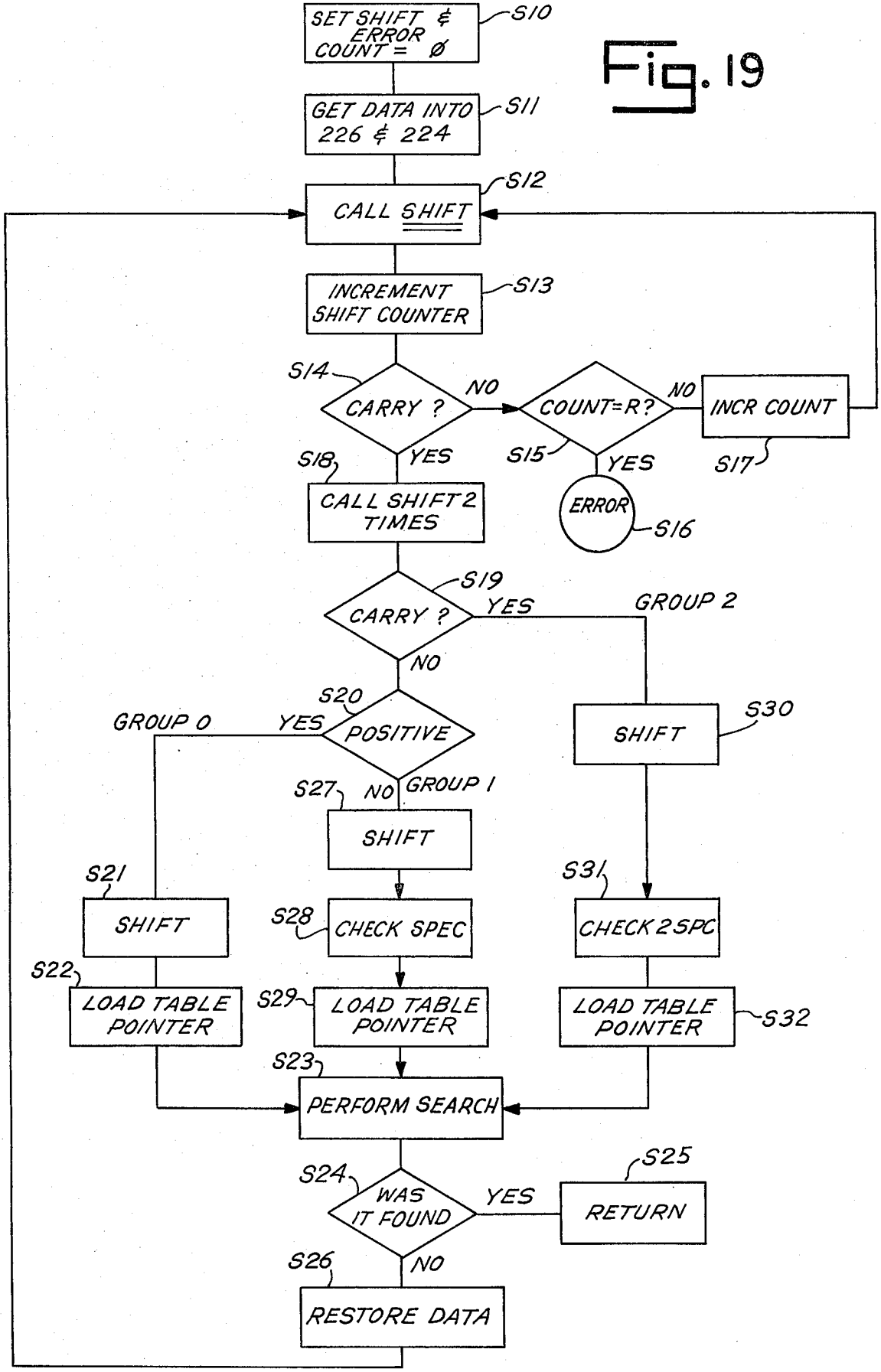
FIG. 19 is a flow chart illustrating the manner in which the processor determines the harmony desired by a performer.

FIG. 19 describes the harmony recognition routine of the program instructions stored in ROM 162. Briefly, the twelve bit playing key pattern signal stored in registers 224, 226 can be reduced to an eight bit representation by judiciously testing certain bits and properly grouping others.

Referring to FIG. 19, in step S10, shift counter 228 and a software error counter are set equal to zero. The playing key pattern signal then is transferred into registers 224 and 226 in step S11. In step S12, the data in the registers is rotated one bit position to the left. Shift counter 228 is then incremented in step S13, and the carry (CY) bit is examined to determine whether it is a logical one or a logical zero in step S14.

If the CY bit is a one, steps S18–S20 (FIG. 19) are used to examine the next three bits of data in order to divide the playing key pattern signal into one of three groups (i.e., group zero, one or two). Assuming the bit representing the first note in the chord is in the CY position, the bit in the MSB position need not be considered since it would represent a note pitched one chromatic step from the note represented in the CY position. No valid chord has this combination of notes. For example, if the player had played keys 90, 94 and 97, the C, E and G lines of conductors 134 would be switched to a logical one state. Assuming the bit representing the C is shifted into the CY position, a logical one bit in the MSB position would indicate that the performer had also played a C#. Since the C, C# combination would represent an invalid chord, the bit in the MSB position can be ignored. For this reason, the data can be rotated two more times in step S18 so that the bit representing a C# in the example is rotated beyond the CY position and ignored. This step then places the bits representing the keys corresponding to notes D and D# in the CY and MSB positions, respectively. If neither the D or D# notes were played by the performer, group zero is selected; if D# but not D was played by the performer, group one is selected; if D but not D# was played by the performer, group two is selected. The group selection process is carried out by steps S19 and S20. If, for example, group zero is selected, the data is rotated one more time in step S21, and a table pointer pointing to the group zero chord pattern signals in the memory is set up in step S22. A search of the group zero chord pattern signals in the memory is conducted in step S23. If a match is found between the remaining eight bits of the key pattern signal and the eight bits of the chord pattern signals stored in group 0, the harmony recognition routine returns to the main program through steps S24 and S25. If no match is found, the data located in registers 224 and 226 during step S14 is restored, and the process is repeated by returning to step S12.

In the event group one is selected, the register data is rotated in step S27, and the routine checks for any special chord pattern signals in step S28. The table pointer then is loaded in step S29, and the previously described search is performed on the group one chord pattern signals in step S23.

In the event group two is selected, the register data again is rotated in step S30, and the routine checks for special chord pattern signals in step S31. The table pointer again is loaded in step S32 and the same type of search is performed on the group two chord pattern signals in step S23.

Figure 18:
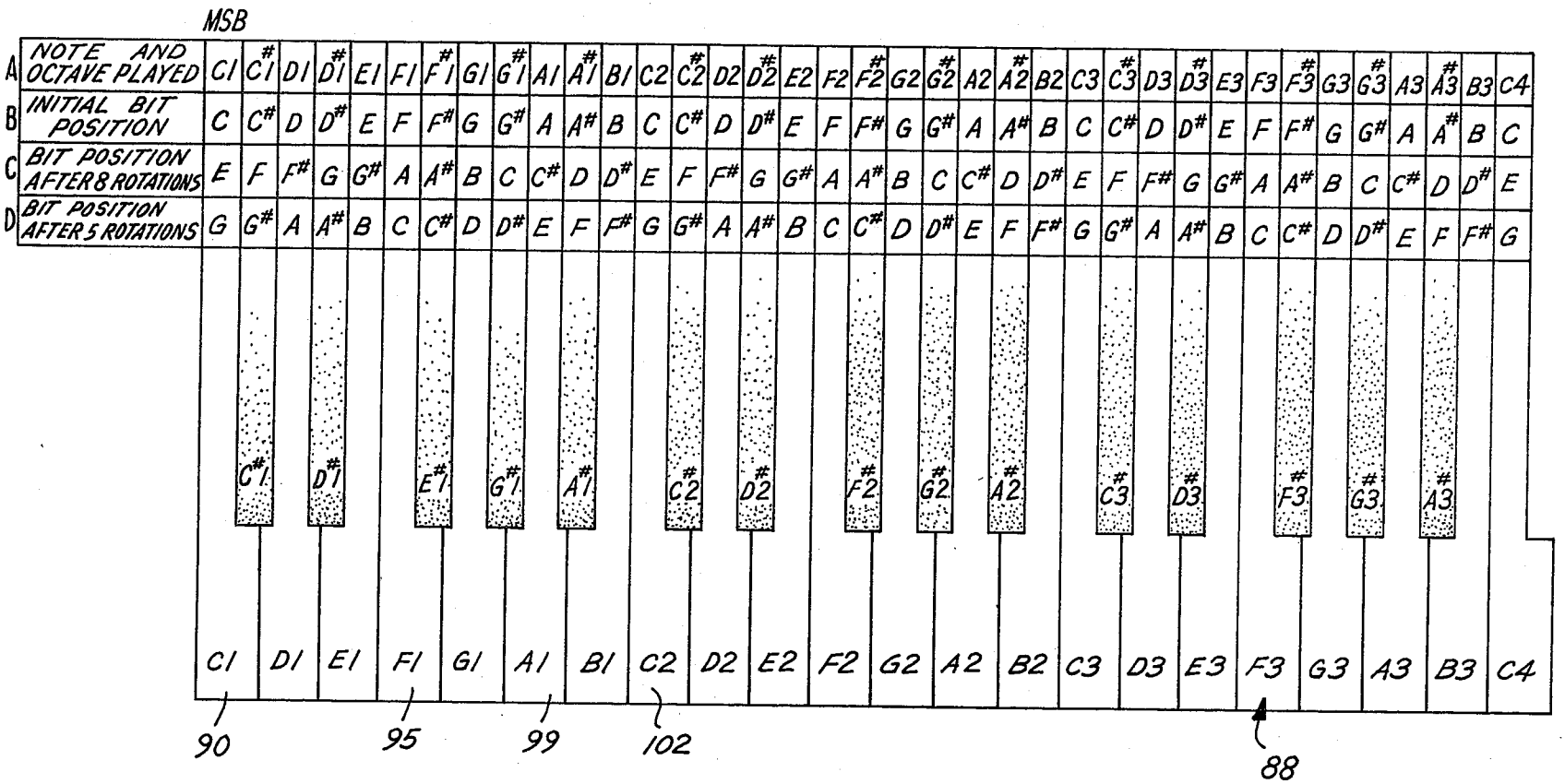
FIG. 18 is a chart illustrating the general operation of the registers shown in FIG. 17.

A better understanding of the unique techniques employed to determine the harmony desired by the performer may be obtained by the following example described in connection with FIGS. 17–19. Referring to FIG. 18, it will be assumed that the performer depresses keys 95, 99 and 102 representing notes F, A and C (thereby indicating that he desires a major chord having the root F). The depression of the keys will result in the playing key pattern signal shown in line A of FIG. 17. The note represented by each bit of the playing key signal is shown by the letters placed below registers 224 and 226 on each of lines A–J in FIG. 17. In accordance with step S12 (FIG. 19), the data is rotated one step to the left as shown in line B (FIG. 17), and shift counter 228 is incremented. After step S18 (FIG. 17), the data takes on the form shown in line C from which the routine determines that group zero should be searched. After step S21, the resulting data is shown in line D of FIG. 17. The table pointer is then loaded and the search performed, but no pattern in group zero corresponds to the pattern shown in line D.

As a result, step S24 is answered in the negative, and the data originally present at step S14 is restored, as shown in line E of FIG. 17. During the data restoration, the LSB bit is incremented to conform with the value of the carry bit CY, so that the data is accurately rotated during subsequent steps. The routine then returns to step S12 which shifts the data as shown in line F of FIG. 17. Since the carry bit, as well as the next three most significant bits, are zero, steps S15–S17 are followed for three additional rotation operations until the data is stored as shown in line G of FIG. 17. After the next shift is performed by step S12, the data is arranged as shown in line H of FIG. 17. Since a logical one is now shifted into the carry position, the routine proceeds through step S18 which rotates the data twice and results in the configuration shown in line I of FIG. 17. Steps S19 and S20 determine that group zero again should be searched, and this procedure is accomplished in steps S21, S22 and S23. Since the eight bit chord pattern illustrated in register 226 at line J is held in ROM 164, the routine detects a match, and returns to the main program through steps S24 and S25.

The chord pattern signal resulting in the match is stored at an address which corresponds to the chord type (major) of the played key pattern (i.e., FAC). The root note is derived from the value of the shift counter according to the following root table:

| Value of Counter 228 | Root Note |
|---|---|
| 1 | C |
| 2 | C# |
| 3 | D |
| 4 | D# |
| 5 | E |
| 6 | F |
| 7 | F# |
| 8 | G |
| 9 | G# |
| 10 | A |
| 11 | A# |
| 12 | B |

As shown in line J of FIG. 17, the shift counter value (6) at the time the match occurs corresponds to the root (F) of the chord played by the performer. The chord type signal and root signal are transferred by the processor to other memory locations for use in generating musical segments in a manner described later.

One unique feature of the harmony recognition routine is that the maximum number of searches of the memory is no greater than the number of keys that are depressed by the performer. This unique operation is achieved by steps S14–S17 which continue to shift data until the carry bit (corresponding to a depressed key) is found to be a logical one.

By dividing the chord pattern signals into three groups, only a small number of entries in the memory must be searched for any particular arrangement of data in register 226. These unique features enable the harmony desired by the performer to be selected from a standard keyboard with a minimum of memory and a minimum of processor time.

FIG. 18 illustrates how the data representing any combination of played keys is shifted through registers 224,226. Line A represents the notes and octaves resulting from the playing of the keys aligned with the entries in line A. Line B illustrates the notes initially represented by the bit positions in registers 224,226. Lines C and D illustrate the notes represented by the bit positions of registers 224,226 after 8 and 5 data rotations respectively. With the aid of FIG. 18, those skilled in the art can readily trace the rotation of data representing any combination of played keys.

IV. Output Hardware

Referring to FIG. 15, output system 250 comprises identical voice systems 251–256. Each of the voice systems is capable of simulating a separate instrument or voice by which segments of musical accompaniment can be expressed. At any one time, any voice system can sound like any instrument the system is capable of simulating. In other words, the individual voice systems are not confined to a single voice or instrument simulation.

Each of the voice systems can be understood from the following description of system 251. System 251 basically comprises an oscillator circuit 260, a harmonic spectrum adjuster 430, an envelope generator 590 and a modulator 700.

Figure 20:
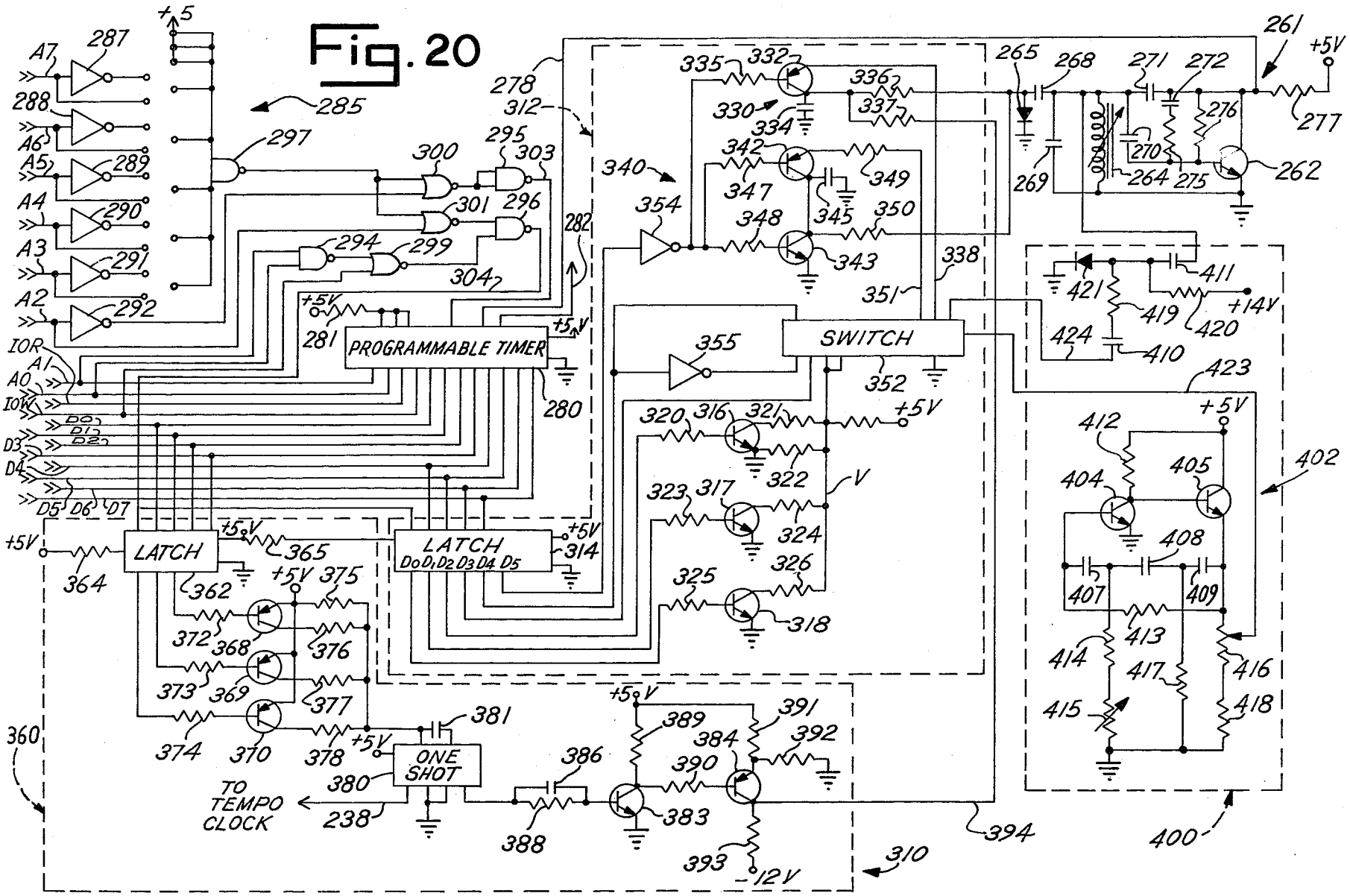
FIG. 20 is an electrical schematic diagram of a preferred form of oscillator made in accordance with the present invention.

Referring to FIG. 20, oscillator 260 basically comprises an oscillator circuit 261, a selection circuit 285, a portamento module 310, and a vibrato module 400. Oscillator 261 includes a transistor 262, an inductor 264, a diode 265, capacitors 268–272 and resistors 275–277, connected as shown. The signals generated by the oscillator are transmitted to an input of a programmable timer 280 over a conductor 278. The timer can be implemented by Intel Model No. 8253 which is operated in mode 3, the square wave generator mode, and is described in the Intel data catalogue for 1977 at page 10–159. The timer is biased by a resistor 281 and generates square wave pulses on a conductor 282 at a repetition rate determined by the frequency of the oscillator and the interaction between the oscillator and the other modules shown in FIG. 20.

The operation of oscillator circuit 260 is controlled by the data processor over bus 152 under the supervision of selection circuit 285. Selection circuit 285 includes inverters 287–292, NAND gates 294–297, and NOR gates 299–301. Appropriate inverters are connected to gate 297 depending on the precise addressing code used on conductors A2–A7. By transmitting the proper bit pattern over the address bus, either a pitch select line 303 or a portamento select line 304 is raised to a logical one state. In the event the pitch line is selected, timer 280 is enabled to receive information over data bus D0–D7 which determines the repetition rate of the square wave pulses produced on output conductor 282. In the event the portamento line is selected, the portamento module is enabled to receive information over the data bus which controls the pitch and rate of the portamento feature.

Portamento module 310 includes a portamento pitch control circuit 312 comprising an addressable latch 314 which receives information from the data bus. The latch, in turn, controls transistors 316–318 and associated resistors 320–326 which generate a voltage V that determines the upper and lower portamento pitches.

Module 310 also includes a portamento slide up circuit 330 comprising a transistor 332, a capacitor 334 and resistors 335–337 connected as shown. A portamento slide down circuit 340 is also provided by connecting transistors 342,343, a capacitor 345 and resistors 347–350 as shown. The portamento slide up and slide down circuits are controlled by a quad bilateral switch 352 and by inverters 354,355.

Module 310 also includes a portamento rate control circuit 360 comprising an addressable latch 362, resistors 364–365, switching transistors 368–370, resistors 372–378, a one shot multi-vibrator 380 controlled by a timing capacitor 381, and an amplifier circuit comprising transistors 383,384, a capacitor 386, and resistors 388–393. The output of the amplifier circuit is transmitted over a control line 394 to portamento slide up circuit 330.

Vibrato module 400 includes an oscillator 402 containing transistors 404,405, capacitors 407–411, resistors 412–420 and a diode 421, all connected as shown.

Assuming neither the portamento nor vibrato features are used, oscillator 261 generates a signal which is a multiple of the frequency desired for voice system 251. If a lower frequency is desired, a divisor number equal to the divisor required to achieve that lower frequency is transmitted to timer 280 over the data bus. The timer divides the frequency of the input from oscillator 261 by said divisor number in order to produce pulses on conductor 282 having a repetition rate corresponding to the desired frequency or pitch of the note produced by system 251.

Voice system 251 can be instantaneously quieted or silenced by entering the proper data in timer 280 from data bus 154. The timer then enters a non-counting mode which prevents output pulses on conductor 282. This mode of operation is controlled by a QUIET software routine described later.

If a vibrato sound is desired, output D3 of latch S14 is raised to a logical one state by means of the data bus, thereby causing switch 352 to connect conductors 423, 424. As a result of this operation, oscillator 402 is connected with oscillator 261. Oscillator 402 causes the bias on diode 421 to vary periodically, so that the frequency of oscillator 261 is periodically varied.

If the musical segment calls for a portamento slide up to a defined note, outputs D0–D2 of latch 314 are set to values which will cause transistors 316–318 to produce a voltage V corresponding to the starting pitch of the portamento slide. Output D4 of latch 314 then is switched to a state which will cause switch 352 to interconnect voltage V with conductor 338. At the same time, transistor 332 is switched to its conductive state by output D5 of latch 314 and inverter 354, so that capacitor 334 is charged to voltage V. This process increases the control voltage on oscillator 261, thereby decreasing the oscillator frequency to a value established by voltage V. Diode 265 operates as a voltage-sensitive variable impedance which changes the time constant of the oscillator feedback circuit. When the portamento slide is to commence, transistor 332 is switched off through the operation of latch 314, and the voltage across capacitor 334 decreases to its normal value, thereby increasing the frequency of oscillator 261 to its normal value.

In the event that the musical segment calls for a portamento slide down from a defined note to an undefined note, transistors 316–318 again establish a value V that determines the ultimate pitch at the bottom of the slide, and switch 352 enables the voltage V to be connected to conductor 351. At the same time, latch 314 and inverter 354 cause transistor 343 to be switched to its conductive state, so that capacitor 345 is discharged to ground potential, and oscillator 251 operates normally. When the portamento slide down is to commence, the state of inverter 354 is reversed so that transistor 343 turns off and transistor 342 turns on. Capacitor 345 then charges to voltage V, thereby increasing the control voltage on oscillator 261 and causing a decrease in the frequency of its output.

The rate at which the portamento slide up or slide down proceeds is controlled by circuit 360. One shot 380 receives tempo clock pulses from tempo clock 232 through conductor 238, and transforms the tempo clock pulses into constant width pulses. As a result, when the rate of the tempo clock increases, the duty cycle of the pulses from one shot 380 increases. The time constant of one shot 380 is controlled through transistors 368–370 which can be turned on or turned off through latch 362 by means of the data bus. This novel circuitry enables the pulse width of one shot 380 to be programmed.

As the duty cycle of the pulses produced by one shot 380 increases, the average amount of negative voltage applied to conductor 394 per cycle increases. As a result, capacitor 334 discharges and capacitor 345 charges more rapidly, thereby increasing the rate of the portamento slide up or slide down. This is an important feature which automatically increases the rate of the slide as the rate of the tempo clock increases. By using this novel technique, the circuitry automatically speeds up the rate of the portamento slide as the performer speeds up his music. The portamento slide automatically proceeds at a rate appropriate to the desires of the performer as indicated through his setting of knob 234 of the tempo clock.

Figure 21:
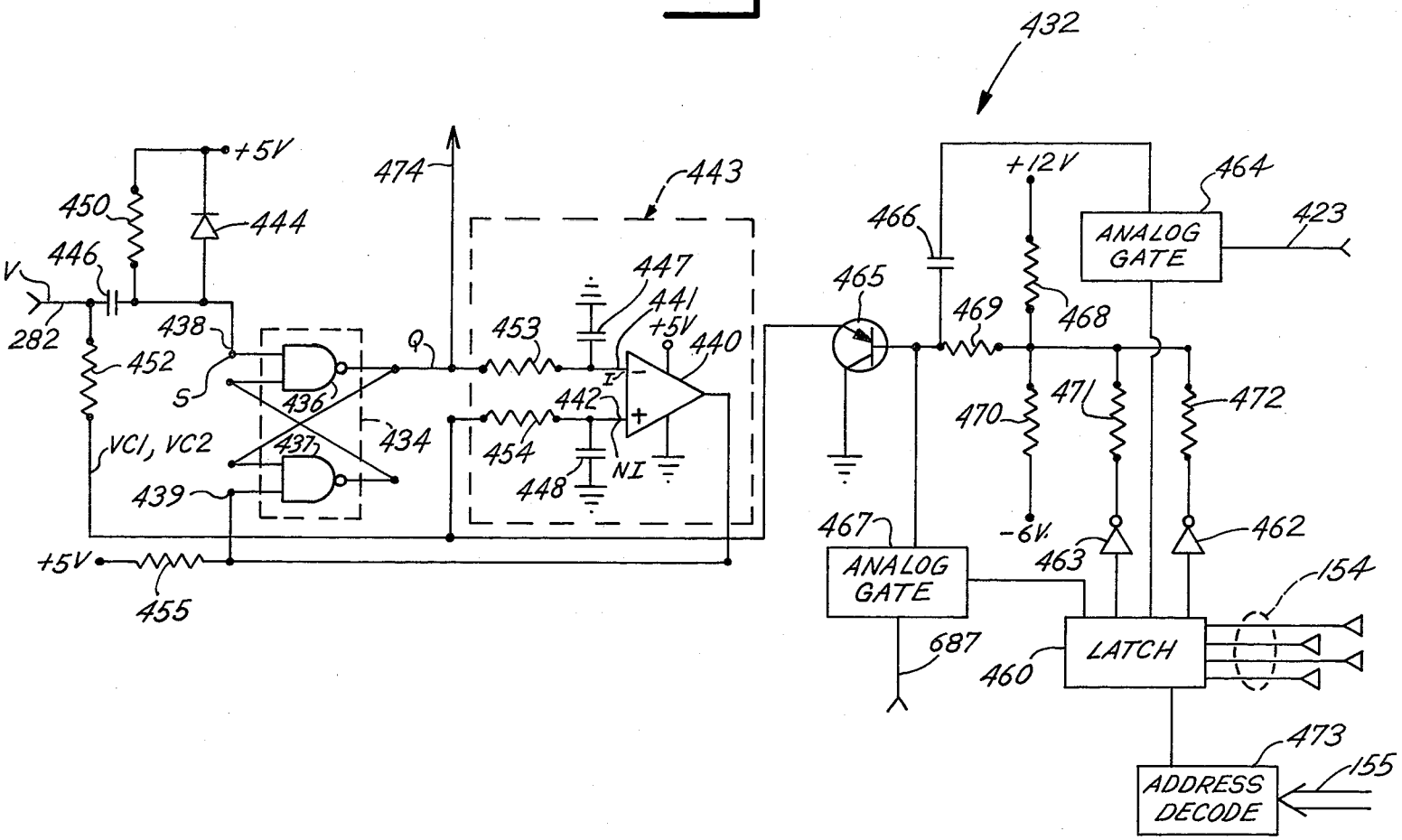
FIG. 21 is an electrical schematic diagram of a preferred form of duty cycle adjustment circuit made in accordance with the present invention.

Referring to FIG. 21, harmonic spectrum adjuster 430 comprises a duty cycle adjusting circuit 432 that includes a flipflop 434 consisting of NAND gates 436,437, a set input 438 and a reset input 439. An operational amplifier 440 having an inverting input 441 and a noninverting input 442 is configured as a balanced comparator 443. The input signal from conductor 282 is differentiated by a capacitor 446 and a resistor 450, and the positive pulse resulting from the differentiation is removed by a diode 444. Additional capacitors 447,448 and resistors 451–455 are connected as shown. Resistors 453,454 have the same value and capacitors 447,448 have the same value in order to provide a balanced comparison by amplifier 440.

The overall operation of the circuit is controlled from a latch 460 through inverters 462,463 and analog gates 464,467. The latch controls the operation of a transistor 465 which is associated with a capacitor 466 and resistors 468–472, connected as shown. Latch 460 is enabled to receive data from data bus 154 by means of a conventional address decode circuit 473 which is controlled through address bus 155.

Figure 21A:
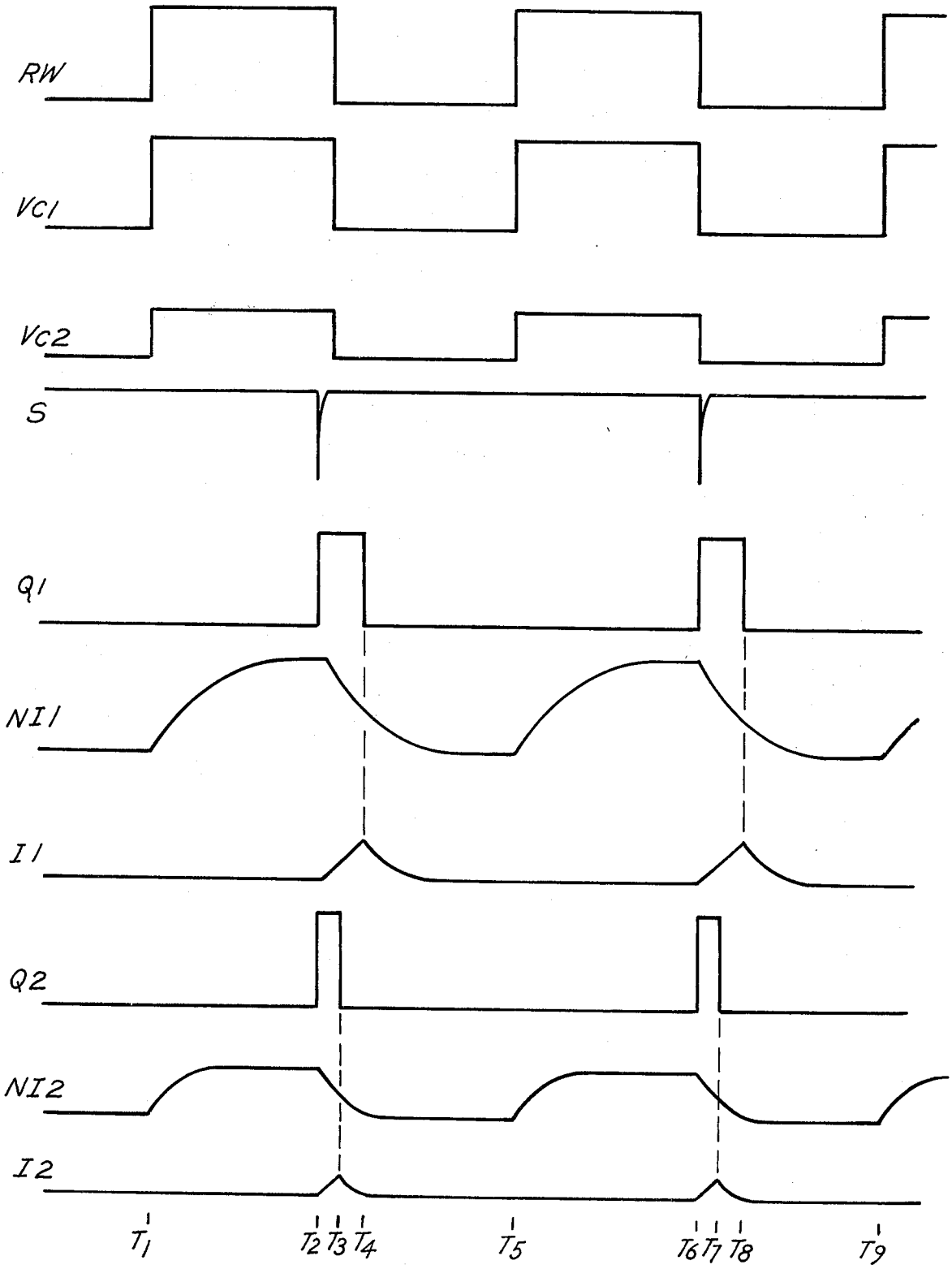
FIG. 21A is a timing diagram illustrating voltage waveforms generated by the like-lettered parts of the circuit shown in FIG. 21.

Referring to FIG. 21A, circuit 432 accepts rectangular wave pulses (such as RW) on input conductor 282 and adjusts the width of the pulses before they are transmitted to an output conductor 474. The input rectangular wave is differentiated by capacitor 446 and resistor 450, and the positive pulse resulting from the differentiation is removed by diode 444. The remaining negative pulse (s) is transmitted to set input 438 which forces the Q output of flipflop 434 to a logical one state at time T2. During time T1–T2, voltage pulse VC1 is integrated by capacitor 448 and resistor 454 to form voltage NI1, thereby forcing the output of opamp 440 to a logical one state. At time T2, voltage Q from the Q output of flipflop 434 begins to be integrated by resistor 453 and capacitor 447 and voltage I1 increases. Also at time T2, voltage NI1 begins to decay because input voltage VC1 has returned to its zero state. At time T4 when the voltage across capacitor 447 equals the voltage across capacitor 448 (i.e., when NI1-I1), the output of opamp 440 is switched to its zero state, thereby resetting flipflop 434 and forcing the Q output to its zero state. The Q output then remains at its zero state until the next negative S pulse is received through capacitor 446.

The width of the resulting output pulse Q on conductor 474 depends upon the time required for the voltage at input 441 to equal the voltage at input 442. The pulse width varies with the repetition rate of the input pulses, but the duty cycle remains constant. The duty cycle, however, can be varied by changing the level of the rectangular wave VC1 through the operation of transistor 465. Transistor 465 clamps the peaks of the input rectangular wave at about 0.6 volts above the voltage of the base of transistor 465. The voltage at the base of transistor 465, in turn, can be controlled in three ways:

1. Latch 460 can be conditioned through data bus 154 to transmit current through either resistor 471 or 472, thereby varying the base voltage.
2. Latch 460 can be conditioned through data bus 154 to open analog gate 467, thereby controlling the base voltage with the output of envelope generator 590. This mode of operation can achieve a "WAH" effect which is useful for simulating some orchestral sounds.
3. Latch 460 can be conditioned through data bus 154 to open analog gate 464, thereby controlling the base voltage with the output of vibrato oscillator 400.

The effect of transistor 465 on the operation of circuit 432 is illustrated by waveforms VC2, Q2, NI2 and I2 in FIG. 21A. Assuming the voltage on the base of transistor 465 is reduced, voltage VC2 is reduced compared to voltage VC1. Voltage N12 then is integrated to a reduced value during time period T1–T2. Since voltage N12 is reduced, it decays to a lower value more quickly than voltage NI1, and NI2=I2 more quickly than NI1=I1. As a result, Q is returned to its zero state at time T3, earlier than time T4, and a narrower output pulse Q2 results. By using the foregoing circuitry, the duty cycle is predictable and is expressed by the formula: Duty %=V1/2V2, where V1=maximum voltage of clamped pulse Vc, and V2=maximum voltage of input pulse RW.

The provision of duty cycle adjusting circuit is an important feature which improves the ability of the system to create different types of orchestral sounds requiring different harmonic spectrums. For example, the circuit provides a 50% duty cycle for a clarinet-type sound, and a 12.5% duty cycle for a string-type sound.

The operation of the duty cycle adjustment circuit is drastically improved by the balanced nature of comparator 443. Absent the balanced comparator feature, changes in the repetition rate of the input pulses would result in changes in the duty cycle of the output pulses. Due to the unique balanced component arrangement of the comparator, the errors due to changes in repetition rate at one of the opamp inputs balances the errors due to changes in repetition rate at the other opamp input, thereby enabling the adjustment of the duty cycle of the output pulses with great accuracy irrespective of the repetition rate of the input pulses.

Figure 22:
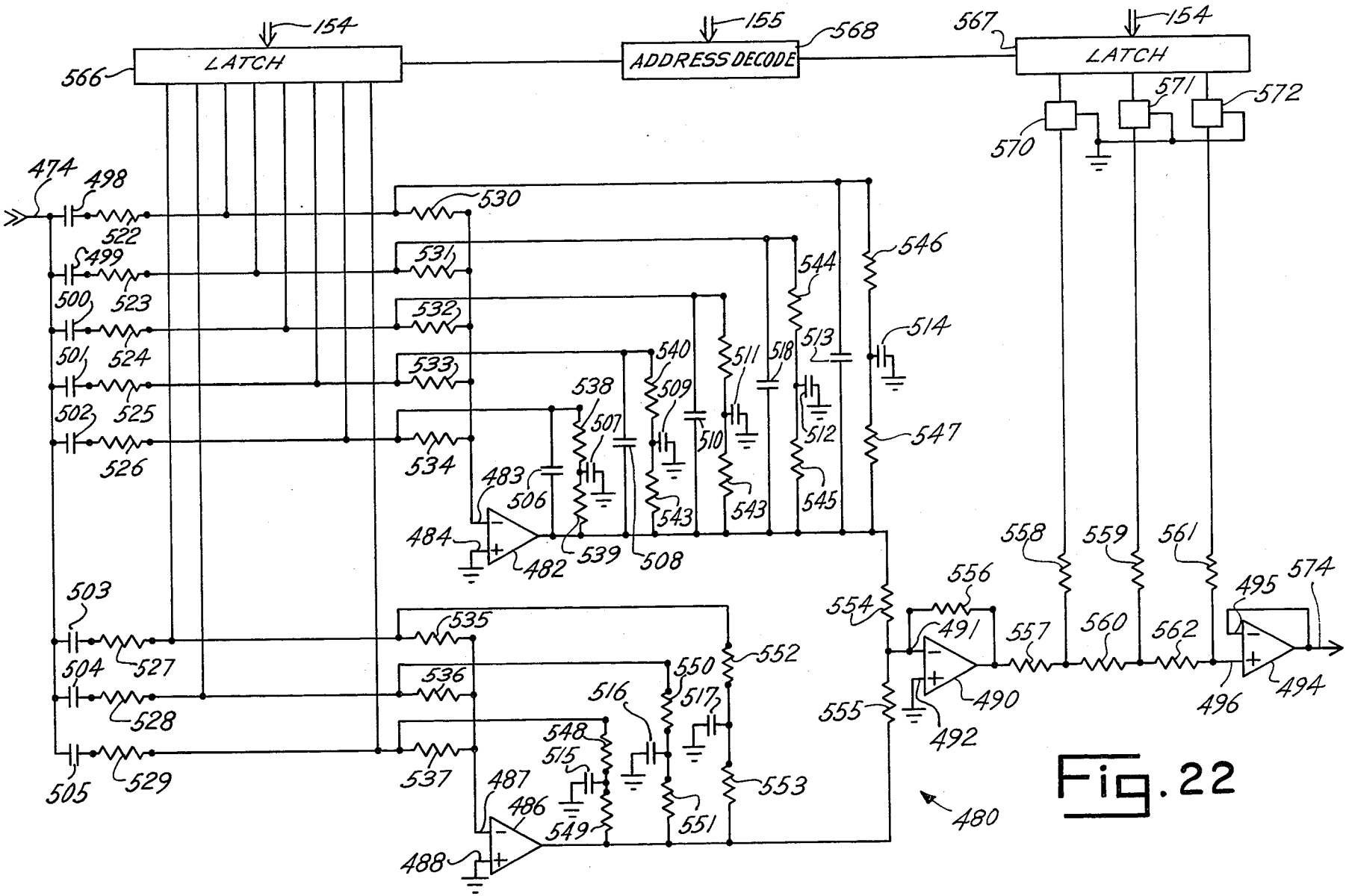
FIG. 22 is an electrical schematic diagram of a preferred form of programmable filter made in accordance with the present invention.

Referring to FIG. 22, harmonic spectrum adjuster 430 also comprises a programmable filter 480. The filter includes operational amplifiers 482,486, 490 and 494 having inverting inputs 483, 487, 491 and 495, respectively, and non-inverting inputs 484, 488, 492 and 496, respectively. The filter also includes capacitors 498–518, resistors 522–562, latches 566,567, an address decoder 568, open collector gates 570–572 and an output conductor 574, all connected as shown. When enabled by address decoder 568, latch 566 enables one or more of the resistor-capacitor pairs to be connected into the feedback loops of operational amplifiers 482 or 486 in order to provide adjustable filtering of the pulses received on input conductor 474. When enabled by address decoder 568, latch 567 enables one or more of resistors 558–561 to be connected into the output of operational amplifier 490 through gates 570–572 in order to provide variable attenuation of the filtered signals.

Figure 23:
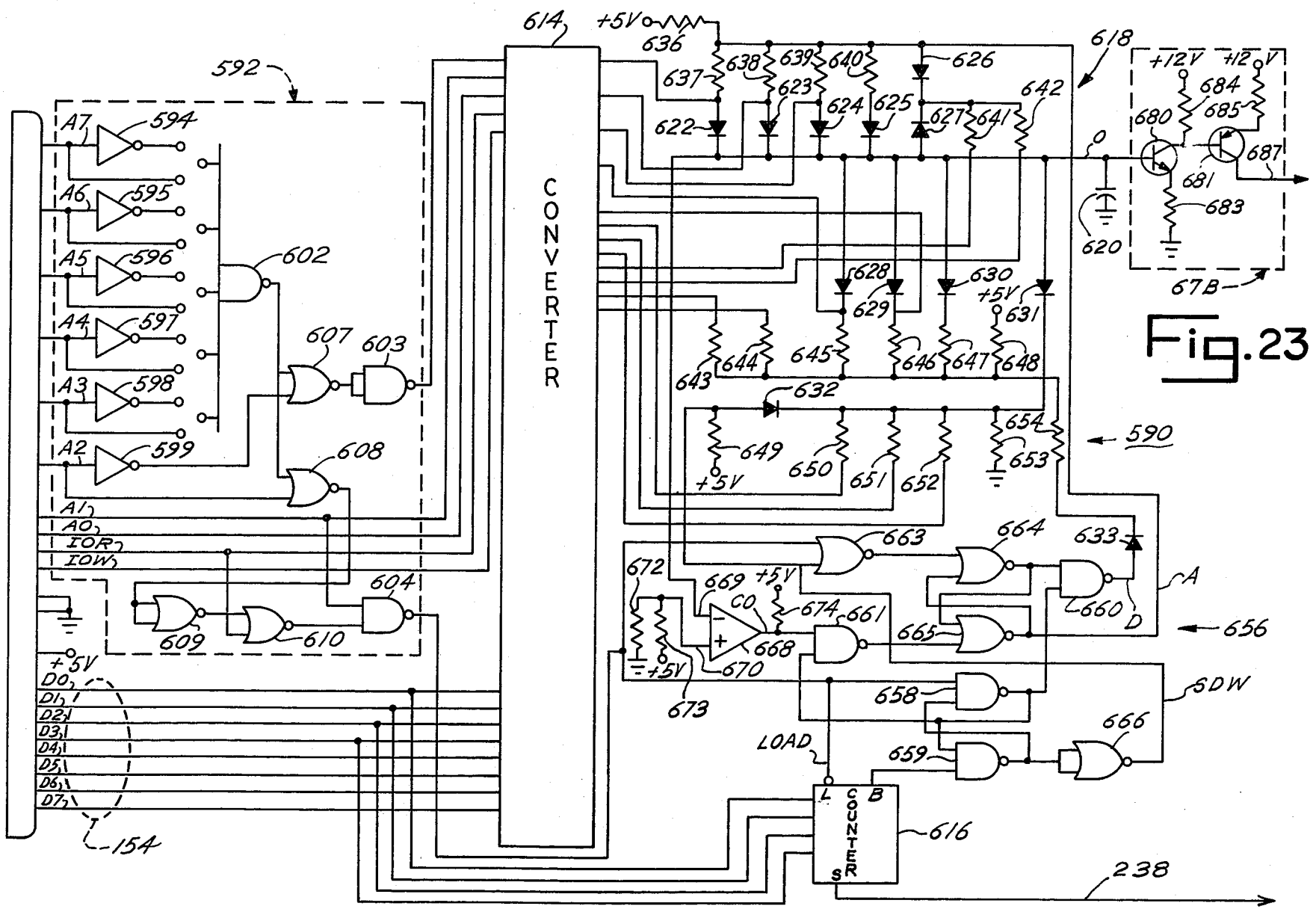
FIG. 23 is an electrical schematic diagram of a preferred form of envelope generator made in accordance with the present invention.

Referring to FIG. 23, envelope generator 590 basically comprises an address decoding circuit 592, a parallel-to-parallel converter 614, a counter 616, a time constant circuit 618, a control logic circuit 656 and an output amplifier 678.

The address decoding circuit includes inverters 594–599, NAND gates 602–604 and NOR gates 607–610. The decoding circuit is responsive to signals on the address bus to enable converter 614 or counter 616 to receive information from data bus 154. Converter 614 is a 12-bit wide, open collector latch in which the outputs are grounded or allowed to float under programmed control.

Time constant circuit 618 comprises a timing capacitor 620, diodes 622–633 and resistors 636–654, all connected as shown.

Control logic circuit 656 includes NAND gates 656–661, NOR gates 663–666, an operational amplifier 668 having an inverting input 669 and a non-inverting input 670, and resistors 672–674, all connected as shown.

Output amplifier 678 includes transistors 680,681, resistors 683–685 and an output conductor 687.

Figure 24:
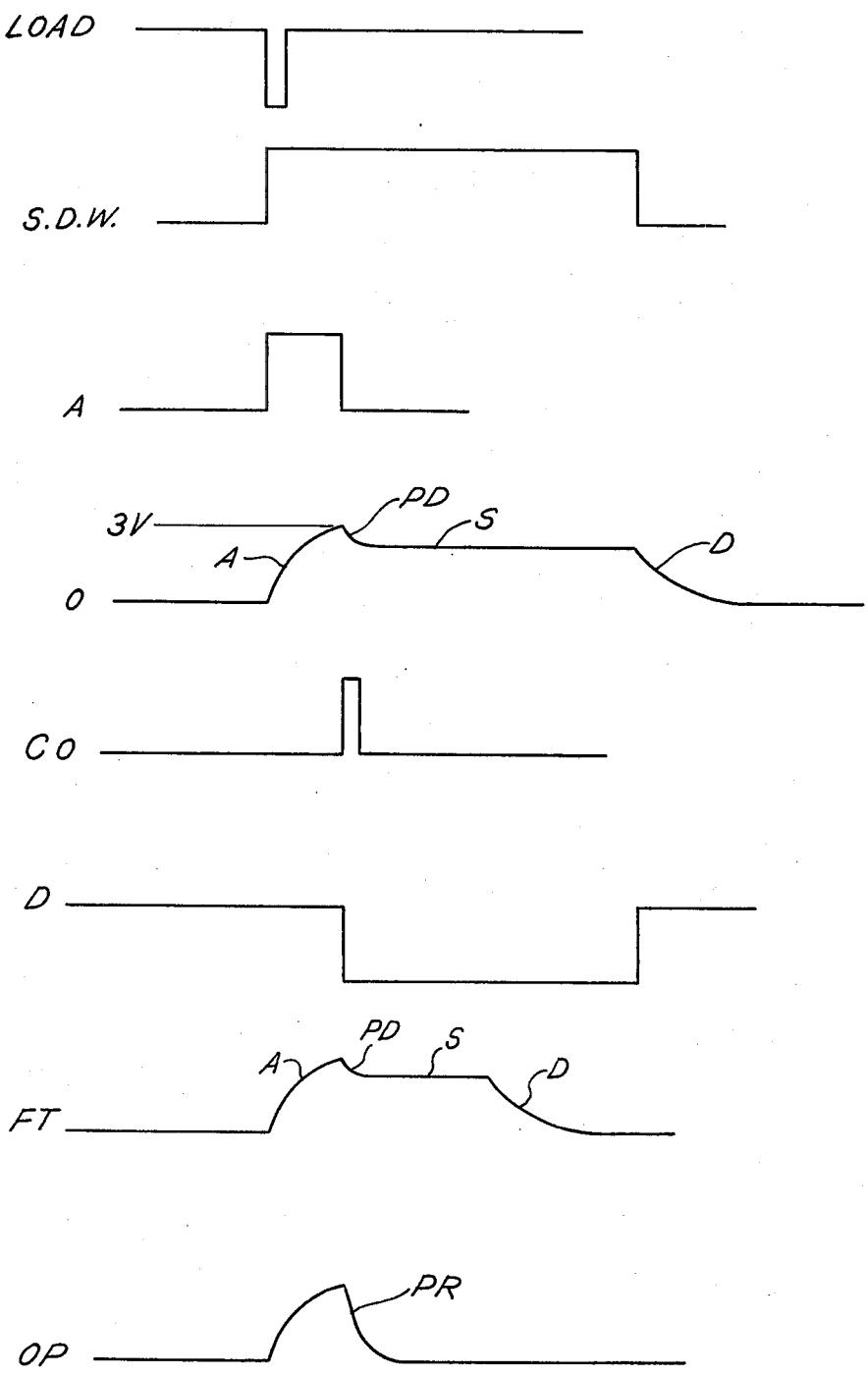
FIG. 24 is a timing diagram illustrating voltage waveforms generated by the like lettered parts of the envelope generator shown in FIG. 23.

Envelope generator 590 produces an output envelope voltage signal of the type shown opposite waveform O in FIG. 24. The envelope includes an attack portion A, a percussive decay portion PD, a sustain portion S, and a release decay portion D. Each of these portions of the envelope can be changed under programmed control.

In order to operate the generator, parameter signals defining the attach, percussive decay, and release decay portions of the envelope and the sustain level are transmitted over the data bus to converter 614. These parameter signals are stored by converter 614 so that the appropriate resistor-diode pairs of time constant circuit 618 produce an envelope of the proper shape. In order to commence operation, the microprocessor addresses circuit 592 which causes the load input of counter 616 to switch to its zero state. At the same time, counter 616 is loaded through data bus 154 with a number proportional to the proper time duration for the envelope being created. When the load input is switched to its zero state, NOR gates 663–665 cause signal A to switch to its one state, thereby commencing the attack portion of the envelope. Waveform A (FIG. 24) enables one or more of diodes 622–625 to charge capacitor 620. As soon as the voltage across capacitor 620 reaches the trigger voltage of the comparator formed by operational amplifier 668 (approximately three volts), the output of the comparator (waveform CO, FIG. 24) switches state, and signals A and D go to their zero states, thereby initiating the percussive decay (PD) portion of the envelope. During the percussive decay portion, current flows from capacitor 620 through one or more of diodes 628–630 until the sustain level S is reached. The sustain level is determined by the value of resistor 648 and the value of one or the other of resistors 643 and 644 which operate under programmed control.

Counter 616 is decremented by tempo clock pulses from conductor 238. When the duration count loaded in counter 616 is decremented to zero, the borrow output of the counter reverts to its zero state, thereby initiating the release decay (D) portion of the envelope. During the release decay portion of the envelope, signal D is switched to its one state and signal SDW is switched to its zero state, enabling current from capacitor 620 to discharge through diode 631 and one or more of resistors 650–653.

Waveform FT (FIG. 24) illustrates the envelope voltage produced by generator 590 when the same parameter signals resulting in waveform O are used, but the rate of the tempo clock is increased. Portions A,PD and D and the sustain level (S) remain the same, but the duration of the sustain time period (defined by signal SDW) is decreased.

Waveform OP (FIG. 24) illustrates the envelope voltage produced by generator 590 for a percussive instrument, such as a banjo. The normal sustain level is ignored, and a percussive release portion PR is generated. The time constant of the PR portion is controlled by the value of resistor 641 or 642.

Figure 24A:
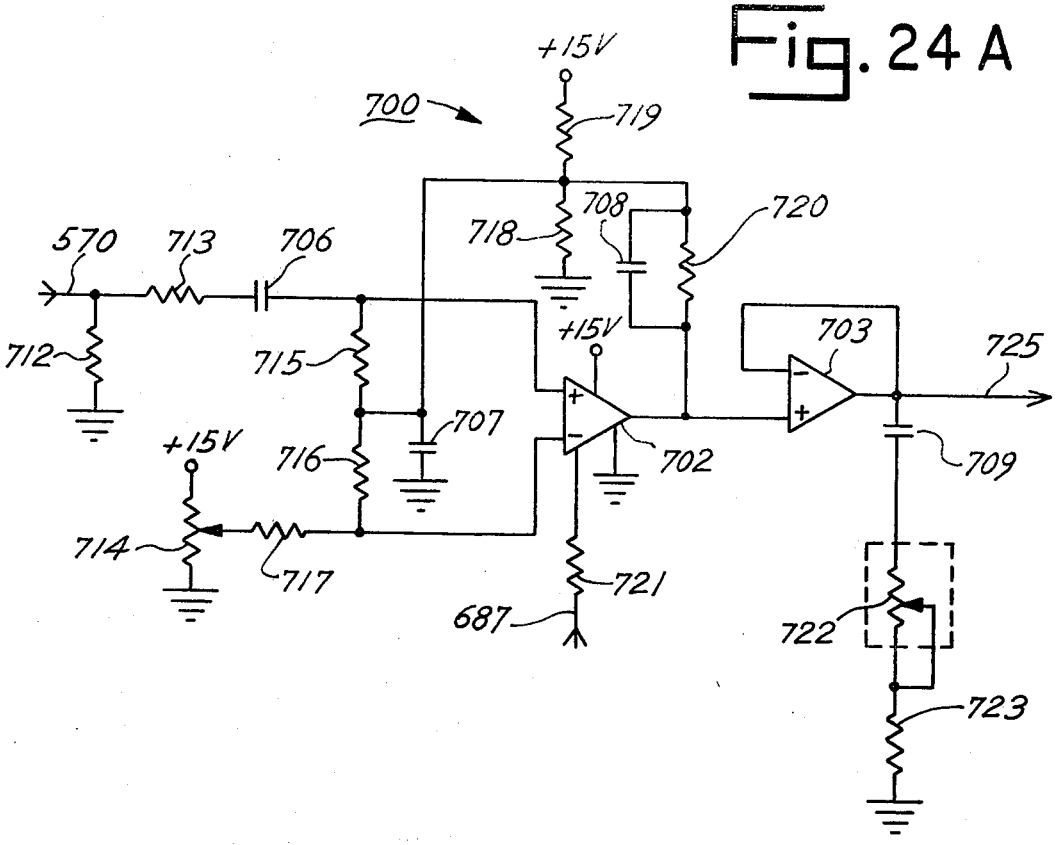
FIG. 24A is an electrical schematic diagram of a preferred form of modulator made in accordance with the present invention.

Referring to FIG. 24A, modulator 700 comprises operational amplifiers 702,703, capacitors 706–709 and resistors 712–723, connected as shown. The modulator modulates the filtered audio signals received from harmonic spectrum adjuster 430 in accordance with the envelope signal received from envelope generator 590 in order to produce one note of a musical accompaniment on an output conductor 725. The not represents one pitch of one instrument or voice. Other pitches and instruments can be represented by additional voice systems 252–256.

V. Overall Operation

Figure 25:
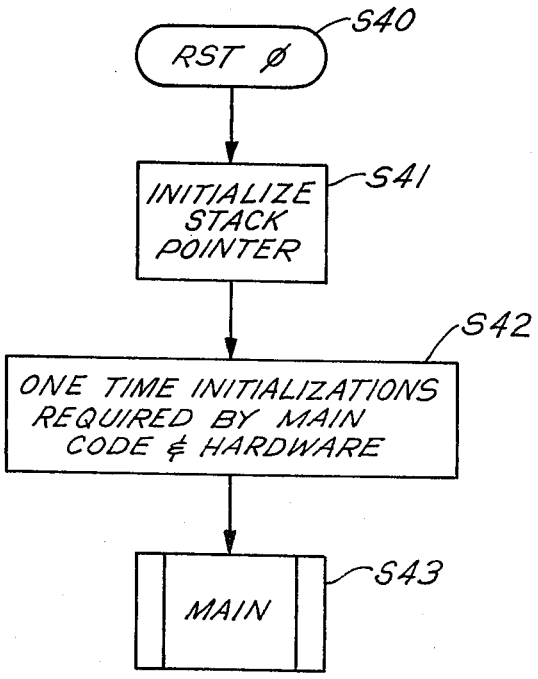

The overall musical instrument is controlled by means of a program stored in ROM 162 which is executed by microprocessor 170. When the instrument is turned on, there are several one-time initialization functions which are performed. Various counters, pointers and variables are initialized by a program called INITLZ. A working area in RAM 166 is set up for stack pointers used by various programs, and a means for swapping these pointers is provided. Each of these initialization procedures is described in steps S40–S43 of the flow chart of FIG. 25.

Figure 26:
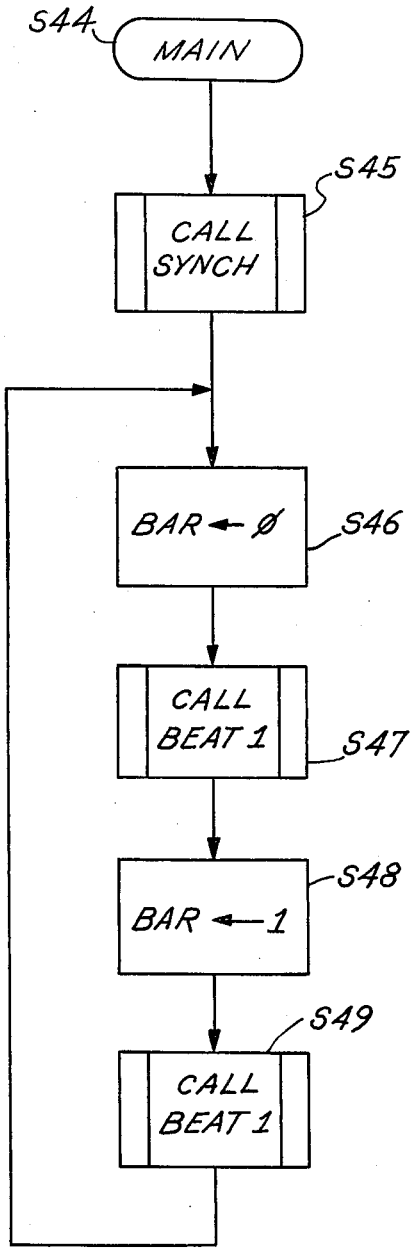

Referring to FIG. 26, the program called Main works on a hilosophy of four levels. The outer level responds to the musical style (e.g., bossa nova, big band, etc.) selected by the performer, and arranges the logic for two complete musical bars. The second or bar level arranges for the output of four beats for a normal bar and three beats for a waltz bar. The third or beat level arranges for the output of twelve tempo clock pulses. The fourth or clock pulse level locates the proper orchestration and instrument data stored in ROM 164, creates the requisite parameter signals, and outputs the parameter signals to the voice systems in order to create the accompaniment sound.

As shown in step S45 of FIG. 26, the Main program first performs a synchronization function which enables the system and tempo clock 232 to use the same clock pulse as a down beat. Main waits in a loop until it detects a down beat condition and then allows continuation of the program. Main then enters an endless loop which is the outer loop for playing the two-bar pattern. The variable BAR is assigned the value 0 in step S46, and the routine BEAT 1 is called in step S47. BEAT 1 plays one bar (three or four beats) which is identified by the contents of the variable BAR. If BAR is assigned the value 0, the first bar is played; if BAR is assigned the value 1, the second bar is played (See steps S48 and S49). The foregoing loop is performed continuously, alternately playing bar 1 and then playing bar 2.

Figure 27:
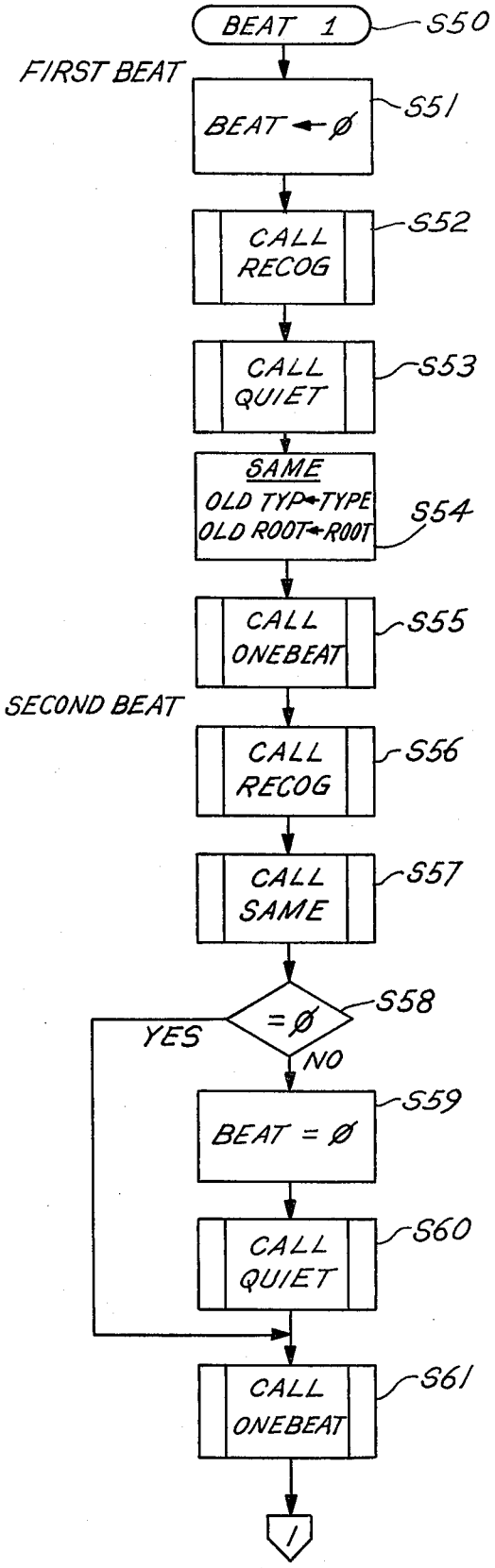

The BEAT 1 routine called by Main is described in the flow charts of FIGS. 27 and 28. Referring to FIG. 27, BEAT 1 determines when chords are recognized (with respect to beats in a bar), determines the response to an invalid chord played by the performer, and determines the response to a change of chords by the player between the two beat phrases. As described earlier, bars are broken into two parts or phrases. The first of the two phrases always includes two beats, that is beat 1 and beat 2. The second phrase always includes beat 3 and will include beat 4 unless a waltz bar is indicated. The musical bars are broken into these multi-beat phrases so that the proper musical phrasing can be incorporated into the musical accompaniment segments. A unique musical accompaniment segment exists for each musical phrase. If the system recognizes a chord type change between an old phrase and a new phrase, a new unique musical accompaniment is played in the new phrase. However, if a chord type is changed between beats within a phrase, a special operation is required to retain the continuity of the musical phrasing. It has been discovered that at these critical times (i.e., when a chord changes between beat 1 and beat 2 or when a chord changes between beat 3 and beat 4), the beat 1 musical accompaniment should be played in place of the beat 2 or beat 4 accompaniment. The musical consequences of this concept can best be explained by reference to FIG. 5.

Referring to section III of FIG. 5, during bar 1, the accompaniment progresses through F6 and Gm7 harmony on beats 1 and 2, respectively, in response to an F maj chord played by the performer. In the event the F maj chord is played immediately prior to beat 1, the progression from F6 to Gm7 sounds like a natural progression to the ear. However, if the F maj chord were not played until immediately prior to beat 2, the sounding of Gm7 harmony by the instrument without first sounding an F6 chord would seem undesirable to most performers. As a result, the instrument replaces the beat 2 harmony (Gm7) with the beat 1 harmony (F6), if an F maj chord is played between beats 1 and 2 of bar 1. A similar replacement occurs for chords changed betweedn beats 3 and 4 of a 4 beat bar. This is a unique feature which enables musical continuity to exist in an instrument capable of executing diverse musical techniques. A more detailed example of these concepts is given in the following Table A:

TABLE A

| | Bar 1 | | | | Bar 2 | | | |
|---|---|---|---|---|---|---|---|---|
| Chord Played By Performer | CM | GM | CM | CM | FM | B$^b$M | CM | CM |
| Beat (*indicates a chord change) | 1* | 2* | 3* | 4 | 1* | 2* | 3* | 4 |

| Tempo Clock | | Orchestration Signals Used By Instrument | | |
|---|---|---|---|---|
| Bar | Beat | Chord Type | Bar | Beat |
| 1 | 1 | CM | 1 | 1 |
| 1 | 2 | GM | 1 | 1 |
| 1 | 3 | CM | 1 | 3 |
| 1 | 4 | GM | 1 | 1 |
| 2 | 1 | FM | 2 | 1 |
| 2 | 2 | B$^b$M | 2 | 1 |
| 2 | 3 | CM | 2 | 3 |
| 2 | 4 | CM | 2 | 4 |

As an example of how Table A can be interpreted, the orchestration signals corresponding to GM harmony stored for normal usage during bar 1, beat 1 are used during bar 1, beat 2 of the tempo clock due to the change in harmony between beats 1 and 2 of bar 1.

The foregoing concepts are incorporated into the BEAT 1 routine which is shown in the flow charts of FIGS. 27 and 28. During the first beat, the variable BEAT is set to 0 (step 851), and the harmony recognition routine (FIG. 19) is called (step S52) in order to determine the chord type and root desired by the performer. In step S53, the QUIET routine is called to prevent any overhang from a previous musical segment. As previously explained, QUIET enters a number in timer 280 through data bus 154 (FIG. 20) which prevents oscillator 260 from emitting pulses. Overhang may result when a note continues between beats 1 and 2 or between beats 3 and 4. For example, many of the musical segments are written so that notes continue uninterrupted between beats 2 and 3 or between beats 4 and 1. Thus, between these beats, the QUIET routine prevents a conflict between the notes of the old beats and the notes of the new beats. In addition, overhang can result due to a long release decay which extends the envelope generated by generator 590 into the next beat.

If the recognition routine discovers a new chord type or new root, the identification of the new chord type or new root is stored in step S54 by a routine called SAME. The routine determines whether the new chord type and root are the same as the old chord type and root.

After any new chord types or roots have been handled in step S54, the ONE BEAT routine is called in step S55. The ONE BEAT routine arranges for the output of one entire beat (12 tempo clock pulses) and then increments the variable BEAT so that the second beat of the current bar is processed.

During the second beat, the recognition routine again is called in step S56, and any new chord type or root is stored by the SAME routine in step S57. If the chord type and root have not changed between the beats 1 and 2 (i.e., if they are the same), step S58 directs the program to call the ONE BEAT routine (step S61). If the chord type or root has changed, step S58 compels the BEAT variable to return to a 0 value and calls the QUIET routine in steps S59 and S60, so that the musical accompaniment for the first beat will be produced during beat 2. As previously explained, this procedure is necessary when the chord type or root has changed between the beats of a 2 beat phrase.

Referring to FIG. 28, during the third beat of the bar, the variable BEAT is incremented to the value 2 in step S62. Steps S63–S66 then follow the same procedure followed by steps S52–S55, in connection with the first beat (FIG. 27). At step S67, the input downbeat routine (INDB) is called to determine whether the third beat completes a 3 beat waltz phrase or whether a fourth beat is required. If the accompaniment is being played in waltz time, the musical phrase is completed, and the program is returned through steps S68 and S69.

In the event a fourth beat is required, the recognition routine is called in step S70, and any change in chord type or root is detected in step S71. In the event that neither the chord type nor root was changed, step S72 jumps the program to step S75 which calls the ONE BEAT routine. If a new chord type or root was detected in step S73, and the QUIET routine is called in step S74, so that a musical accompaniment for the first beat will be played in step S75. At the conclusion of the fourth beat, the program is returned through step S76.

The ONE BEAT routine called by the BEAT 1 routine (FIGS. 27 and 28) is shown in the flow chart of FIG. 29. In step S79, a variable CLKCNT is set to 0. CLKCNT counts the number of tempo clock pulses and has a value which can vary from 0 to 11, since there are 12 clock pulses in each beat. The OUTPUT routine is called in step S80, and the ONE BEAT routine then waits for a tempo clock transition at step S81. When a clock transition is sensed, the CLKCNT variable is incremented in step S82, and the OUTPUT routine again is called if the end of the beat has not occurred (i.e., if CLKCNT is less than 11). When CLKCNT reaches 11, step S83 causes the variable BEAT to be incremented in step S84, and causes a return to the BEAT 1 routine (FIGS. 27 and 28) in step S85.

Figure 30:
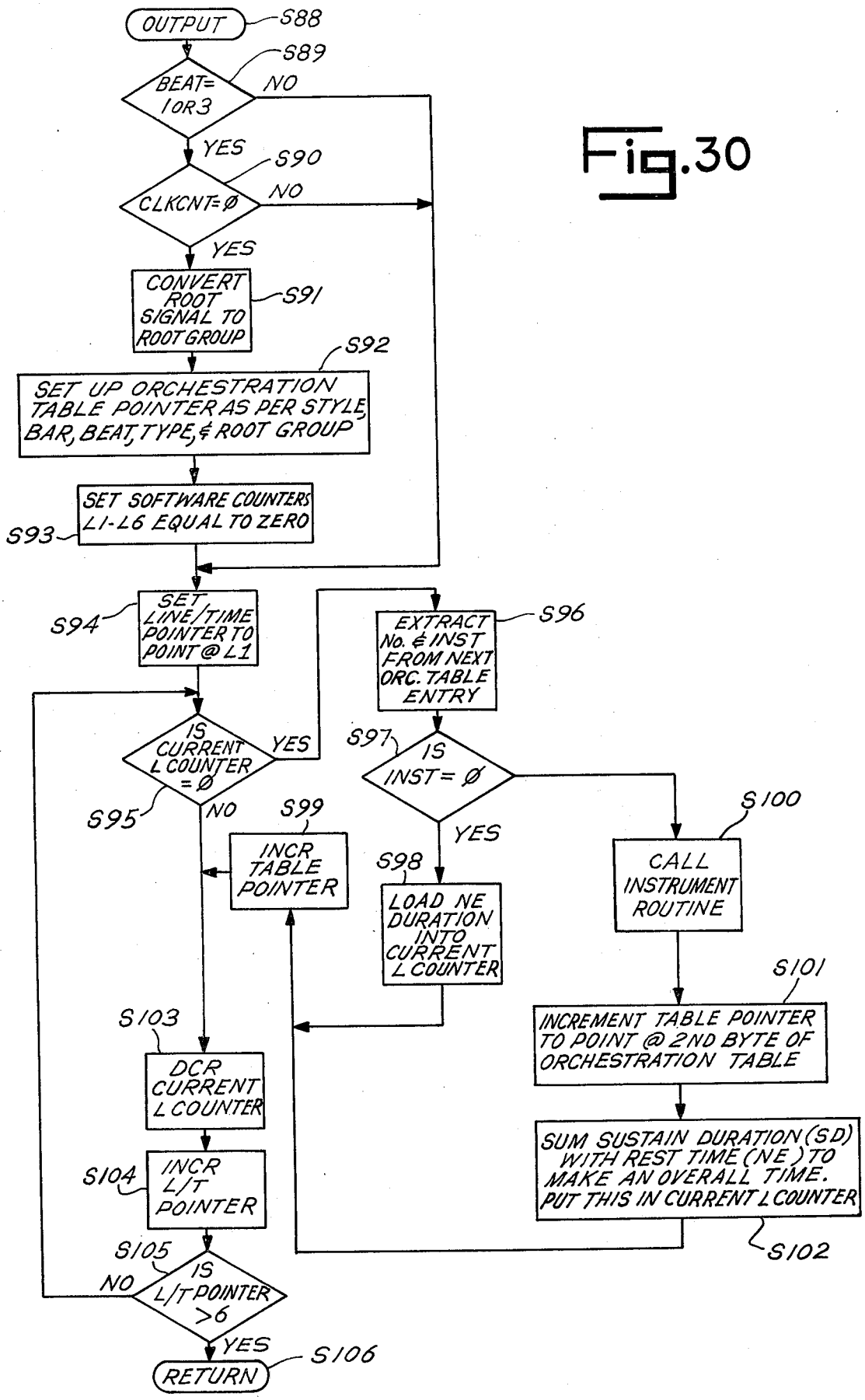

The OUTPUT routine called during the ONE BEAT routine is described in FIG. 30. Assuming the beat is 1 or 3 and the tempo clock count is 0 (Steps S89, S90), the root signal obtained by the harmony recognition routine (FIG. 19) is converted to one of the root groups previously identified in step S91. In step S92, a table pointer to the orchestration table in ROM 164 is set up according to the musical style selected by the performer, the bar, the beat, the chord type and the root group.

Figure 31:
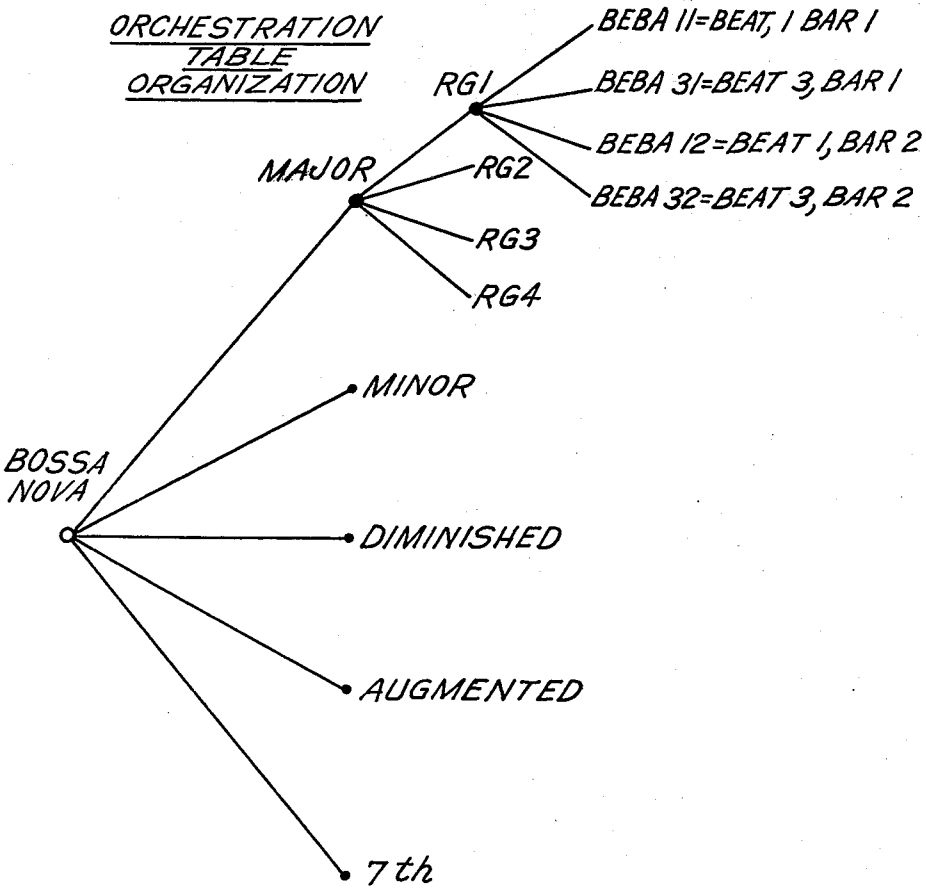
FIG. 31 is a diagram illustrating the organization of the orchestration tables stored in the memory of the preferred embodiment.

The organization of the orchestration table in ROM 164 is illustrated in FIG. 31. As shown in that Figure, each musical style selected by the performer, (such as bossa nova) can point to any one of the five different chord types recognized by the harmony recognition routine (i.e., major, minor, diminished, augmented and seventh). In turn, each chord type can point to any one of the four different root groups, and each of the root groups can point to an address identifying any one of four different combinations of beat and bar (i.e., beat 1, bar 1; beat 3, bar 1; beat 1, bar 2; and beat 3, bar 2).

Referring again to FIG. 30, step S93, after the table pointer is set up to point to the proper address, of the orchestration table, six software counter L1–L6 corresponding to the six voice systems 251–256 are set equal to 0. In step S94, a line/time pointer is set to point to counter L1. The software counters L1–L6 determine when a new note needs to be produced by one of voice systems 251–256. If the counter has not been decremented to 0, no new note needs to be produced, and the voice system can be ignored by the microprocessor. However, when one of counter L1–L6 is decremented to 0, orchestration signals must be read from ROM 164 in order to produce the next note. The orchestration signals located in ROM 164 are stored in the form illustrated in the following Table 1, in which an "x" indicates a bit of a word:

TABLE 1

| Orchestration Table Entry | | | |
|---|---|---|---|
| 1st Byte | | 2nd Byte | |
| xxxxx | xxx | xxxx | xxxx |
| NO | INST | S.D. | N.E. |

Each orchestration table entry consists of two bytes. The first byte comprises (a) a five bit word NO which is related to the pitch of the note to be produced, and (b) a three bit word INST which defines the type of instrument or voice which the note is to simulate. The second byte comprises (a) a four bit word S.D. which defines the duration of the sustain time of the envelope generator (i.e., the duration of signal SDW, FIG. 24) and (b) another four bit word N.E. which defines the rest time until the next note of the voice is produced (i.e., the duration from the termination of one SDW signal to the commencement of the next SDW signal by the same envelope generator). As previously described in connection with FIG. 23, the S.D. word is transmitted to counter 66 in order to generate the proper envelope for the production of the note.

Returning to FIG. 30, if the current L counter is 0, the NO and INST words are read out of the orchestration table in step S96. According to step S97, if the value of the INST word is 0, a musical rest is indicated, and the value N.E. is loaded into the current L counter in step S98. In step S99, the pointer for the L counters is incremented to point to the next counter, and, in step S103, the current L counter is decremented.

Since the OUTPUT routine is executed once during each tempo clock pulse, the L counters are decremented once during each such clock pulse. As a result, the L counters are kept in synchronism with the tempo clock pulses. After all of the L counters have been serviced during a tempo clock pulse, the program returns to the ONE BEAT routine through steps S105 and S106. If all L counters have not been serviced, the routine returns the step S95 and is repeated with respect to the remaining L counters.

Returning to step S97, if the value of the INST word is not equal to 0, a real instrument is indicated, and the instrument routine (INSTRU) is called in step S100. After INSTRU is completed, the orchestration table pointer is moved to the second byte of the orchestration table entry (See Table 1) in step S101. The sum of the sustain duration and rest time (i.e., the sum of words S.D. and N.E.) then is loaded into the current L counter in step S102 in order to define the next time when the voice system corresponding to the current L counter need service. The table pointers then are incremented in step S99, and the routine follows the previously-described steps S103–S106.

Figure 32:
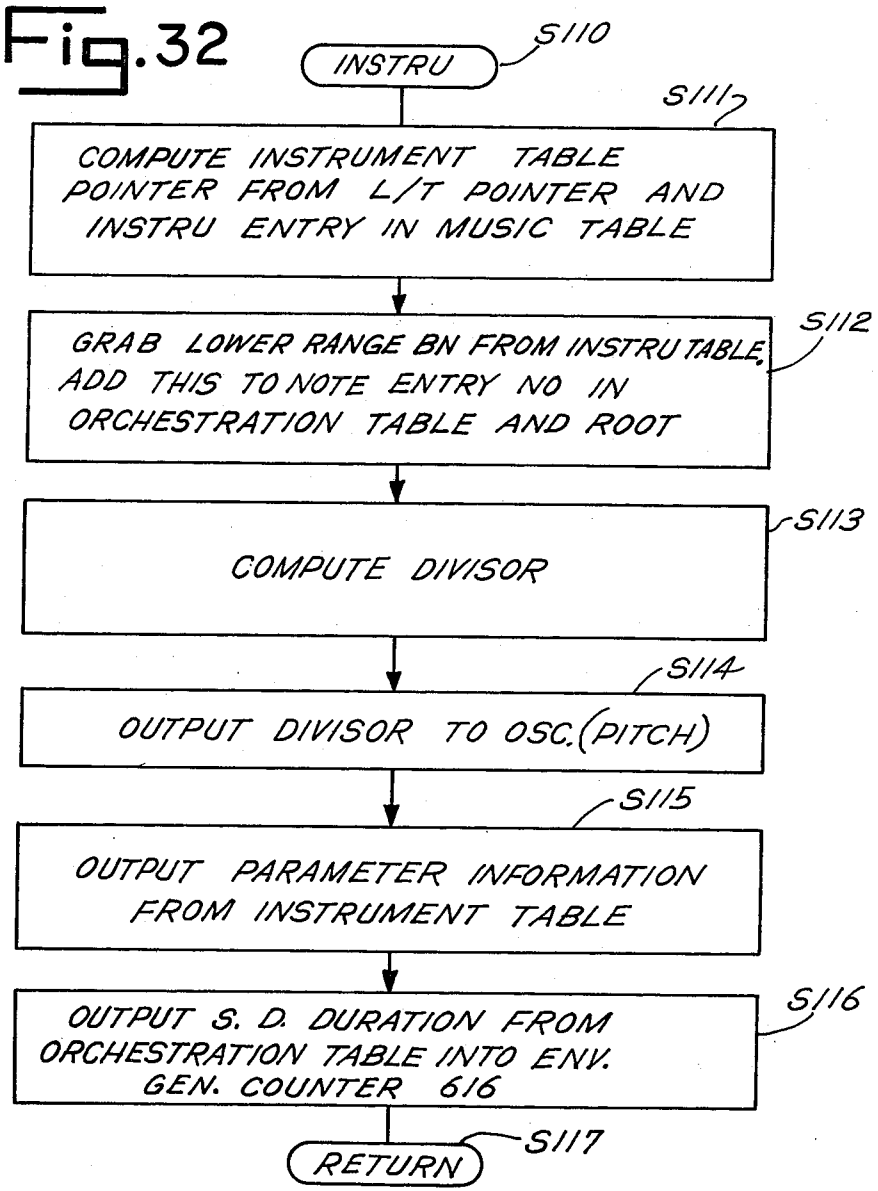

Referring to FIG. 32, when the instrument routine (INSTRU) is called, a pointer to the proper entry in the instrument table stored in ROM 164 is calculated from the current value of the line/time pointer (step S94) and from the INST word stored in the orchestration table (Table 1) (step S111). The instrument signals located in ROM 164 are stored in the form illustrated in the following Table 2:

TABLE 2

| INSTRUMENT TABLE ENTRY | | | | |
|---|---|---|---|---|
| 1. | xxxxxxxx<br>Base Number (BN) (0–95, 8 Octaves) | | | |
| 2. | xxx<br>Attack (A) | xx<br>Percussive Decay (PD) | xx<br>Sustain Level (S) | x<br>— |
| 3. | xxx<br>Release Decay (D) | xx<br>Percussive Release (PR) | xxx<br>— | |
| 4. | xxx<br>Pulse Width (latch 460) | x<br>"WAH" On (And Gate 467) | x<br>Vib. Mod. On (And Gate 464) | xxx<br>— |
| 5. | xxxxxxxx<br>Volume Control (To Filter Latch 567) | | | |
| 6. | xxxxxxxx<br>Portamento and Vibrato Control (To Latch 314) | | | |
| 7. | xxxxxxxx<br>Portamento Rate (To Latch 362) | | | |
| 8. | xxxxxxxx<br>Filter characteristic (To Filter Latch 566) | | | |

Each entry consists of eight words, and each word has 8 bits. Once the proper entry in the instrument table is addressed by the calculated pointer, a base number BN is read out of word 1 of the entry. BN defines the lowest pitch which can be played by an instrument or voice. In step S112, the microprocessor sums BN+NO (from the orchestration table)+the value of the root (from counter 228, FIG. 17) to obtain a value P. In steps S113 and S114, the value P is used to compute the divisor number which is read out to timer 280 in oscillator 260 on data bus 154. As previously described, the divisor number determines the pitch of the note to be produced by one of voice systems 251–256.

Step S112 is an important feature which enables the INSTRU routine to transpose the divisor number into the proper harmonic key before it is transmitted to a voice system. By using this technique, the orchestration tables can store a single entry for every different key in which the accompaniment ultimately might be played. This technique saves a considerable amount of memory. In step S115, the parameter signals stored as words 2–8 in the instrument table entry are transmitted over bus 154 to the appropriate latches of the proper voice system.

Words 2 and 3 (Table 2) store the parameter signals which define the attack (A), percussive decay (PD), sustain level (S), release decay (D) and percussive release (PR) portions of the envelope signal (signal 0, FIG. 24) produced by envelope generator 590. Each of these signals is transmitted to converter 614 (FIG. 23).

Word 4 stores a pulse width parameter signal which results in the selection of resistors 471 or 472 (FIG. 21), a WAH on signal which controls analog gate 467, and a Vib. Mod. on signal which controls analog gate 646. Each of these signals is transmitted to latch 460 (FIG. 21).

Word 5 stores a volume control parameter signal which controls the operation of open collector gates 570–572 (FIG. 22). This parameter signal is transmitted to latch 567.

Word 6 stores a portamento and vibrato control parameter signal which controls the portamento up-down direction and pitch and also enables vibrato oscillator 400 (FIG. 20). This signal is transmitted to latch 314.

Word 7 stores a portamento rate parameter signal which controls the pulse width of one shot 380 (FIG. 20). This signal is transmitted to latch 362.

Word 8 stores a filter parameter signal which controls the resistor-capacitor combinations connected into programmable filter 480 (FIG. 22). This signal is transmitted to latch 566. Referring again to FIG. 32, in step S116, the value SD is read from the orchestration table into counter 616 of the envelope generator (FIG. 23) in order to determine the sustain time duration of the note. The program then is returned to the output routine through step S117. The parameter signals control the designated voice system so that a tone signal having the proper pitch and harmonic spectrum is generated. The tone signals from each of the voice systems are summed and amplified in amplifier 77 and are converted to sound waves by transducer 79.

Figure 8:
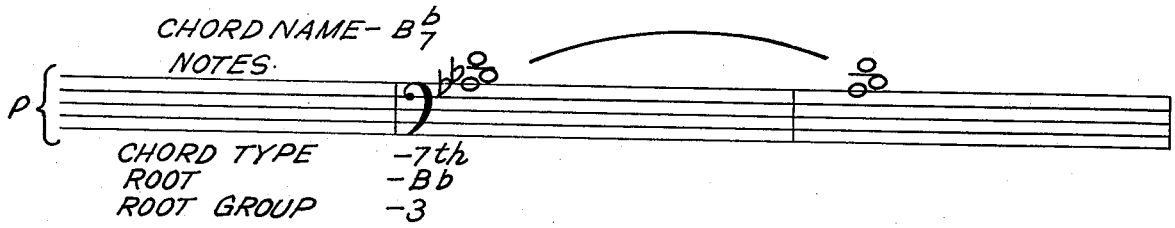
Figure 8:
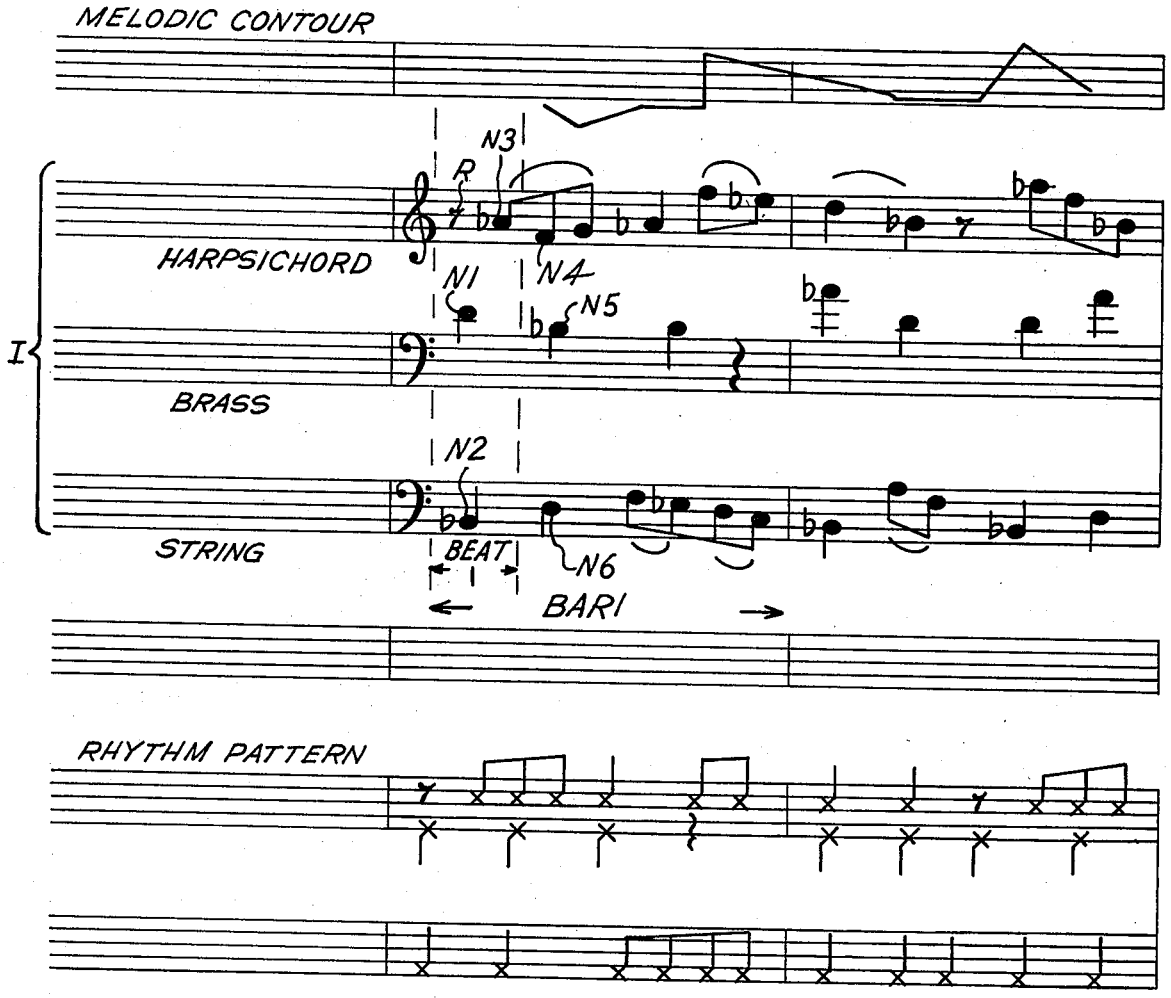
Figure 9:
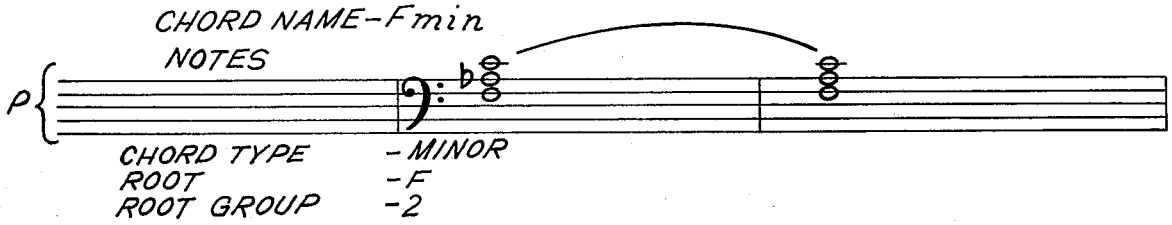
Figure 9:
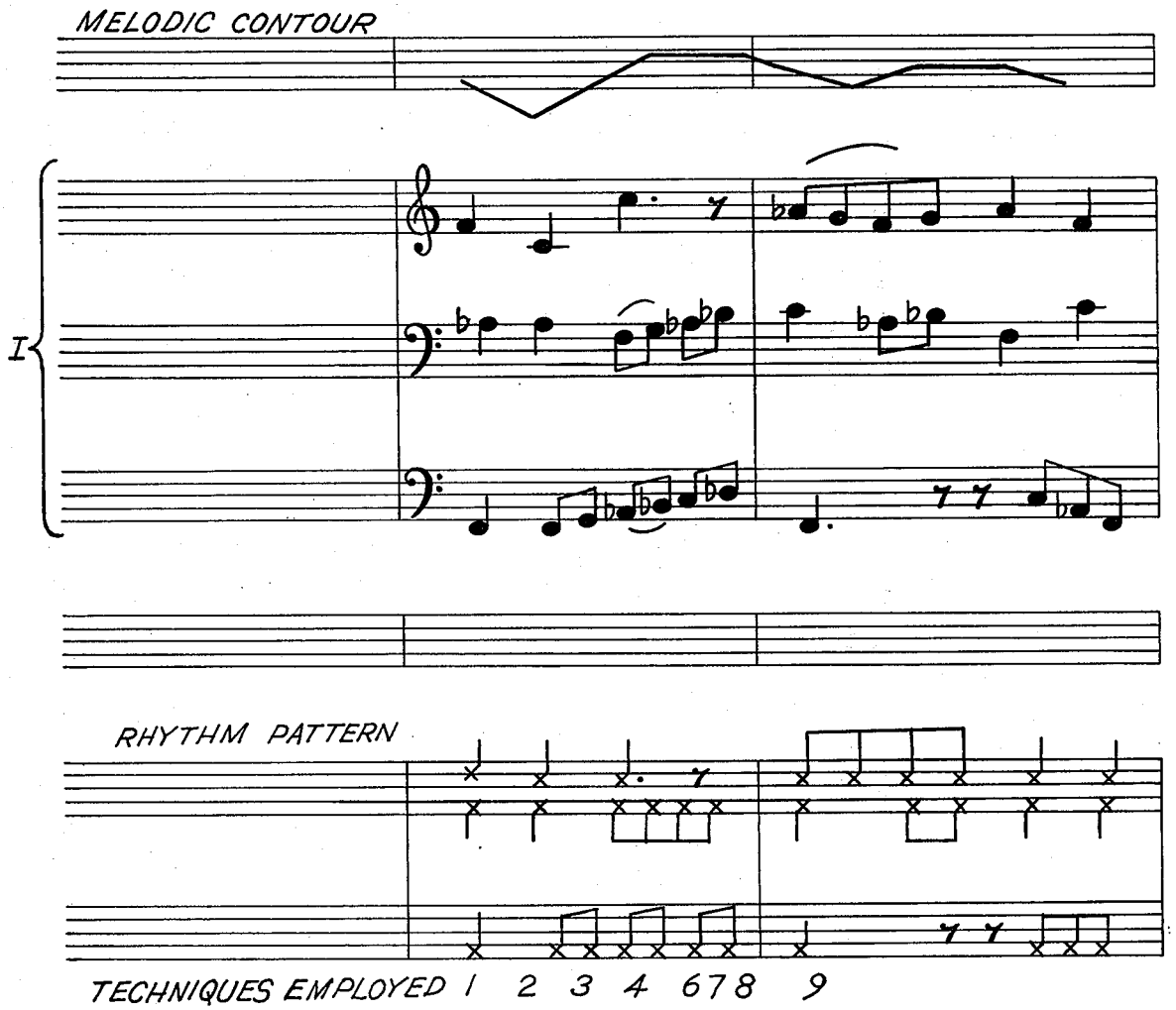
Figure 10:
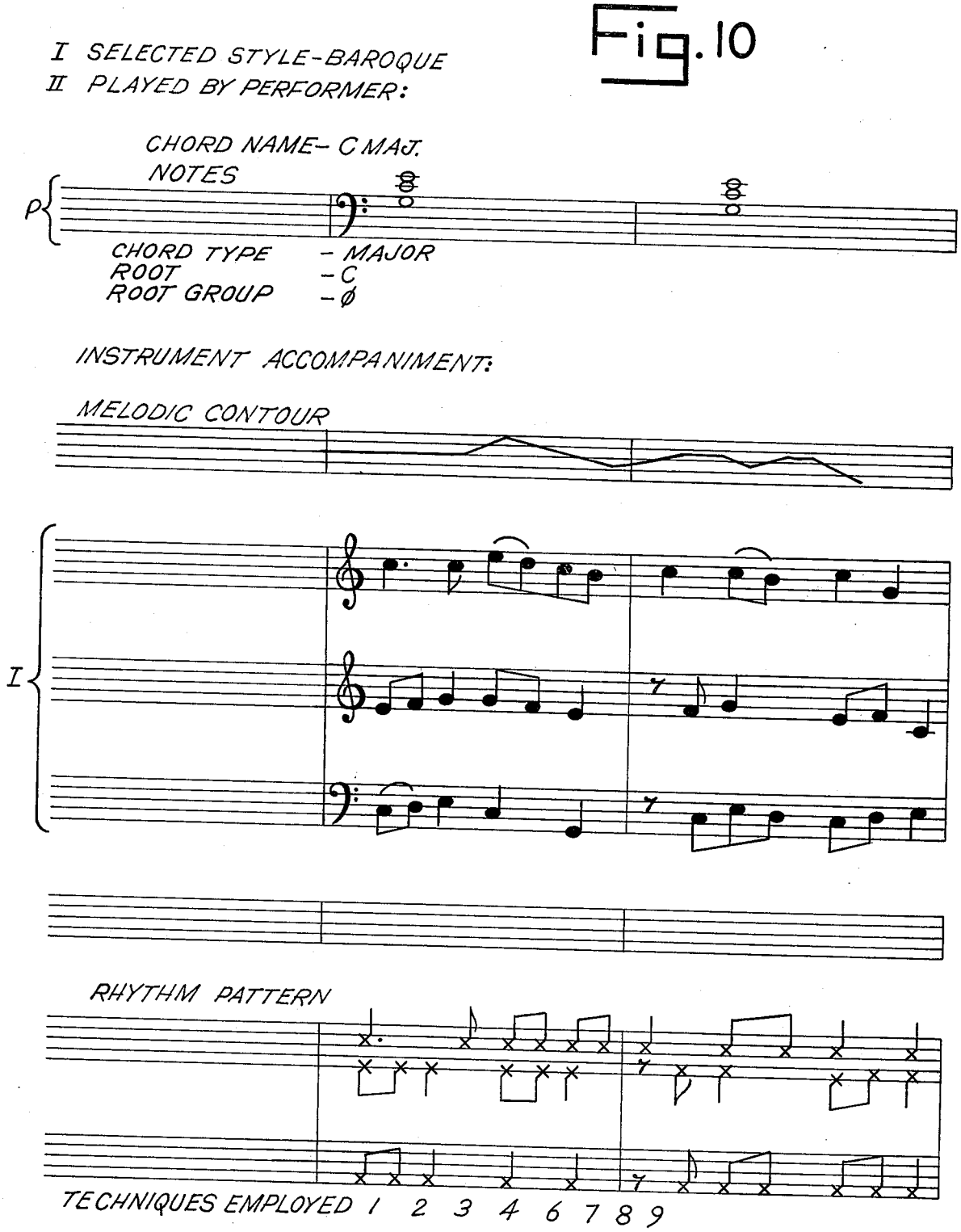
Figure 11:
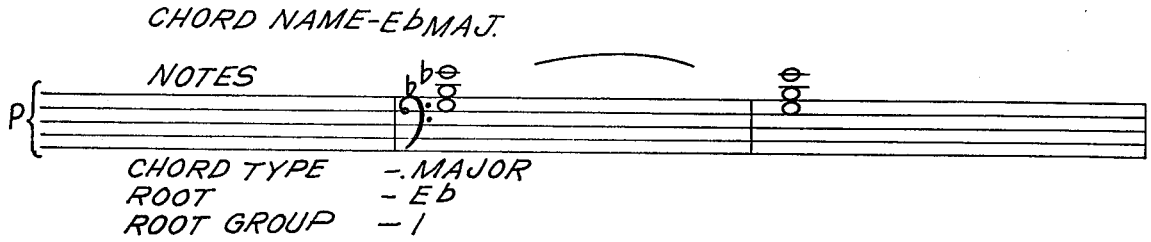
Figure 11:
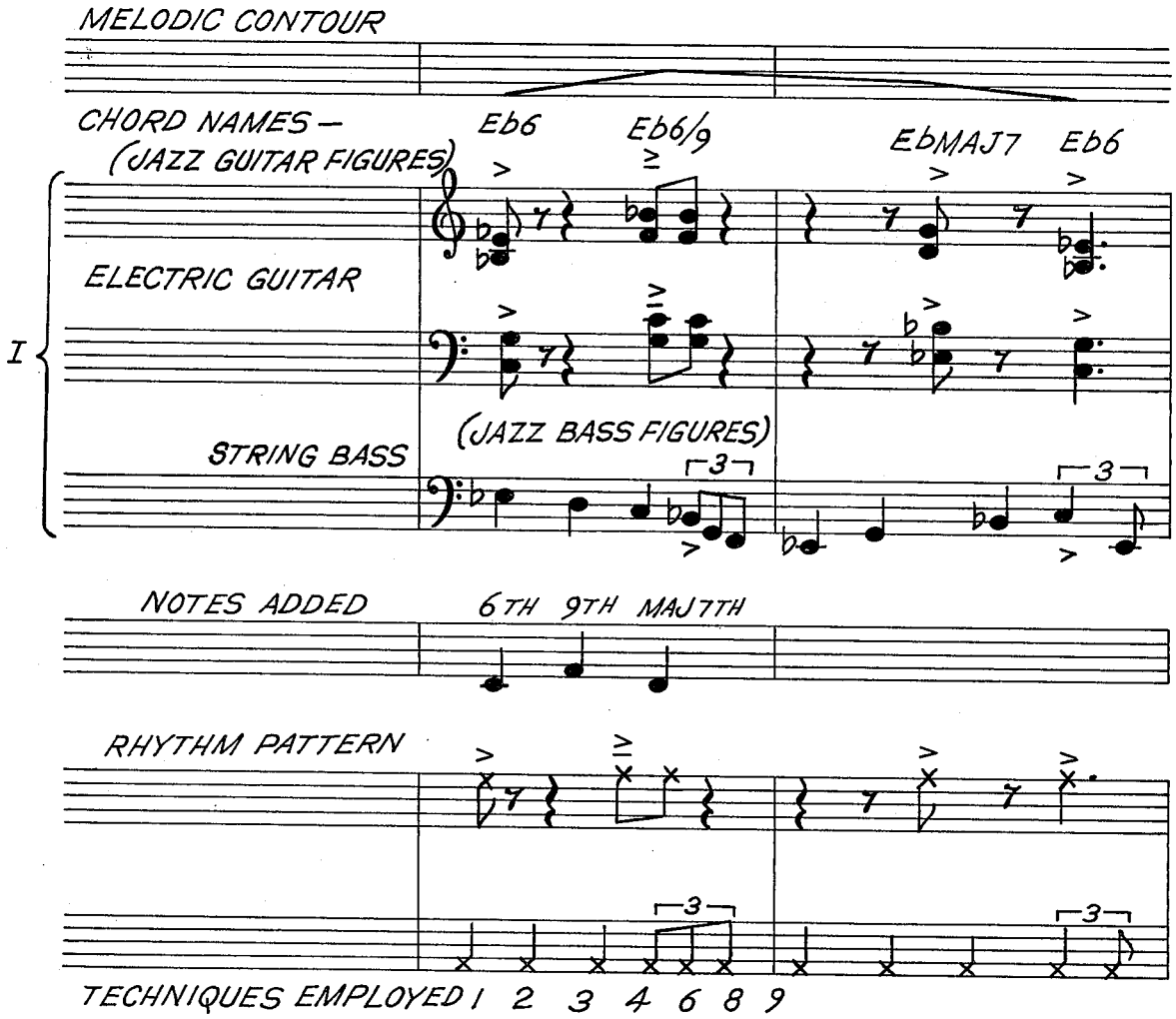
Figure 12:
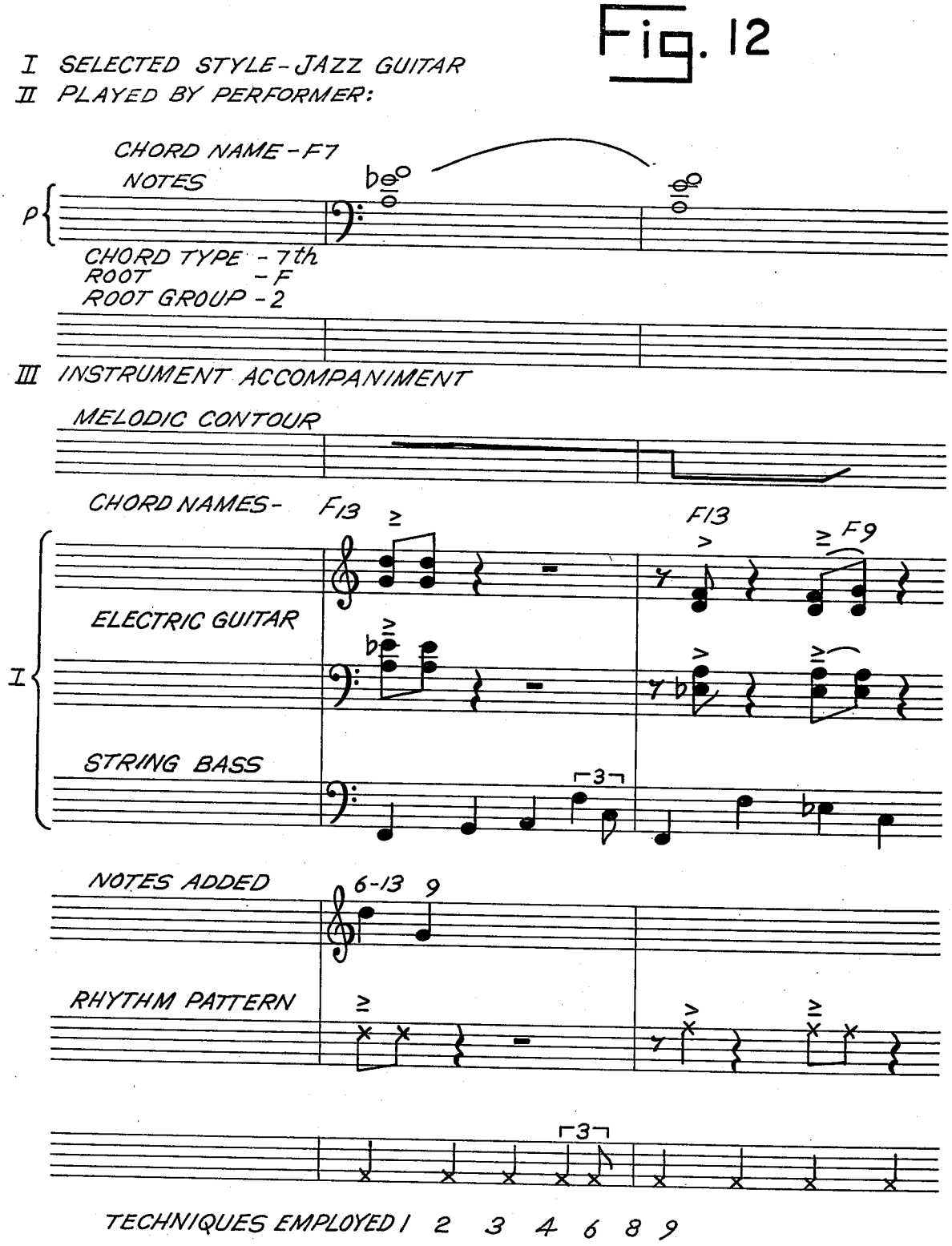
Figure 13:
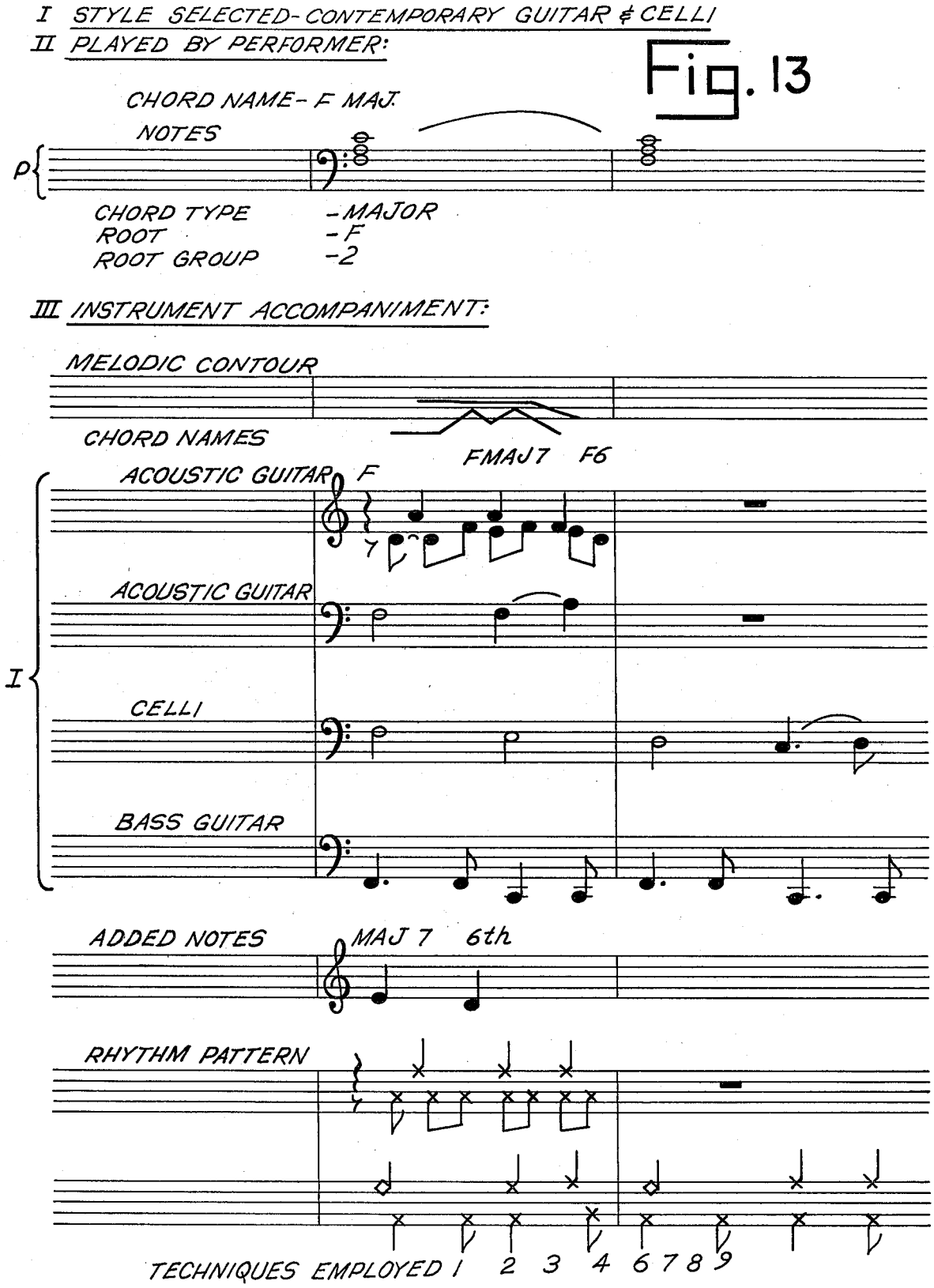
Figure 14:
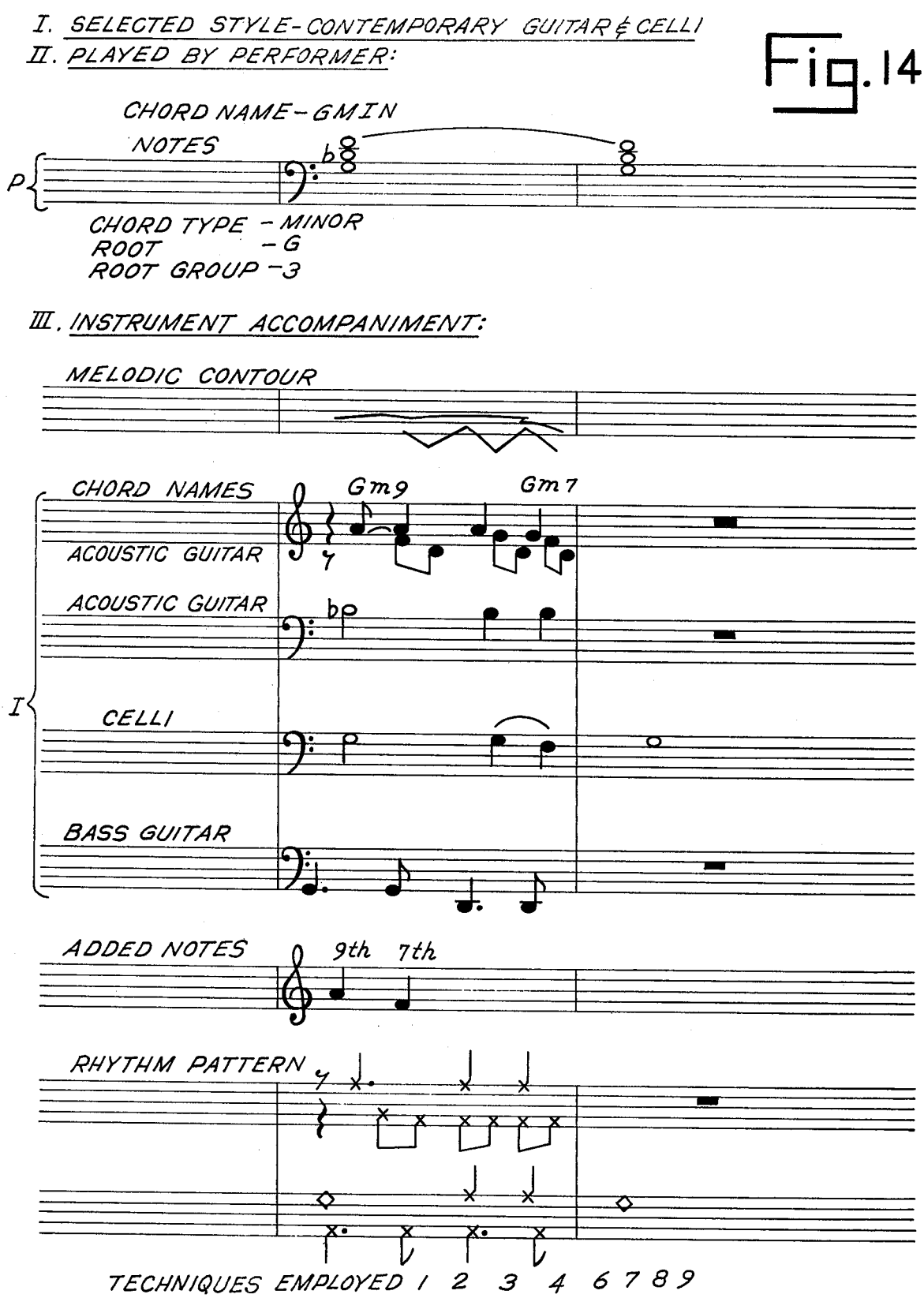

The operation of the foregoing system may be more clearly understood from the following example described with reference to FIG. 8. FIG. 8 describes the music desired to be produced when a performer selects the Baroque style and plays a B flat 7th chord on the harmony keyboard. The upper or treble staff to be produced by the instrument is to sound like a harpsichord; the middle staff of music is to sound like brass and the lower staff of music is to sound like a string instrument. In order to achieve this result, the notes written on the upper staff can be produced by voice system 251, the notes indicated on the middle staff of music can be produced by voice system 252 and the notes indicated on the lower staff of music can be produced by voice system 253 (FIG. 15). Of course, any other of the 6 voice systems could be assigned to the respective lines of music and still achieve the same results. As indicated by FIG. 31, there are a number of memory locations which are assigned to the Baroque style, 7th chord type, root group 3, BEAT 1, BAR 1 of the music described in FIG. 8. In order to produce the notes shown in BAR 1, BEAT 1 of FIG. 8, the locations of the orchestration table for BAR 1 BEAT 1 are filled in ascending numerical order. The order corresponds to the time sequence of the notes.

For example, the first four table entries would contain information for rest R and notes N1–N3, respectively shown in FIG. 8.

Referring to Table 1, the first entry (i.e., the entry for rest R, FIG. 8) would contain a word INST having a value 000, indicating that a rest is desired. The second byte of the entry would contain a word N.E. having a value defining the musical time duration of rest R.

Referring to Table 1, the second entry would contain a word NO which when added to the base number BN for the harpsichord voice and the value of the root (B flat) would result in a number P. P, in turn, is used to calculate the divisor number which is read out to timer 280 and oscillator 260 in order to produce rectangular wave pulses having a repetition rate corresponding to the fundamental pitch of note N1.

The second entry also contains a word INST which identifies the brass voice and a word SD which dictates that note N1 will be produced for a time period appropriate to a quarter note. Word NE will have a zero value because there is no rest between note N1 and the next note in the brass voice, note N5.

The orchestration table entries for notes N2–N6 are stored in a similar manner. Of course, the table entries for notes N2–N6 contain different values in order to make these notes sound in different voices and for periods of time appropriate to their music time values.

Three different instrument table entries (Table 2) are stored, one for each of the three different voices of notes N1–N3.

Referring to FIGS. 8 and 30, when the program enters the output routine due to the performer playing a B flat 7 chord in the Baroque style at the beginning of a measure, since the BEAT is 1 and the CLKCNT is zero (steps S89, S90), the root signal is converted to root group 3 in step S91 and the orchestration table pointer is set to address the first entry described above corresponding to rest R.

Counters L1–L6 are set to 0 (step S93) and the line time (L/T) pointer points to counter L1 (step S94). Since counter L1 is set to zero, words NO and INST are extracted from the first memory entry (Step S96). Since the value of INST is 0, the value of N.E. is loaded into counter L1 (steps S97, S98). The table pointer is incremented to point to the second entry (corresponding to note N1). The L1 counter then is decremented by 1 (step S103), and the L/T pointer is incremented in order to point to counter L2 (step S104). Since the L/T pointer is less than 6, the output routine returns to step S95 in order to determine the value of counter L2.

Since counter L2 is set to 0, the instrument routine is called (steps S97, S100). In the manner previously described, the instrument routine causes the proper entries from the instrument table (Table 2) to be outputted to output system 252 so that note N1 is produced in the brass voice for the time value of a quarter note.

The program then returns to step S101 of the output routine in which the table pointer is incremented to point at the second byte of the orchestration table entry for note N1. (Table 1). The sustain duration (SD) and the rest time (NE) values in the second byte are then summed in order to determine the overall time period from the commencement of note N1 to the commencement of note N5. The value of this time period is loaded into the L2 counter (step S102), and the table pointer is incremented to point to the third entry corresponding to note N2 (step S99). The L2 counter is then decremented by 1 (step S103), and the LT pointer is incremented in order to point to counter L3 (step S104). Since the L/T pointer is less than 6, the output routine returns to step /S95 in order to determine the value of counter L3.

Since the value of counter L3 is zero, the NO and INST words corresponding to note N2 are extracted from the orchestration table (step S96). Since the value of INST indicates the string voice, the instrument routine is called (steps S97 and S100). The instrument routine operates in the foregoing manner in order to produce note N2 through output systems 253. The program then returns to step S101 where the second byte of the orchestration table entry for note N2 is analyzed. The sustain duration and rest time for note N2 are summed and placed into counter L3 to define a time period from the beginning of note N2 until the beginning of the next note in the string voice, note N6. Of course, the summed value for N2 is the same as the summed value for note N1, since both N1 and N2 are quarter notes and must extend over one full musical beat. The table pointer then is incremented to point to the fourth entry in step S99. Counter L2 is decremented in step S103 and L/T pointer is incremented in step S104 to point to counter L4. The program then returns through steps S105 and S95 to examine counter L4.

Since the value of counter L4 is zero, the NO and INST words from the fourth orchestration table entry are extracted. Since only three different voices are used in the Baroque style, the capacity of the system for three additional voices is not needed. As a result, the fourth, fifth and sixth orchestration table entries corresponding to counters L4, L5, and L6 each have their INST values set equal to zero. As a result, in step S98, the NE duration corresponding to the entire two measure musical segment shown in FIG. 8 is loaded in counter L4, and the instrument routine is not called. As a result, no sound is produced in response to the fourth orchestration table entry. The table pointer is then incremented to point to the fifth orchestration table entry (step S99) and the L4 counter is decremented (step S103). The L/T pointer is then incremented to point to the L5 counter which is then evaluated (steps S105, S95). The L5 and L6 counters are handled in the same way as the L4 counter so that no sound results from the fifth and sixth orchestration table entries. As a result, after the L6 counter has been evaluated, the program is returned to step 581 of the ONE BEAT routine (FIG. 29).

In summary, during the first cycle of operation of the output routine, rest R and notes N1–N2 are commenced, and their durations are defined by the values loaded into software counters L1–L3. In addition, the other three voices corresponding to counters L4–L6 are quieted and their duration is extended throughout the two measure musical cycle shown in FIG. 8. The initial cycle of operation of the output routine is carried out so rapidly that notes N1–N2 appear to sound at the same time.

Referring to FIG. 29, as soon as the CLKCNT is incremented to 1, (step S82), the output routine again is called (step S80). Since the CLKCNT is no longer at zero, the output routine proceeds directly to step S94 where the L/T pointer again points to counter L1. Since counter L1 is not yet zero, the output routine proceeds directly to step S103 where counter L1 is decremented and the L/T pointer is incremented to point counter L2. Since none of counters L1–L6 have yet been decremented to zero, the orchestration table does not need to be consulted for any of the counters and the output routine is again returned to step S81 of the 1 BEAT routine (step S106).

The foregoing procedure is followed until the CLKCNT (FIG. 29) advances to 5, thereby indicating that BEAT 1 is half completed. At this point in time, rest R (FIG. 8) should terminate and note N3 should begin sounding. After the CLKCNT advances to 5 and the output routine is called in step S80, the output routine immediately advances to step S94 and the L/T pointer is set to counter L1.

Since counter L1 has been decremented to zero by the previous cycles of the output routine during CLKCNTS 0–4, the NO and INST words corresponding to note N3 are extracted from the seventh orchestration table entry (step S96). Since the value of the INST word indicates a harpsichord voice, the instrument routine is called in step S100. In the manner described above, the instrument routine causes note N3 to sound through output system 251. The program then returns to step S101 of the output routine where the orchestration table pointer is incremented to point to the second byte which contains the SD and NE values for note N3. These values are summed in order to determine a time period from the beginning of note N4 to the beginning of the next note in the harpsichord voice, note N4. This value is loaded into counter L1 and the orchestration table pointer is incremented to point to the eighth orchestration table entry (step S99). Counter L1 is then decremented (step S103), and the L/T pointer is incremented to point to counter L2 (step S104).

Since the value of counter L2 is not yet zero, (since it corresponds to note N1 which is held for one full musical beat), the output routine proceeds directly to step S103 where the L2 counter value is decremented. The same procedure is followed for counters L3–L6 during CLKCNT 5 until the program returns to the ONE BEAT routine through step S106. The ONE BEAT routine will continue to call the output routine for CLKCNTS 6–11. However, since no additional notes need to be originated during BEAT 1 of BAR 1 (FIG. 8), the orchestration table entries never need to be consulted.

At the end of BEAT 1, the program returns to the BEAT 1 routine through step S85 (FIGS. 27, 28). At the beginning of the second beat, the ONE BEAT routine is called in step S55, and the same procedure is followed. That is, during CLKCNT 0 of the second beat, notes N4, N5 and N6 are originated and note N3 is terminated. As a result, each of the notes shown in FIG. 8 is played in its exact musical voice, pitch and time value as long as the performer continues to play a B flat 7th chord.

Those skilled in the art will recognize that each of the musical features set forth in the Musical Organization and Capablities section of the specification can be implemented by choosing the proper values for the orchestration and instrument table entries and by placing the entries in an appropriate order in the memory so that they are available for access when the desired musical notes need to be generated.

A detailed program listing suitable for executing the flow charts of FIGS. 19, 25–30 and 32, as well as exemplary entries for the orchestration and instrument tables follows. The listings named STYLE and MAOXXX correspond to the orchestration table, and the listing named INSTBL corresponds to the instrumentation table.

Those skilled in the art will recognize that the preferred embodiment may be altered and modified without departing from the true spirit and scope of the invention as defined in the appended claims.

```
:F1:ASMMD INITLZ.SRC PRINT(:LP:) DEBUG MODB5 MACROFILE

ISIS-II 8080/8085 MACRO ASSEMBLER, V2.0          INITLZ   PAGE    1

 LOC  OBJ          SEQ        SOURCE STATEMENT

                     1         NAME    INITLZ
                     2
                     3         EXTRN   MAIN     ;LINKAGE POINT FOR MAIN LOOP
                     4
                     5
                     6         ASEG
 0000                7         ORG     0        ;SET UP TO GO TO INITIALIZATION
 0000 F3             8         DI               ;ROUTINE IF RESET OR RST 0
 0001 C30000    L    9         JMP     INITLZ   ;PERFORMED
                    10
                    11
                    12         CSEG
                    13
                    14 INITLZ:                  ;STARTING ADDRESS FOR SYSTEM
                    15                          ;INITIALIZATION ROUTINE
                    16         STKLN   100H
 0080 310000    S   17         LXI     SP,STACK
                    18
                    19 ;       INITIALIZATION ROUTINE FOR MAIN PROGRAM
                    20
                  = 21 $INCLUDE ( MAINI.SRC)
                  = 22 ;                 ****************************************
                  = 23 ;                 *                                      *
                  = 24 ;                 * THIS IS A SAMPLE INITIALIZATION      *
                  = 25 ;                 *                                      *
                  = 26 ;                 * ROUTINE FOR MAIN                     *
                  = 27 ;                 *                                      *
                  = 28 ;                 ****************************************
                  = 29
                  = 30
 003A             = 31 S1ALL   EQU     3AH
 00B8             = 32 U1ALL   EQU     0B8H
                  = 33
 0043             = 34 FI12CL  EQU     43H
 0047             = 35 FI34CL  EQU     47H
 004B             = 36 FI56CL  EQU     4BH
                  = 37
                  = 38 ;THE FOLLOWING FOUR LINES OF CODE INITIALIZE THE FILTER PICS
                  = 39
 0005 3E3A        = 40         MVI     A,S1ALL
 0005 D343        = 41         OUT     FI12CL
 0007 D347        = 42         OUT     FI34CL
 0009 D34B        = 43         OUT     FI56CL
                  = 44
                  = 45 ;       RHYTHM SPEED INITILIZATION ROUTINE
                  = 46
                  = 47
 00F0             = 48 PORCLK  EQU     0F0H            ; PORNAMENTO CLOCK DIVIDER
 00F1             = 49 ORCLK   EQU     0F1H            ; ORCHRESTRA PLUS CLOCK DIVIDER
 00F2             = 50 RHMCLK  EQU     0F2H            ; RHYTHM CLOCK DIVIDER
 00F3             = 51 CNTL1   EQU     0F3H            ; CHIP # 1 CONTROL PORT
 00F4             = 52 DNBT    EQU     0F4H            ; DOWN BEAT DIVIDER
 00F7             = 53 CNTL2   EQU     0F7H            ; CHIP # 2 CONTROL PORT
 00F8             = 54 SWITCH  EQU     0F8H            ; SPEED SWITCH INPUT
 0010             = 55 DTIME   EQU     10H             ; SWITCH FOR DOUBLE TIME
                  = 56
                  = 57
 000B 3E36        = 58         MVI     A,36H
 000D D3F3        = 59         OUT     CNTL1           ; PORCLK IN MODE 3
 000F 3E74        = 60         MVI     A,74H
 0011 D3F3        = 61         OUT     CNTL1           ; ORCHRESTRA PLUS CLOCK IN MODE 2
 0013 219901      = 62         LXI     H,409           ; DEFAULT RHYTHM SPEED SO THINGS WILL START
 0016 7C          = 63         MOV     A,H
 0017 D3F0        = 64         OUT     PORCLK
 0019 7D          = 65         MOV     A,L
 001A D3F0        = 66         OUT     PORCLK
 001C 3E80        = 67         MVI     A,128
 001E D3F1        = 68         OUT     ORCLK
 0020 AF          = 69         XRA     A
 0021 D3F1        = 70         OUT     ORCLK           ; FIXED DIVIDE BY 64 FROM PORNAMENTO TO ORCH.
                  = 71
 0023 FB          = 72         EI
 0024 76          = 73         HLT
                  = 74
                  = 75
 0025 3E84        = 76         MVI     A,084H
 0027 D3F3        = 77         OUT     CNTL1           ; RHYTHM CLOCK IN MODE 2
 0029 3E34        = 78         MVI     A,34H
 002B D3F7        = 79         OUT     CNTL2           ; DOWN BEAT IS MODE 2
 002D 3E04        = 80         MVI     A,4
 002F D3F2        = 81         OUT     RHMCLK          ; DEFAULT TO ROCK
 0031 AF          = 82         XRA     A
 0032 D3F2        = 83         OUT     RHMCLK
 0034 3E1F        = 84         MVI     A,31
 0036 D3F4        = 85         OUT     DNBT
 0038 AF          = 86         XRA     A
 0039 D3F4        = 87         OUT     DNBT
                  = 88
                  = 89 ;       END RHYTHM INITILAZATION
                  = 90
                  = 91 ;THE ABOVE COMMENT IS NOT A STATEMENT OF PROTEST BUT MERELY
                  = 92 ;AN ATTEMT TO AID THE MACHINE IN IT'S UNDERSTANDING OF THE
                  = 93 ;CARE AND GROOMING OF HUMAN BEINGS
                  = 94
                  = 95
```

```
                1=  96 $INCLUDE(SYSEQU.SRC)
0003            1=  97 OSAPUR   EQU     0D3H
0007            1=  98 OSACNT   EQU     0D7H
0004            1=  99 OSCA0    EQU     0D4H
0005            1= 100 OSCA1    EQU     0D5H
0006            1= 101 OSCA2    EQU     0D6H
00B3            1= 102 OSBPUR   EQU     0B3H
00B7            1= 103 OSBCNT   EQU     0B7H
00H4            1= 104 OSCR0    EQU     0H4H
00H5            1= 105 OSCR1    EQU     0H5H
00H6            1= 106 OSCR2    EQU     0H6H
                1= 107
                1= 108
0036            1= 109 OS0INI   EQU     36H
0076            1= 110 OS1INI   EQU     76H
00B6            1= 111 OS2INI   EQU     0B6H
                1= 112
                1= 113
                1= 114 ;KEYBOARD INPUT PORT NUMBERS
                1= 115
00C0            1= 116 KBINH    EQU     0C0H
00C1            1= 117 KBINL    EQU     0C1H
                1= 118
                1= 119
                1= 120 ;DOWNBEAT INFORMATION PORT DATA
                1= 121
0080            1= 122 DBEAT    EQU     80H     ;BIT D7 IS THE INPUT BIT
00C1            1= 123 INDOWN   EQU     0C1H    ;DOWNBEAT DATA PORT NUMBER
                = 124
                1= 125 $INCLUDE(OSCINI.SRC)
                1= 126 INTL:
003H 3E36       1= 127          MVI     A,OS0INI
003D D3H7       1= 128          OUT     OSACNT
003F D3H7       1= 129          OUT     OSBCNT
0041 3E76       1= 130          MVI     A,OS1INI
0043 D3D7       1= 131          OUT     OSACNT
0045 D3H7       1= 132          OUT     OSBCNT
0047 3E96       1= 133          MVI     A,OS2INI
0049 D3D7       1= 134          OUT     OSACNT
004H D3H7       1= 135          OUT     OSBCNT
                1= 136
                1= 137
004D 3E07       1= 138          MVI     A,7
                1= 139 INTLOP:
004F D3D3       1= 140          OUT     OSAPUR
0051 D3H3       1= 141          OUT     OSBPUR
0053 3D         1= 142          DCR     A
0054 F24F00    C1= 143          JP      INTLOP
                = 144
                = 145
                = 146           ASEG
                = 147
0028            = 148           ORG     28H
                = 149
0028 C9         = 150           RET
                = 151
                = 152
                = 153           CSEG
                  154
0057 C30000    E  155           JMP     MAIN    ;GO TO ENTRY POINT OF MAIN
                  156
                  157           END
```

PUBLIC SYMBOLS

EXTERNAL SYMBOLS

MAIN E 0000

USER SYMBOLS

```
CNTL1  A 00F3   CNTL2  A 00F7   DIALL  A 00H8   DBEAT  A 0080   DNBT   A 00F4   DTIME  A 0010   FI12CL A 0043
FI56CL A 0047   FI56CL A 004H   INDOWN A 00C1   INITLZ C 0000   INTL   C 003B   IN.LOP C 004F   KBINH  A 00C0
KBINL  A 00C1   MAIN   E 0000   ORCLR  A 00F1   OS0INI A 0036   OS1INI A 0076   OS2INI A 00B6   OSACNT A 00D7
OSAPUR A 00D3   OSBCNT A 0087   OSBPUR A 00H3   OSCA0  A 00D4   OSCA1  A 00D5   OSCA2  A 00D6   OSCR0  A 00H4
OSCR1  A 00H5   OSCR2  A 00H6   PORCLK A 00F0   RHMCLK A 00F2   SIALL  A 0038   SWITCH A 00F8
```

ASSEMBLY COMPLETE, NO ERRORS

```
LOC  OBJ        SEQ        SOURCE STATEMENT

                  1 $MOD85 MACROFILE DEBUG
                  2 $TITLE('MAIN/ HOUSEKEEPING')
                  3
                  4          NAME    MAIN
                  5
                  6          PUBLIC  MAIN
                  7          PUBLIC  KEY,TYPE,FOUNDIT
                  8          PUBLIC  OLDKEY,OLDTYP
                  9          PUBLIC  BAR
                 10          PUBLIC  BEAT
                 11          PUBLIC  CLACNT
                 12
                 13          EXTRN   QUIET   ;THIS PROGRAM SILENCES SYSTEM AND SETS MUSIC POINTER
                 14          EXTRN   OUTPUT  ;THIS PROGRAM KEEPS TRACK OF WHEN TO OUTPUT & DOES IT
                 15          EXTRN   FIND    ;THIS PROGRAM NAMES A CHORD ON THE L. H. INPUT
                 16          EXTRN   RGCALC  ;THIS PROGRAM CALCULATES THE ROOT GROUP FROM KEY
                 17          EXTRN   RHYCLK  ;THIS ROUTINE SETS UP 8253 RHY CLK ETC.
                 18          EXTRN   SYNCH   ;THIS ROUTINE SYNCHRONIZES THE DOWNBEAT
                 19
0001             20 CLKIN    EQU     01H     ;CLOCK INPUT PORT NUMBER
00F8             21 SWITCH   EQU     0F8H    ;RHYTHM SWITCH PORT NUMBER
                 22
                 23
                 24 $EJECT   TITLE('MAIN/ SYSTEM EQUATES')
```

```
LOC  OBJ          SEQ        SOURCE STATEMENT

                  =  25 $INCLUDE ( SYSEQU.SRC)
00D3              =  26 OSAPUR  EQU     0D3H
00D7              =  27 OSACNT  EQU     0D7H
00D4              =  28 OSCA0   EQU     0D4H
00D5              =  29 OSCA1   EQU     0D5H
00D6              =  30 OSCA2   EQU     0D6H
00B3              =  31 OSBPUR  EQU     0B3H
00B7              =  32 OSBCNT  EQU     0B7H
00B4              =  33 OSCB0   EQU     0B4H
00B5              =  34 OSCB1   EQU     0B5H
00B6              =  35 OSCB2   EQU     0B6H
                  =  36
                  =  37
0036              =  38 OS0INI  EQU     36H
0076              =  39 OS1INI  EQU     76H
00B6              =  40 OS2INI  EQU     0B6H
                  =  41
                  =  42
                  =  43 ;KEYBOARD INPUT PORT NUMBERS
                  =  44
00C0              =  45 KRINM   EQU     0C0H
00C1              =  46 KRINL   EQU     0C1H
                  =  47
                  =  48
                  =  49 ;DOWNBEAT INFORMATION PORT DATA
                  =  50
0080              =  51 DBEAT   EQU     80H     ;BIT D7 IS THE INPUT BIT
00C1              =  52 INDOWN  EQU     0C1H    ;DOWNBEAT DATA PORT NUMBER
                     53
                     54
                     55 $EJECT  TITLE('MAIN/ MAIN LOOP')
                     56
                     57
                     58
                     59         CSEG
                     60
                     61 ;MAIN PROGRAM LOOP
                     62
                     63 MAIN:
                     64
                     65 BAR1:                   ;THIS IS THE START OF BAR ONE
0000 CD0000    E     66         CALL    SYNCH   ;SYNCHRONIZE DOWNBEAT COUNT
0003 AF              67         XRA     A       ;CLEAR A
0004 320700    D     68         STA     BAR     ;STORE ZERO IN THE BAR COUNTER
0007 CD1500    C     69         CALL    BEAT1   ;PLAY A BAR
                     70
000A 3E01            71 BAR2:   MVI     A,1
000C 320700    D     72         STA     BAR     ;STORE ONE IN THE BAR COUNTER
000F CD1500    C     73         CALL    BEAT1   ;PLAY BAR TWO
                     74
0012 C30000    C     75         JMP     BAR1    ;LOOP FOREVER PLAYING BAR ONE AGAIN ETC.
                     76
                     77 $EJECT  TITLE('MAIN/ BAR PLAY')
                     78 ;THE FOLLOWING ROUTINE PLAYS ONE WHILE THREE OR FOUR BEAT BAR
                     79
                     80 BEAT1:
0015 CD0000    E     81         CALL    RHYCLK  ;CHECK RHYTHM SWITCHES ETC.
0018 AF              82         XRA     A       ;CLEAR A
0019 320000    D     83         STA     BEAT    ;STORE ZERO IN THE BEAT COUNTER
001C CD0700    C     84         CALL    RECOG   ;GET A CHORD
001F CD0000    E     85         CALL    QUIET   ;SILENCE THE SYSTEM
0022 2A0000    D     86         LHLD    KEY
0025 220300    D     87         SHLD    OLDKEY  ;SAVE CHORD KEYTYPE IN OLDKEYBOLDTYP
002A CD7F00    C     88         CALL    ONEBEAT ;PLAY ONE FULL BEAT FOR BEAT1
                     89
                     90 ;START OF LOGIC FOR BEAT TWO
                     91
002D CD0700    C     92         CALL    RECOG   ;GET A CHORD
0030 CDC900    C     93         CALL    SAME    ;SEE IF IT HAS CHANGED
0033 CA4100    C     94         JZ      BEAT2   ;IF NOT GO TO REGULAR BEAT2
                     95
                     96 ;IF CHORD HAS CHANGED BETWEEN BEAT ONE AND TWO THEN
                     97
0036 AF              98         XRA     A       ;CLEAR A
0037 320000    D     99         STA     BEAT    ;PRETEND WE'RE ON BEAT ONE AND CHANGE BEAT COUNT
003A CD0000    E    100         CALL    QUIET   ;SILENCE OVERHANG FROM FORMER BEAT ONE
003D 2A0000    D    101         LHLD    KEY     ;GET CURRENT CHORD
0040 220300    D    102         SHLD    OLDKEY  ;STORE IT IN OLD CHORD
                    103
                    104 BEAT2:
0043 CD0000    E    105         CALL    RHYCLK  ;CHECK RHYTHM SWITCHES ETC.
0046 CD7F00    C    106         CALL    ONEBEAT ;PERFORM MODIFIED OR REGULAR BEAT TWO
                    107
                    108 ;THIS MARKS THE START OF THE LOGIC FOR BEAT THREE
                    109
0049 3E02           110         MVI     A,2     ;INSURE BEAT COUNT IS READY FOR BEAT THREE
004B 320000    D    111         STA     BEAT
                    112
                    113 BEAT3:
004E CD0000    E    114         CALL    RHYCLK  ;CHECK RHYTHM SWITCHES ETC.
0051 CD0700    C    115         CALL    RECOG   ;GET A CHORD FOR BEAT THREE
0054 CD0000    E    116         CALL    QUIET   ;SILENCE IN CASE A BEAT ONE WAS JUST PLAYED
0057 2A0000    D    117         LHLD    KEY     ;STORE IT IN OLD CHORD
005A 220300    D    118         SHLD    OLDKEY
005D CD7F00    C    119         CALL    ONEBEAT ;PERFORM BEAT THREE
                    120
                    121 ;TEST FOR WALTZ
                    122
                    123
                    124
005E DBF0           125         IN      SWITCH  ;INPUT RHYTHM SWITCH DATA
0060 17             126         RAL
```

```
0061 D8                 127          RC                 ;RETURN IF WALTZ IS INDICATED
                        128
                        129
                        130
                        131 ;BEAT FOUR LOGIC STARTS HERE
                        132
0062 CDD700      C      133          CALL     RECOG     ;GET A CHORD FOR BEAT FOUR
0065 CDC900      C      134          CALL     SAME      ;SEE IF IT HAS CHANGED SINCE BEAT THREE
0068 CA7000      C      135          JZ       BEAT4     ;IF NOT PERFORM BEAT FOUR
                        136
                        137 ;IF THEY HAVE CHANGED SINCE BEAT THREE THEN PLAY BEAT ONE OF NEW CHORD
                        138
006B AF                 139          XRA      A         ;CLEAR A
006C 320000      D      140          STA      BEAT      ;SET BEAT COUNT FOR BEAT ONE
006F CD0000      E      141          CALL     QUIET     ;SILENCE OVERHANG FROM BEAT THREE
0072 2A0000      D      142          LHLD     KEY       ;GET CURRENT CHORD
0075 220300      D      143          SHLD     OLDKEY    ;STORE IN OLD CHORD
                        144
                        145 ;REGULAR BEAT FOUR LOGIC
                        146
                        147 BEAT4:
0078 CD0000      E      148          CALL     RHYCLK    ;CHECK RHYTHM SWITCHES ETC.
007B CD7800      C      149          CALL     ONEBEAT   ;PLAY BEAT FOUR
                        150
007E C9                 151          RET                ;RETURN TO BAR LOGIC
                        152
                        153 $EJECT  TITLE('MAIN/ ONE NOTE')
                        154
                        155
                        156 ;THIS ROUTINE OUTPUTS TWELVE RHYTHM CLOCK PULSES WORTH OF DATA
                        157
                        158 ONEBEAT:
007F AF                 159          XRA      A
0080 320400      D      160          STA      CLKCNT
                        161
                        162 UPDATE:
0083 2A0001      D      163          LHLD     KEY
0086 220500      D      164          SHLD     TESKEY
                        165
                        166 SLUGUY:
0089 CD0000      E      167          CALL     OUTPUT
008C 210400      D      168          LXI      H,CLKCNT
008F 34                 169          INR      M
0090 CDED00      C      170          CALL     CKWAIT
0093 3E03               171          MVI      A,3
0095 BE                 172          CMP      M
0096 CA8000      C      173          JZ       OUTLOP
                        174
0099 CDD700      C      175          CALL     RECOG
009C 210500      D      176          LXI      H,TESKEY
009F 3A0000      D      177          LDA      KEY
00A2 BE                 178          CMP      M
00A3 C2AE00      C      179          JNZ      FIX
00A6 23                 180          INX      H
00A7 3A0100      D      181          LDA      TYPE
00AA BE                 182          CMP      M
00AB CA8900      C      183          JZ       SLUGUY
                        184
                        185 FIX:
00AE CD0000      E      186          CALL     QUIET
00B1 C38300      C      187          JMP      UPDATE
                        188
                        189
                        190 OUTLOP:
00B4 CD0000      E      191          CALL     OUTPUT    ;CALL OUTPUT ROUTINE
00B7 210400      D      192          LXI      H,CLKCNT
00BA 34                 193          INR      M
00BB 3E0B               194          MVI      A,11
00BD BE                 195          CMP      M
00BE CDED00      C      196          CALL     CKWAIT    ;WAIT FOR CLOCK PULSE
00C1 F2B400      C      197          JP       OUTLOP    ;LOOP FOR 12 TIMES
                        198
00C4 210000      D      199          LXI      H,BEAT
00C7 34                 200          INR      M         ;INCREMENT BEAT COUNT
00C8 C9                 201          RET                ;BEAT   DONE
                        202
                        203 $EJECT  TITLE('MAIN/ SAME CHORD CHECK')
                        204
                        205
                        206 ;THIS ROUTINE COMPARES THE NEW CHORD WITH THE OLD CHORD (TYPE&KEY)
                        207 ;AND RETURNS STATUS
                        208
                        209
                        210
                        211 SAME:
00C9 210000      D      212          LXI      H,KEY
00CC 3A0300      D      213          LDA      OLDKEY
00CF BE                 214          CMP      M
00D0 C0                 215          RNZ
00D1 23                 216          INX      H
00D2 3A0000      D      217          LDA      OLDTYP
00D5 BE                 218          CMP      M
00D6 C9                 219          RET
                        220
                        221 $EJECT  TITLE('MAIN/ RECOGNIZE')
                        222
                        223 RECOG:
00D7 DBC1               224          IN       RHINL
00D9 E60F               225          ANI      0FH
00DB 47                 226          MOV      B,A
00DC DBC0               227          IN       RHINH
00DE CD0000      E      228          CALL     FIND
00E1 3A0200      D      229          LDA      FOUND1
00E4 1F                 230          RAR
00E5 D8                 231          RC
```

```
00E6 2A0300   D   232          LHLD    OLDKEY
00E9 220000   D   233          SHLD    KEY
00EC C9           234          RET
                  235
                  236
                  237                          ;THIS ROUTINE WAITS FOR CLOCK INPUT
                  238                          ;IT THEN RETURNS WHEN A RHYTHM CLOCK
                  239                          ;PULSE HAS BEEN FOUND
                  240
                  241 CKWAIT:
00ED 3E10         242          MVI     A,10H
00EF 30           243          SIM             ;RESET RST 7.5 INTRPT TO 0
                  244
00F0 FB           245          EI
00F1 76           246          HLT
00F2 C9           247          RET
                  248
                  249          ASEG
003C              250          ORG     3CH
003C C9           251          RET
                  252
                  253          CSEG
                  254
                  255 $EJECT   TITLE('MAIN/ DATA SEGMENT')
                  256          DSEG
                  257
                  258
                  259 KEY:
0001              260          DS      1       ;CHORD'S KEY
                  261 TYPE:
0001              262          DS      1       ;CHORD'S TYPE (MAJ,MIN,AUG ETC.)
                  263 FOUNDIT:
0001              264          DS      1       ;TRUE=0FFH,FALSE=00H
                  265
                  266 ;OLD CHORD DATA
                  267
                  268 OLDKEY:
0001              269          DS      1
                  270 OLDTYP:
0001              271          DS      1
                  272
                  273 ;SLOW GUY CHORD DATA
                  274
                  275 TESKEY:
0001              276          DS      1
                  277 TESTYP:
0001              278          DS      1
                  279
                  280 MAN:
0001              281          DS      1
                  282 HEAT:
0001              283          DS      1
                  284 CLKCNT:
0001              285          DS      1
                  286
                  287
                  288
                  289          END
```

```
PUBLIC SYMBOLS
BAR    D 0007   HEAT   D 0008   CLKCNT D 0009   FOUNDI D 0002   KEY    D 0000   MAIN   C 0000   OLDKEY D 0003
OLDTYP D 0004   TYPE   D 0001

EXTERNAL SYMBOLS
FIND   E 0000   OUTPUT E 0000   QUIET  E 0000   RECALC E 0000   RHYCLK E 0000   SYNCH  E 0000

USER SYMBOLS
BAR    D 0007   MAN1   C 0000   BAR2   C 000A   BEAT   D 0008   BEAT1  C 0015   BEAT2  C 0041   BEAT3  C 004C
BEAT4  C 0078   CKWAIT C 00ED   CLKCNT D 0009   CLKIN  A 0001   DHEAT  A 00B0   FIND   E 0000   FIX    C 00AE
FOUNDI D 0002   INDOWN A 00C1   KBINH  A 00C0   KHINL  A 00C1   KEY    D 0000   MAIN   C 0000   OLDKEY D 0003
OLDTYP D 0004   ONEBEA C 007F   OS01NI A 0036   OS1INI A 0076   OS2INI A 00B6   OSACNT A 00D7   OSAPON A 00D3
OSBCNT A 00B7   OSBPON A 00B3   OSCA0  A 00D4   OSCA1  A 00D5   OSCA2  A 00D6   OSCB0  A 00B4   OSCB1  A 00B5
OSCB2  A 00B6   OUTLOP C 00B4   OUTPUT E 0000   QUIET  E 0000   RELOG  L 00D7   RECALL E 0000   RHYCLK E 0000
SAME   C 00C9   SLOGUY C 0089   SWITCH A 00F8   SYNCH  E 0000   TESKEY D 0005   TESTYP D 0006   TYPE   D 0001
UPDATE C 0083

ASSEMBLY COMPLETE,  NO ERRORS

LOC  OBJ        SEQ        SOURCE STATEMENT

                  1 $MACROFILE DEBUG
                  2
                  3          NAME    SYNCH
                  4
00F0              5 PONCLK   EQU     0F0H        ; PORNAMENTO CLOCK DIVIDER
00F1              6 ONCLK    EQU     0F1H        ; ORCHESTRA PLUS CLOCK DIVIDER
00F2              7 RHMCLK   EQU     0F2H        ; RHYTHM CLOCK DIVIDER
00F3              8 CNTL1    EQU     0F3H        ; CHIP # 1 CONTROL PORT
00F4              9 DHEAT    EQU     0F4H        ; DOWN HEAT DIVIDER
00F7             10 CNTL2    EQU     0F7H        ; CHIP # 2 CONTROL PORT
00F8             11 SWITCH   EQU     0F8H        ; SPEED SWITCH INPUT
0010             12 DTIME    EQU     10H         ; SWITCH FOR DOUBLE TIME
                 13
                 14
                 15          PUBLIC  SYNCH
                 16
                 17          CSEG
                 18
                 19 SYNCH:
0000 3E34        20          MVI     A,34H
0002 D3F7        21          OUT     CNTL2       ; DOWN HEAT IS MODE 2
                 22
```

```
                        23 ;        END RHYTHM INITILAZATION
                        24
                        25
                        26
                        27
 0004 DBF8              28 RHYCLK: IN      SWITCH          ; READ THE SWITCHES
 0006 4F                29         MOV     C,A
 0007 17                30         RAL
 0008 DA1600    C       31         JC      RALTZ
 000A 17                32         RAL
 000C DA1D00    C       33         JC      BALAD
 000F 2603              34 ROCK:   MVI     H,3
 0011 2E20              35         MVI     L,32            ; DIVIDE BY 3 WITH 32 CLOCKS TO DOWN HEAT
 0013 C32100    C       36         JMP     PUTIT
 0016 2604              37 RALTZ:  MVI     H,4
 0018 2E12              38         MVI     L,18            ; DIVIDE BY 4 WITH 18 CLOCKS TO DOWN HEAT
 001A C32100    C       39         JMP     PUTIT
 001D 2604              40 BALAD:  MVI     H,4             ; DIVIDE BY 4
 001F 2E18              41         MVI     L,24            ; 24 CLOCKS TO DOWN HEAT
 0021 7C                42 PUTIT:  MOV     A,H             ; OUTPUT RHYTHM CLOCK PINS!
 0022 D3F2              43         OUT     RHMCLK
 0024 AF                44         XRA     A
 0025 D3F2              45         OUT     RHMCLK
 0027 7D                46         MOV     A,L
 0028 D3F4              47         OUT     DHEAT
 002A AF                48         XRA     A
 002B D3F4              49         OUT     DHEAT
                        50
 002D C9                51         RET
                        52
                        53         END

PUBLIC SYMBOLS
SYNCH  C 0000

EXTERNAL SYMBOLS


USER SYMBOLS
BALAD  C 001D   CNTL1  A 00F3   CNTL2  A 00F7   DHEAT  A 00F4   DTIME  A 0010   BRCLK  A 00F1   PBRCLK A 00F0
PUTIT  C 0021   RHMCLK A 00F2   RHYCLK C 0004   ROCK   C 000F   SWITCH A 00F8   SYNCH  C 0000   RALTZ  C 0016

ASSEMBLY COMPLETE,  NO ERRORS

 LOC  OBJ          SEQ          SOURCE STATEMENT

                        1         NAME    QUIET   ;THIS ROUTINE SILENCES THE SYSTEM AND SETS THE TABLE POINTER
                        2         PUBLIC  QUIET   ;MAKE AVAILABLE THE ENTRY POINT
                        3         PUBLIC  TBLPTR  ;THIS 16 BIT VARIABLE POINTS AT THE NEXT ENTRY IN THE
                        4                         ;MUSIC TABLE
                        5
                        6         EXTRN   BAR     ;THIS 8 BIT VARIABLE CONTAINS THE BAR # (0 OR 1)
                        7         EXTRN   BEAT    ;THIS 8 BIT VARIABLE CONTAINS THE BEAT # (0,1,2,3)
                        8         EXTRN   TYPE    ;THIS 8 BIT VARIABLE CONTAINS A NUMBER
                        9                         ;WHICH REPRESENTS THE CHORD TYPE
                       10                         ;SUCH AS MAJ,MIN,DIM,AUG OR SEV.
                       11         EXTRN   RGRP    ;THIS 8 BIT VARIABLE CONTAINS THE ROOT
                       12                         ;GROUP NUMBER (0,1,2,3).
                       13         EXTRN   RGCALC  ;THIS ROUTINE CALCULATES RGRP FROM KEY
                       14         EXTRN   STYLE   ;THIS 16 BIT VARIABLE CONTAINS THE ADDRESS OF
                       15                         ;THE START OF THE MUSIC TABLE
                       16
                       17         EXTRN   LCNT    ;ADDRESS OF LINCNT VALUES IN OUTPUT
                       18
                   *   19 $INCLUDE            ( SYSEQU.SRC)
 0003              *   20 USAPOR  EQU     03H
 0007              *   21 USALNT  EQU     07H
 0004              *   22 USCA0   EQU     04H
 0005              *   23 USCA1   EQU     05H
 0006              *   24 USCA2   EQU     06H
 0003              *   25 USBPOR  EQU     03H
 0007              *   26 USBCNT  EQU     07H
 0004              *   27 USCR0   EQU     04H
 0005              *   28 USCR1   EQU     05H
 0006              *   29 USCR2   EQU     06H
                   *   30
                   *   31
 003A              *   32 USOINI  EQU     3AH
 007A              *   33 USIINI  EQU     7AH
 00BA              *   34 USZINI  EQU     0BAH
                   *   35
                   *   36
                   *   37 ;KEYBOARD INPUT PORT NUMBERS
                   *   38
 00C0              *   39 KBINH   EQU     0C0H
 00C1              *   40 KBINL   EQU     0C1H
                   *   41
                   *   42
                   *   43 ;DOWNBEAT INFORMATION PORT DATA
                   *   44
 0080              *   45 DHEAT   EQU     80H     ;BIT D7 IS THE INPUT BIT
 00C1              *   46 INDOWN  EQU     0C1H    ;DOWNBEAT DATA PORT NUMBER
                       47
                       48         CSEG    ;START OF CODE SEGMENT
                       49
                       50 QUIET:
                       51
                       52
 0000 CD0000    E       53         CALL    RGCALC  ;CALCULATE RGRP
                       54
 0003 210000            55         LXI     H,0     ;LOAD HL WITH 0
 0006 220100    E       56         SHLD    LCNT+1  ;SET LCNT1 & LCNT2 = 0
 0009 220300    E       57         SHLD    LCNT+3  ;SET LCNT3 & LCNT4 = 0
 000C 220500    E       58         SHLD    LCNT+5  ;SET LCNT5 & LCNT6 = 0
                       59
```

```
0000 210000   E     60          LXI     H,TYPE   ;POINT H&L AT TYPE
0012 7E             61          MOV     A,M      ;LOAD TYPE
0013 3D             62          DCR     A        ;NORMALIZE TYPE TO RANGE 0 TO 4
0014 87             63          ADD     A        ;MULTIPLY TYPE BY 4
0015 87             64          ADD     A
                    65
0016 210000   E     66          LXI     H,RGRP   ;POINT H&L AT ROOT GROUP
0019 86             67          ADD     M        ;ADD RGRP TO 4*TYPE
001A 87             68          ADD     A        ;MULTIPLY (4*TYPE)+RGRP BY 4
001B 87             69          ADD     A
                    70
001C 210000   E     71          LXI     H,RAN    ;POINT H&L AT RAN
001F 86             72          ADD     M        ;ADD RAN TO (4*((4*TYPE)+RGRP))
0020 210000   E     73          LXI     H,BEAT   ;POINT H&L AT BEAT
0023 86             74          ADD     M        ;ADD BEAT TO 4*((4*TYPE)+RGRP)+RAN
                    75
0024 87             76          ADD     A        ;MULTIPLY (4*((4*TYPE)+RGRP)+RAN+BEAT) BY 2
0025 1600           77          MVI     D,0      ;SET UPPER HALF OF DE TO 0
0027 5F             78          MOV     E,A      ;SET LOWER HALF OF DE TO A
0028 2A0000   E     79          LHLD    STYLE    ;LOAD STYLE ADDRESS (AS PER INPUT FROM TABS)
002B 19             80          DAD     D        ;ADD DBE TO H&L CAUSING H&L TO
                    81                           ;POINT AT MUSIC TABLE POINTER VALUE
                    82
002C 5E             83          MOV     E,M
002D 23             84          INX     H
002E 56             85          MOV     D,M
002F EB             86          XCHG
0030 220000   D     87          SHLD    TBLPTR   ;STORE ADDRESS OF NEXT MUSIC
                    88                           ;TABLE POINTER IN TBLPTR
                    89
0033 C9             90          RET
                    91
                    92
                    93          DSEG     ;START OF DATA SEGMENT
                    94
                    95 TBLPTR:
0002                96                   DS      2        ;CONTAINS ADDRESS OF NEXT MUSIC TABLE VALUE
                    97
                    98          END
```

```
PUBLIC SYMBOLS
QUIET  C 0000    TBLPTR D 0000

EXTERNAL SYMBOLS
RAN    E 0000    BEAT   E 0000    LCNT   E 0000    RGCALC E 0000    RGRP   E 0000    STYLE  E 0000    TYPE   E 0000

USER SYMBOLS
RAN    E 0000    BEAT   E 0000    DBEAT  A 00B0    INDOSP A 00C1    RHIGH  A 00C0    RHIGL  A 00C1    LCNT   E 0000
OSUINI A 0036    OS1INI A 0076    OS2INI A 00B6    OSACNT A 00D7    OSAPUR A 00D3    OSBCNT A 00D7    OSBPUR A 00D3
OSCA0  A 0004    OSCA1  A 0005    OSCA2  A 0006    OSCH0  A 00H4    OSCH1  A 00H5    OSCH2  A 00H6    QUIET  C 0000
RGCALC E 0000    RGRP   E 0000    STYLE  E 0000    TBLPTR D 0000    TYPE   E 0000

ASSEMBLY COMPLETE,  NO ERRORS
```

```
LOC  OBJ          SEQ        SOURCE STATEMENT

                    1 $TITLE ('OUTPUT /HJH')
                    2
                    3          NAME    OUTPUT
                    4
                    5          PUBLIC  OUTPUT
                    6
                    7          PUBLIC  LCNT     ;FOR USE IN QUIET, TO SET TO ZEROS
                    8
                    9          EXTRN   TBLPTR   ;POINTS AT NEXT MUSIC TABLE ENTRY
                   10          EXTRN   INSTRU   ;ROUTINE WHICH PLAYS OUTPUT AS PER TABLE ENTRY
                   11
                   12
                   13          CSEG
                   14
                   15
                   16 OUTPUT:
0000 21FFFF   D    17          LXI     H,LCNT   ;LOAD ADDR-1 OF LINE COUNT TABLES
0003 0607          18          MVI     B,7      ;LOAD # OF LINES+1
                   19
                   20 NEWLIN:
0005 05            21          DCR     B        ;HAVE WE GONE THRU ALL THE LINES
0006 C8            22          RZ               ;IF SO RETURN, ELSE
0007 23            23          INX     H        ;MOV H&L TO POINT @ LINE/TIME COUNT
0008 35            24          DCR     M        ;DECREMENT LINE/TIME COUNT
0009 F20500   C    25          JP      NEWLIN   ;IF TIME NOT EXPIRED THEN LOOP
                   26                           ;TO THE NEXT LINE, IF TIME HAS EXPIRED
                   27                           ;THEN
                   28
000C E5            29          PUSH    H        ;SAVE LINE/TIME COUNT POINTER
000D 2A0000   E    30          LHLD    TBLPTR   ;GET ADDRESS OF NEXT TABLE ENTRY
0010 7E            31          MOV     A,M      ;GET THAT ENTRY
0011 E607          32          ANI     07H      ;LOOK AT THE 3 LSBS
0013 C22500   C    33          JNZ     VALID    ;IF THEY ARE NOT ZERO WE HAVE A NOTE TO PLAY
                   34                           ;SO JUMP TO VALID
0016 7E            35          MOV     A,M      ;OTHERWISE WE HAVE A REST SO GET ENTRY AGAIN
0017 E6F8          36          ANI     0F8H     ;LOOK AT FIVE MSBS
0019 1F            37          RAR              ;SHIFT RIGHT BY 3
001A 1F            38          RAR
001B 1F            39          RAR
001C 23            40          INX     H        ;PREPARE TABLE POINTER FOR NEXT ENTRY
001D 220000   E    41          SHLD    TBLPTR   ;SAVE THAT VALUE
0020 E1            42          POP     H        ;RESTORE LINE COUNT POINTER
0021 77            43          MOV     M,A      ;SAVE NEW TIME COUNT
0022 C30500   C    44          JMP     NEWLIN   ;GO FOR THE NEXT LINE
                   45
                   46 VALID:
```

```
0025 CD0000   E   47          CALL    INSTRU  ;CALL THE ROUTINE WHICH ACTUALLY PLAYS THE TUNE
0028 7E           48          MOV     A,M     ;HEL NOW POINT AT THE 2ND BYTE, GET IT
0029 E60F         49          ANI     0FH     ;STRIP AWAY FOUR MSBS
002B 4F           50          MOV     C,A     ;SAVE VALUE IN C
002C 7E           51          MOV     A,M     ;GET VALUE AGAIN
002D E6F0         52          ANI     0F0H    ;STRIP AWAY FOUR LSBS
002F 1F           53          RAR             ;SHIFT RIGHT BY FOUR
0030 1F           54          RAR
0031 1F           55          RAR
0032 1F           56          RAR
0033 81           57          ADD     C       ;COMBINE THE TWO COUNTS
0034 23           58          INX     H       ;PREPARE TABLE POINTER FOR NEXT ENTRY
0035 220000   E   59          SHLD    TBLPTR  ;SAVE THAT VALUE
0038 E1           60          POP     H       ;RESTORE LINE COUNT POINTER
0039 77           61          MOV     M,A     ;SAVE THE COMBINED COUNT
003A C30500   C   62          JMP     NEWLIN  ;GO FOR A NEW LINE
                  63
                  64
                  65          DSEG
                  66
                  67
                  68 ;MUST BE STORED IN RAM, CONTAIN TIME COUNTERS FOR EACH LINE
                  69
FFFF          D   70 LCNT     EQU     $-1
                  71
                  72 LCNT1:
0001              73          DS      1
                  74 LCNT2:
0001              75          DS      1
                  76 LCNT3:
0001              77          DS      1
                  78 LCNT4:
0001              79          DS      1
                  80 LCNT5:
0001              81          DS      1
                  82 LCNT6:
0001              83          DS      1
                  84
                  85
                  86
                  87          END

PUBLIC SYMBOLS
LCNT   D FFFF    OUTPUT C 0000

EXTERNAL SYMBOLS
INSTRU E 0000    TBLPTR E 0000

USER SYMBOLS
INSTRU E 0000    LCNT   D FFFF    LCNT1  D 0000    LCNT2  D 0001    LCNT3  D 0002    LCNT4  D 0003    LCNT5  D 0004
LCNT6  D 0005    NEWLIN C 0005    OUTPUT C 0000    TBLPTR E 0000    VALID  C 0025

ASSEMBLY COMPLETE,  NO ERRORS

LOC  OBJ          SEQ          SOURCE STATEMENT

                   1           NAME    FIND
                   2 ;
                   3 ;
                   4           PUBLIC  FIND
                   5 ;
                   6           EXTRN   FOUNDIT,TYPE,KEY
                   7           EXTRN   GROUP0,GROUP1,GROUP2
                   8 ;
                   9           CSEG
                  10 ;
0000 4F           11 FIND:     MOV     C,A
0001 AF           12           XRA     A
0002 320000   E   13           STA     FOUNDIT
0005 3E0C         14           MVI     A,12
0007 320000   E   15           STA     KEY
000A 79           16           MOV     A,C
                  17 ;
                  18 ;
                  19 ;
                  20 LOOP:
                  21 ;
                  22 ;
000B 50           23           MOV     D,B
000C 4F           24           MOV     C,A
000D 78           25           MOV     A,B
000E 87           26           ADD     A
000F 47           27           MOV     B,A
0010 E610         28           ANI     10H
0012 CA1A00   C   29           JZ      NCRY
0015 78           30           MOV     A,B
0016 E60F         31           ANI     0FH
0018 47           32           MOV     B,A
0019 3F           33           CMC
001A 79           34 NCRY:     MOV     A,C
001B 17           35           RAL
                  36 ;
                  37 ;
                  38 ;
001C DA2700   C   39           JC      NEXT
001F 210000   E   40 BACK:     LXI     H,KEY
0022 35           41           DCR     M
0023 C8           42           RZ
0024 C30B00   C   43           JMP     LOOP
0027 04           44 NEXT:     INR     B
0028 320000   D   45           STA     MULD
002B B7           46           ORA     A
002C FA8600   C   47           JM      CNTFND
002F E660         48           ANI     060H
```

```
0031 EE60          89          XRI     060H
0033 CA8000   C    90          JZ      CNTFND
0036 210000   E    91          LXI     H,GROUP1
0039 D640          92          SUI     40H
003B CA4700   C    93          JZ      0
003E 210000   E    94          LXI     H,GROUP2
0041 DA4700   C    95          JC      0
0044 210000   E    96          LXI     H,GROUP0
0047 3A0000   D    97 0:       LDA     HOLD
004A 87            98          ADD     A
004B 87            99          ADD     A
004C 87            100         ADD     A
004D B2            101         ORA     D
                   102 ;
                   103 ;
                   104 ;
                   105 ;
                   106 ;
004E 56            107         MOV     D,M
                   108 SPEC:
004F 23            109         INX     H
0050 15            110         DCR     D
0051 CA6D00   C    111         JZ      NORM
0054 BE            112         CMP     M
0055 23            113         INX     H
0056 4E            114         MOV     C,M
0057 23            115         INX     H
005B C24F00   C    116         JNZ     SPEC
005B 7E            117         MOV     A,M
005C 210000   E    118         LXI     H,KEY
005F 86            119         ADD     M
0060 77            120         MOV     M,A
0061 CA4700   C    121         JZ      SKIP
0064 F27D00   C    122         JP      BYE
0067 C60C          123 SKIP:   ADI     12
0069 77            124         MOV     M,A
006A C37D00   C    125         JMP     BYE
                   126 NORM:
006D 0E06          127         MVI     C,6
006F 0D            128 NXTYP:  DCR     C
0070 CA8800   C    129         JZ      CNTFND
0073 56            130         MOV     D,M
                   131 NOFND:
0074 23            132         INX     H
0075 15            133         DCR     D
0076 CA6F00   C    134         JZ      NXTYP
0079 BE            135         CMP     M
007A C27400   C    136         JNZ     NOFND
                   137 BYE:
007D 210000   E    138         LXI     H,TYPE
0080 71            139         MOV     M,C
0081 210000   E    140         LXI     H,FOUNDIT
0084 3EFF          141         MVI     A,0FFH
0086 77            142         MOV     M,A
0087 C9            143         RET
008B 3A0000   D    144 CNTFND: LDA     HOLD
008B C31F00   C    145         JMP     BACK
                   146 ;
                   147         DSEG
                   148 ;
0000 00            149 HOLD:   DB      0
                   150 ;
0000          C    151 END     FIND
```

PUBLIC SYMBOLS
FIND C 0000

EXTERNAL SYMBOLS
FOUND1 E 0000 GROUP0 E 0000 GROUP1 E 0000 GROUP2 E 0000 KEY E 0000 TYPE E 0000

USER SYMBOLS
0 C 0047 BACK C 001F BYE C 007D CNTFND C 0088 FIND C 0000 FOUND1 E 0000 GROUP0 E 0000
GROUP1 E 0000 GROUP2 E 0000 HOLD D 0000 KEY E 0000 LOOP C 0000 NEXT C 001A NEXT C 0027
NOFND C 0074 NORM C 006D NXTYP C 006F SKIP C 0067 SPEC C 004F TYPE E 0000

ASSEMBLY COMPLETE, NO ERRORS

```
LOC  OBJ        SEQ        SOURCE STATEMENT

                 1          NAME    TABLE
                 2          PUBLIC  GROUP0,GROUP1,GROUP2
                 3          CSEG
                 4 GROUP0:
0000 01          5          DB      1
0001 0B          6          DB      11
0002 00          7          DB      00H      JC
0003 80          8          DB      80H      JC E
0004 90          9          DB      90H      JC E G
0005 94         10          DB      94H      JC E G A
0006 91         11          DB      91H      JC E G B
0007 10         12          DB      10H      JC G
0008 11         13          DB      11H      JC G B
0009 01         14          DB      01H      JC B
000A 81         15          DB      81H      JC E B
000B 14         16          DB      14H      JC G A
000C 01         17          DB      1
000D 03         18          DB      3
000E 20         19          DB      20H      JC F#
000F 25         20          DB      25H      JC F# A B
0010 03         21          DB      3
0011 88         22          DB      88H      JC E G#
0012 8A         23          DB      8AH      JC E G# A#
0013 08         24          DB      8
0014 02         25          DB      02H      JC A#
```

```
0015 82          26          DB      82H     ;C E A#
0016 92          27          DB      92H     ;C E G A#
0017 12          28          DB      12H     ;C G A#
0018 16          29          DB      16H     ;C G A A#
0019 96          30          DB      96H     ;C E G A A#
001A 86          31          DB      86H     ;C E A A#
                 32 GROUP1:
001B 02          33          DB      2
001C 20          34          DB      20H     ;D#  F# A
001D 03          35          DB      3
001E F7          36          DB      -9
001F 01          37          DB      1
0020 07          38          DB      7
0021 50          39          DB      50H     ;C D# F G
0022 42          40          DB      42H     ;C D# F A#
0023 00          41          DB      00H     ;C D#
0024 10          42          DB      10H     ;C D# G
0025 11          43          DB      11H     ;C D# G B
0026 01          44          DB      01H     ;C D# B
0027 05          45          DB      5
0028 24          46          DB      24H     ;C D# F# A
0029 25          47          DB      25H     ;C D# F# A B
002A 21          48          DB      21H     ;C D# F# B
002B 05          49          DB      05H     ;C D# A B
002C 01          50          DB      1
002D 01          51          DB      1
                 52 GROUP2:
002E 06          53          DB      6
002F 10          54          DB      10H     ;D F A#
0030 04          55          DB      4
0031 F7          56          DB      -9
0032 58          57          DB      58H     ;D E G A A#
0033 01          58          DB      1
0034 F6          59          DB      -10
0035 18          60          DB      18H     ;D E A A#
0036 01          61          DB      1
0037 F6          62          DB      -10
0038 48          63          DB      48H     ;D E G A#
0039 01          64          DB      1
003A F6          65          DB      -10
003B 08          66          DB      08H     ;D E A#
003C 01          67          DB      1
003D F6          68          DB      -10
003E 01          69          DB      1
003F 01          70          DB      1
0040 01          71          DB      1
0041 01          72          DB      1
0042 04          73          DB      4
0043 92          74          DB      92H     ;C D E G A#
0044 82          75          DB      82H     ;C D E A#
0045 02          76          DB      02H     ;C D A#
                 77          END
```

PUBLIC SYMBOLS
GROUP0 C 0000  GROUP1 C 001B  GROUP2 C 002E

EXTERNAL SYMBOLS

USER SYMBOLS
GROUP0 C 0000  GROUP1 C 001B  GROUP2 C 002E

ASSEMBLY COMPLETE,  NO ERRORS

```
LOC  OBJ          SEQ          SOURCE STATEMENT

                    1          NAME    RGCALC
                    2          PUBLIC  RGCALC,RGRP,RGBASE
                    3          EXTRN   KEY
                    4
                    5          CSEG    INPAGE
                    6
                    7 RGCALC:
0000 3A0000    E    8          LDA     KEY
0003 211600    C    9          LXI     H,RGTBL-1
0006 85             10          ADD     L
0007 6F             11          MOV     L,A
0008 7E             12          MOV     A,M
0009 E603           13          ANI     3
000B 320000    D    14          STA     RGRP
000E 7E             15          MOV     A,M
000F E61C           16          ANI     1CH
0011 1F             17          RAR
0012 1F             18          RAR
0013 320100    D    19          STA     RGBASE
0016 C9             20          RET
                    21
                    22
                    23 RGTBL:
0017 1F             24          DB      1FH     ;B
0018 1F             25          DB      1FH     ;A#
0019 16             26          DB      16H     ;A
001A 16             27          DB      16H     ;G#
001B 1F             28          DB      1FH     ;G
001C 09             29          DB      09H     ;F#
001D 16             30          DB      16H     ;F
001E 00             31          DB      0       ;E
001F 09             32          DB      09H     ;D#
0020 09             33          DB      09H     ;D
0021 00             34          DB      0       ;C#
0022 00             35          DB      0       ;C
                    36
                    37          DSEG
                    38
                    39 RGRP:
```

```
0001                    40          DS      1
                        41
                        42 HGBASE:
0001                    43          DS      1
                        44
                        45          END

PUBLIC SYMBOLS
HGBASE D 0001    RGCALC C 0000    HGRP   D 0000

EXTERNAL SYMBOLS
REV    E 0000

USER SYMBOLS
REV    E 0000    HGBASE D 0001    HGCALC C 0000    HGRP   D 0000    HGTBL  C 0017

ASSEMBLY COMPLETE,  NO ERRORS

LOC  OBJ          SEQ          SOURCE STATEMENT

                    1          NAME    DIVCVR
                    2
                    3          PUBLIC  DIVCVR
                    4
                    5
00EB                6 CNATRL   EQU     232
00DB                7 CSHARP   EQU     219
00CF                8 DNATRL   EQU     207
00C3                9 DSHARP   EQU     195
00BB               10 ENATRL   EQU     187
00AE               11 FNATRL   EQU     174
00A4               12 FSHARP   EQU     164
009B               13 GNATRL   EQU     155
0092               14 GSHARP   EQU     146
008A               15 ANATRL   EQU     138
0082               16 ASHARP   EQU     130
007B               17 BNATRL   EQU     123
                   18
                   19          CSEG
                   20 DIVCVR:
0000 212D00    C   21          LXI     H,TABL-5
0003 4F            22          MOV     C,A
0004 E603          23          ANI     3
                   24 LOOP:
0006 3D            25          DCR     A
0007 23            26          INX     H
0008 F20600    C   27          JP      LOOP
                   28
000B 79            29          MOV     A,C
000C E6FC          30          ANI     0FCH
000E 0F            31          RRC
000F 0F            32          RRC
                   33
0010 0EFF          34          MVI     C,-1
                   35
                   36 DVB3:
0012 0C            37          INR     C
0013 D603          38          SUI     3
0015 F21200    C   39          JP      DVB3
0018 C603          40          ADI     3
                   41
                   42 AGAIN:
001A 23            43          INX     H
001B 23            44          INX     H
001C 23            45          INX     H
001D 23            46          INX     H
001E 3D            47          DCR     A
001F F21A00    C   48          JP      AGAIN
0022 7E            49          MOV     A,M
0023 2E00          50          MVI     L,0
0025 67            51          MOV     H,A
                   52
                   53 DSHR:
0026 0D            54          DCR     C
0027 F8            55          RM
0028 7C            56          MOV     A,H
0029 B7            57          ORA     A
002A 1F            58          RAR
002B 67            59          MOV     H,A
002C 7D            60          MOV     A,L
002D 1F            61          RAR
002E 6F            62          MOV     L,A
002F C32600    C   63          JMP     DSHR
                   64
                   65
                   66 TABL:
0032 EB            67          DB      CNATRL,CSHARP,DNATRL,DSHARP,ENATRL
0035 DB
0036 CF
0037 C3
0038 BB
0039 AE            68          DB      FNATRL,FSHARP,GNATRL,GSHARP,ANATRL
003B A4
003C 9B
003D 92
003E 8A
003F 82            69          DB      ASHARP,BNATRL
0040 7B
                   70
                   71
                   72          END
```

```
PUBLIC SYMBOLS
DIVCVR C 0000

EXTERNAL SYMBOLS


USER SYMBOLS
ABAIN  C 001A    ANAIRL A 000A    ABMARP A 0002    BNAIRL A 0078    CNATHL A 00E8    CBMARP A 00DB    DIVCVR C 0000
DNATHL A 00CF    DBMARP A 00C3    DBMR   C 0026    DVR3   C 0012    ENATHL A 0088    FNATHL A 00AE    FBMARP A 00A0
GNATHL A 0048    GBMARP A 0092    LOOP   C 0006    TABL   C 0032

ASSEMBLY COMPLETE,  NO ERRORS

  LOC  OBJ          SEQ          SOURCE STATEMENT

                     1           NAME INSTHU
                     2           PUBLIC  INSTHU,CURINS
                     3           EXTRN   OSCPLY,STYLE,INSTBL,ENVLP,FILTER,PORTA
                     4
                     5           CSEG
                     6
                     7 INSTHU:
  0000 C5            8           PUSH    B        ;SAVE BAC REGS
  0001 4E            9           MOV     C,M      ;STORE FIRST BYTE OF MUSIC TABLE IN "C"
  0002 23           10           INX     H        ;MAKE H&L POINT AT NEXT MUSIC TABLE ENTRY
  0003 E5           11           PUSH    H        ;SAVE H&L IN STACK
                    12
                    13                            ;THE FOLLOWING FIVE INSTRUCTIONS MAKE A = 6 * (A - 1)
                    14                            ;"A" CONTAINS THE INSTRUMENT NUMBER (1 - 7)
  0004 87           15           ADD     A        ;A=A+A
  0005 57           16           MOV     D,A      ;D=A
  0006 87           17           ADD     A        ;A=A+A
  0007 82           18           ADD     D        ;A=A+D
                    19
  0008 C640         20           ADI     160      ;COMPENSATE FOR STYLE TABLE LENGTH
  000A 90           21           SUB     B        ;COMPUTE LINE NUMBER
                    22
  000B 1600         23           MVI     D,0      ;SET HIGH ORDER BYTE=0
  000D 5F           24           MOV     E,A      ;SET LOW ORDER BYTE TO DISPLACEMENT VALUE
                    25
  000E 2A0000   E   26           LHLD    STYLE    ;GET ADDRESS OF CURRENT STYLE
                    27
  0011 19           28           DAD     D        ;COMPUTE 16 BIT ADDRESS
                    29
  0012 5E           30           MOV     E,M      ;GET DISPLACEMENT AND PUT IN LEAST SIGNIFICANT BYTE
  0013 1600         31           MVI     D,0      ;CLEAR MOST SIGNIFICANT BYTE
                    32
  0015 EB           33           XCHG             ;GET D&E INTO H&L SO WE CAN SHIFT
  0016 29           34           DAD     H
  0017 29           35           DAD     H
  0018 29           36           DAD     H        ;SHIFT H&L LEFT BY THREE PLACES
  0019 110000   E   37           LXI     D,INSTBL         ;COMPUTE ADDR OF ACTUAL INSTR TABLE ENTRY
  001C 19           38           DAD     D
  001D 220000   U   39           SHLD    CURINS   ;SAVE THIS ADDRESS IN RAM (CURINS)
                    40
  0020 CD0000   E   41           CALL    OSCPLY
  0023 CD0000   E   42           CALL    ENVLP
  0026 CD0000   E   43           CALL    FILTER
                    44 ;         CALL    PORTA
                    45
  0029 E1           46           POP     H        ;RESTORE H REG
  002A C1           47           POP     B        ;RESTORE B REG
                    48
  002B C9           49           RET
                    50
                    51           CSEG
                    52
                    53 CURINS:
  0002              54           DS      2
                    55
                    56           END

PUBLIC SYMBOLS
CURINS D 0000    INSTRU C 0000

EXTERNAL SYMBOLS
ENVLP  E 0000    FILTER E 0000    INSTBL E 0000    OSCPLY E 0000    STYLE  E 0000

USER SYMBOLS
CURINS D 0000    ENVLP  E 0000    FILTER E 0000    INSTBL E 0000    INSTRU C 0000    OSCPLY E 0000    STYLE  E 0000

ASSEMBLY COMPLETE,  NO ERRORS

  LOC  OBJ          SEQ          SOURCE STATEMENT

                     1 $MACROFILE DEBUG
                     2
                     3           NAME    OSCPLY
                     4           PUBLIC  OSCPLY
                     5           EXTRN   DIVCVR,RGRASE,KEY
                     6
  00D4               7 OSCB0     EQU     0D4H
  00D5               8 OSCB1     EQU     0D5H
  00D6               9 OSCB2     EQU     0D6H
  00B4              10 OSCA0     EQU     0B4H
  00B5              11 OSCA1     EQU     0B5H
  00B6              12 OSCA2     EQU     0B6H
                    13
                    14           CSEG
                    15
                    16 OSCPLY:
  0000 79           17           MOV     A,C
  0001 F6F8         18           ANI     0F8H
  0003 1F           19           RAR
```

```
0004 1F              20          RAR
0005 1F              21          RAR
0006 86              22          ADD     M
0007 23              23          INX     H
0008 E5              24          PUSH    H
0009 C60C            25          ADI     12
000B 210000    E     26          LXI     H,KEY
000E 96              27          SUB     M
000F 210000    E     28          LXI     H,NGBASE
0012 96              29          SUB     M
0013 213600    C     30          LXI     H,BACK   ;SET UP RETURN ADDRESS
0016 E5              31          PUSH    H
0017 CD0000    E     32          CALL    DIVCVR
001A 78              33          MOV     A,B
001B 3D              34          DCR     A
001C CA5400    C     35          JZ      OSC6
001F 3D              36          DCR     A
0020 CA4D00    C     37          JZ      OSC5
0023 3D              38          DCR     A
0024 CA4600    C     39          JZ      OSC4
0027 3D              40          DCR     A
002A CA3F00    C     41          JZ      OSC3
002D 3D              42          DCR     A
002C CA3800    C     43          JZ      OSC2
                     44
                     45 OSC1:
002F 7D              46          MOV     A,L
0030 D3H4            47          OUT     OSCA0
0032 7C              48          MOV     A,H
0033 D3H4            49          OUT     OSCA0
0035 E1              50          POP     H
                     51
                     52 BACK:
0036 E1              53          POP     H
0037 C9              54          RET
                     55
                     56 OSC2:
0038 7D              57          MOV     A,L
0039 D3H5            58          OUT     OSCA1
003B 7C              59          MOV     A,H
003C D3H5            60          OUT     OSCA1
003E C9              61          RET
                     62
                     63 OSC3:
003F 7D              64          MOV     A,L
0040 D3H6            65          OUT     OSCA2
0042 7C              66          MOV     A,H
0043 D3H6            67          OUT     OSCA2
0045 C9              68          RET
                     69
                     70 OSC4:
0046 7D              71          MOV     A,L
0047 D3D4            72          OUT     OSCB0
0049 7C              73          MOV     A,H
004A D3D4            74          OUT     OSCB0
004C C9              75          RET
                     76
                     77 OSC5:
004D 7D              78          MOV     A,L
004E D3D5            79          OUT     OSCB1
0050 7C              80          MOV     A,H
0051 D3D5            81          OUT     OSCB1
0053 C9              82          RET
                     83
                     84 OSC6:
0054 7D              85          MOV     A,L
0055 D3D6            86          OUT     OSCB2
0057 7C              87          MOV     A,H
0058 D3D6            88          OUT     OSCB2
005A C9              89          RET
                     90
                     91          END

PUBLIC SYMBOLS
OSCPLY C 0000

EXTERNAL SYMBOLS
DIVCVR E 0000    KEY    E 0000    NGBASE E 0000

USER SYMBOLS
BACK   C 0036    DIVCVR E 0000    KEY    E 0000    OSC1   C 002F    OSC2   C 0038    OSC3   C 003F    OSC4   C 0046
OSC5   C 004D    OSC6   C 0054    OSCA0  A 00H4    OSCA1  A 00H5    OSCA2  A 00H6    OSCB0  A 00D4    OSCB1  A 00D5
OSCB2  A 00D6    OSCPLY C 0000    NGBASE E 0000

ASSEMBLY COMPLETE,  NO ERRORS

   LOC  OBJ          SEQ          SOURCE STATEMENT

                      1 $ MACROFILE DEBUG
                      2
                      3          NAME    ENVLP
                      4          PUBLIC  ENVLP
                      5          EXTRN   CURINS,TOLPTR
                      6
                      7
                      8 EN       MACRO   N
                      9
                     10          LOCAL   BYTE,BIT,SKIP
                     11
                     12 BYTE:
                     13          MVI     B,7      ;SET UP BYTE COUNT IN "B"
                     14          MOV     A,M      ;LOAD ENVELOPE PARAMETER
                     15
                     16 BIT:
```

```
                 17          RAL                 ;ROTATE MSB INTO CARY
                 18          MOV     B,A         ;SAVE "A" NOT AFFECTING STATUS
                 19          MOV     A,E         ;MOVE INITIAL PIC INSTRUCTION INTO "A"
                 20          JNC     SKIP        ;TEST PARAMETER BIT
                 21          ORA     C           ;"C" CONTAINS MASK IF SENSE MUST BE CHANGED
                 22
                 23 SKIP:
                 24          OUT     EN&N&CTL            ;PERFORM OUTPUT TO PIC CTL PORT
                 25          MOV     A,B         ;RESTORE "A" (RECOVER ENVELOPE PARAMETER)
                 26          DCR     E           ;ALTER PIC INSTRUCTION PROTOTYPE
                 27          DCR     D           ;DECREMENT BIT COUNT
                 28          JP      BIT         ;LOOP UNTIL WE COMPLETE A BYTE
                 29
                 30          INX     H           ;POINT "HL" AT NEXT ENVELOPE PARAMETER
                 31          XRA     A           ;REPLACE A WITH ZERO
                 32          CMP     E           ;CHECK IF ALL 24 UNITS HAVE BEEN OUTPUT
                 33          JM      BYTE        ;IF THEY HAVE NOT THEN LOOP
                 34
                 35          XCHG                ;SAVE "HL" IN "DE"
                 36          LHLD    TBLPTR      ;GET MUSIC TABLE POINTER
                 37          INX     H           ;PREPARE TO LOOK AT NEXT VALUE
                 38          MOV     A,M         ;GET DURATION FROM TABLE
                 39          ANI     0F0H        ;LOOK AT FOUR MSBS
                 40          RAR                 ;SHIFT RIGHT BY 4
                 41          RAR
                 42          RAR
                 43          RAR
                 44          OUT     EN&N&DUR            ;OUTPUT 4 BIT DURATION
                 45          XCHG                ;RESTORE "HL"=CURRNS ADDR
                 46
                 47          POP     B
                 48          RET
                 49
                 50          ENDM
                 51
000F             52 EN1CTL   EQU     0FH
0017             53 EN2CTL   EQU     17H
001F             54 EN3CTL   EQU     1FH
0027             55 EN4CTL   EQU     27H
002F             56 EN5CTL   EQU     2FH
0037             57 EN6CTL   EQU     37H
                 58
                 59
0000             60 EN1DUR   EQU     00H
0010             61 EN2DUR   EQU     10H
0010             62 EN3DUR   EQU     10H
0020             63 EN4DUR   EQU     20H
0020             64 EN5DUR   EQU     20H
0030             65 EN6DUR   EQU     30H
                 66
                 67
                 68
                 69          CSEG
                 70
                 71 ENVLP:
0000 C5          72          PUSH    B           ;SAVE BAC REGS
0001 0E40        73          MVI     C,40H       ;SET UP "C" WITH MASK FOR PIC INSTRUCTION
0003 1E17        74          MVI     E,17H       ;SET UP "E" WITH INITIAL PIC INSTRUCTION
                 75
0005 05          76          DCR     B           ;DECREMENT "B" TO SEE WHICH LINE WE ARE DOING
0006 CA[illegible]00   C     77          JZ      EN6         ;IF "B" WAS 1 THEN GO TO EN6
0009 05          78          DCR     B           ;KEE IT UP UNTIL EN1 FALLS THROUGH
000A CA[illegible]00   C     79          JZ      EN5
000D 05          80          DCR     B
000E CA[illegible]00   C     81          JZ      EN4
0011 05          82          DCR     B
0012 CA[illegible]00   C     83          JZ      EN3
0015 05          84          DCR     B
0016 CA[illegible]00   C     85          JZ      EN2
                 86
                 87 EN1:     EN      1
                 88+
                 89+??0001:
0019 1607        90+         MVI     D,7         ;SET UP BYTE COUNT IN "D"
001B 7E          91+         MOV     A,M         ;LOAD ENVELOPE PARAMETER
                 92+
                 93+??0002:
001C 17          94+         RAL                 ;ROTATE MSB INTO CARY
001D 47          95+         MOV     B,A         ;SAVE "A" NOT AFFECTING STATUS
001E 7B          96+         MOV     A,E         ;MOVE INITIAL PIC INSTRUCTION INTO "A"
001F D22300   C  97+         JNC     ??0003      ;TEST PARAMETER BIT
0022 B1          98+         ORA     C           ;"C" CONTAINS MASK IF SENSE MUST BE CHANGED
                 99+
                100+??0003:
0023 D30F        101+        OUT     EN1CTL      ;PERFORM OUTPUT TO PIC CTL PORT
0025 78          102+        MOV     A,B         ;RESTORE "A" (RECOVER ENVELOPE PARAMETER)
0026 1D          103+        DCR     E           ;ALTER PIC INSTRUCTION PROTOTYPE
0027 15          104+        DCR     D           ;DECREMENT BIT COUNT
0028 F21C00   C  105+        JP      ??0002      ;LOOP UNTIL WE COMPLETE A BYTE
                 106+
0028 23          107+        INX     H           ;POINT "HL" AT NEXT ENVELOPE PARAMETER
002C AF          108+        XRA     A           ;REPLACE A WITH ZERO
002D B8          109+        CMP     E           ;CHECK IF ALL 24 UNITS HAVE BEEN OUTPUT
002E FA1900   C  110+        JM      ??0001      ;IF THEY HAVE NOT THEN LOOP
                 111+
0031 EB          112+        XCHG                ;SAVE "HL" IN "DE"
0032 2A0000   E  113+        LHLD    TBLPTR      ;GET MUSIC TABLE POINTER
0035 23          114+        INX     H           ;PREPARE TO LOOK AT NEXT VALUE
0036 7E          115+        MOV     A,M         ;GET DURATION FROM TABLE
0037 E6F0        116+        ANI     0F0H        ;LOOK AT FOUR MSBS
0039 1F          117+        RAR                 ;SHIFT RIGHT BY 4
003A 1F          118+        RAR
003B 1F          119+        RAR
003C 1F          120+        RAR
```

```
003D D308          121+        OUT     EN1DUR  ;OUTPUT 4 BIT DURATION
003F EB            122+        XCHG            ;RESTORE "HL"=CURRENT ADDR
                   123+
0040 C1            124+        POP     B
0041 C9            125+        RET
                   126+
                   127 EN2:    EN      2
                   128+
                   129+770004:
0042 1607          130+        MVI     D,7     ;SET UP BYTE COUNT IN "D"
0044 7E            131+        MOV     A,M     ;LOAD ENVELOPE PARAMETER
                   132+
                   133+770005:
0045 17            134+        RAL             ;ROTATE MSB INTO CARY
0046 47            135+        MOV     B,A     ;SAVE "A" NOT AFFECTING STATUS
0047 78            136+        MOV     A,E     ;MOVE INITIAL PIC INSTRUCTION INTO "A"
0048 D24C00    C   137+        JNC     770006  ;TEST PARAMETER BIT
004B B1            138+        ORA     C       ;"C" CONTAINS MASK IF SENSE MUST BE CHANGED
                   139+
                   140+770006:
004C D317          141+        OUT     EN2CTL  ;PERFORM OUTPUT TO PIC CTL PORT
004E 78            142+        MOV     A,B     ;RESTORE "A" (RECOVER ENVELOPE PARAMETER)
004F 1D            143+        DCR     E       ;ALTER PIC INSTRUCTION PROTOTYPE
0050 15            144+        DCR     D       ;DECREMENT BIT COUNT
0051 F24500    C   145+        JP      770005  ;LOOP UNTIL BE COMPLETE A BYTE
                   146+
0054 23            147+        INX     H       ;POINT "HL" AT NEXT ENVELOPE PARAMETER
0055 AF            148+        XRA     A       ;REPLACE A WITH ZERO
0056 BB            149+        CMP     E       ;CHECK IF ALL 24 UNITS HAVE BEEN OUTPUT
0057 FA4200    C   150+        JM      770004  ;IF THEY HAVE NOT THEN LOOP
                   151+
005A EB            152+        XCHG            ;SAVE "HL" IN "DE"
005B 2A0000    E   153+        LHLD    TBLPTR  ;GET MUSIC TABLE POINTER
005E 23            154+        INX     H       ;PREPARE TO LOOK AT NEXT VALUE
005F 7E            155+        MOV     A,M     ;GET DURATION FROM TABLE
0060 E6F0          156+        ANI     0F0H    ;LOOK AT FOUR MSBS
0062 1F            157+        RAR             ;SHIFT RIGHT BY 4
0063 1F            158+        RAR
0064 1F            159+        RAR
0065 1F            160+        RAR
0066 D310          161+        OUT     EN2DUR  ;OUTPUT 4 BIT DURATION
0068 EB            162+        XCHG            ;RESTORE "HL"=CURRENT ADDR
                   163+
0069 C1            164+        POP     B
006A C9            165+        RET
                   166+
                   167 EN3:    EN      3
                   168+
                   169+770007:
006B 1607          170+        MVI     D,7     ;SET UP BYTE COUNT IN "D"
006D 7E            171+        MOV     A,M     ;LOAD ENVELOPE PARAMETER
                   172+
                   173+770008:
006E 17            174+        RAL             ;ROTATE MSB INTO CARY
006F 47            175+        MOV     B,A     ;SAVE "A" NOT AFFECTING STATUS
0070 78            176+        MOV     A,E     ;MOVE INITIAL PIC INSTRUCTION INTO "A"
0071 D27500    C   177+        JNC     770009  ;TEST PARAMETER BIT
0074 B1            178+        ORA     C       ;"C" CONTAINS MASK IF SENSE MUST BE CHANGED
                   179+
                   180+770009:
0075 D31F          181+        OUT     EN3CTL  ;PERFORM OUTPUT TO PIC CTL PORT
0077 78            182+        MOV     A,B     ;RESTORE "A" (RECOVER ENVELOPE PARAMETER)
0078 1D            183+        DCR     E       ;ALTER PIC INSTRUCTION PROTOTYPE
0079 15            184+        DCR     D       ;DECREMENT BIT COUNT
007A F26B00    C   185+        JP      770008  ;LOOP UNTIL BE COMPLETE A BYTE
                   186+
007D 23            187+        INX     H       ;POINT "HL" AT NEXT ENVELOPE PARAMETER
007E AF            188+        XRA     A       ;REPLACE A WITH ZERO
007F BB            189+        CMP     E       ;CHECK IF ALL 24 UNITS HAVE BEEN OUTPUT
0080 FA6B00    C   190+        JM      770007  ;IF THEY HAVE NOT THEN LOOP
                   191+
0083 EB            192+        XCHG            ;SAVE "HL" IN "DE"
0084 2A0000    E   193+        LHLD    TBLPTR  ;GET MUSIC TABLE POINTER
0087 23            194+        INX     H       ;PREPARE TO LOOK AT NEXT VALUE
0088 7E            195+        MOV     A,M     ;GET DURATION FROM TABLE
0089 E6F0          196+        ANI     0F0H    ;LOOK AT FOUR MSBS
008B 1F            197+        RAR             ;SHIFT RIGHT BY 4
008C 1F            198+        RAR
008D 1F            199+        RAR
008E 1F            200+        RAR
008F D318          201+        OUT     EN3DUR  ;OUTPUT 4 BIT DURATION
0091 EB            202+        XCHG            ;RESTORE "HL"=CURRENT ADDR
                   203+
0092 C1            204+        POP     B
0093 C9            205+        RET
                   206+
                   207 EN4:    EN      4
                   208+
                   209+770010:
0094 1607          210+        MVI     D,7     ;SET UP BYTE COUNT IN "D"
0096 7E            211+        MOV     A,M     ;LOAD ENVELOPE PARAMETER
                   212+
                   213+770011:
0097 17            214+        RAL             ;ROTATE MSB INTO CARY
0098 47            215+        MOV     B,A     ;SAVE "A" NOT AFFECTING STATUS
0099 78            216+        MOV     A,E     ;MOVE INITIAL PIC INSTRUCTION INTO "A"
009A D29E00    C   217+        JNC     770012  ;TEST PARAMETER BIT
009D B1            218+        ORA     C       ;"C" CONTAINS MASK IF SENSE MUST BE CHANGED
                   219+
                   220+770012:
009E D327          221+        OUT     EN4CTL  ;PERFORM OUTPUT TO PIC CTL PORT
00A0 78            222+        MOV     A,B     ;RESTORE "A" (RECOVER ENVELOPE PARAMETER)
00A1 1D            223+        DCR     E       ;ALTER PIC INSTRUCTION PROTOTYPE
00A2 15            224+        DCR     D       ;DECREMENT BIT COUNT
```

```
00A3 F29700   C   225+        JP      ??0011  ;LOOP UNTIL WE COMPLETE A BYTE
                  226+
00A6 23           227+        INX     H       ;POINT "HL" AT NEXT ENVELOPE PARAMETER
00A7 AF           228+        XRA     A       ;REPLACE A WITH ZERO
00A8 BB           229+        CMP     E       ;CHECK IF ALL 24 UNITS HAVE BEEN OUTPUT
00A9 FA9000   C   230+        JM      ??0010  ;IF THEY HAVE NOT THEN LOOP
                  231+
00AC EB           232+        XCHG            ;SAVE "HL" IN "DE"
00AD 2A0000   E   233+        LHLD    TBLPTR  ;GET MUSIC TABLE POINTER
00B0 23           234+        INX     H       ;PREPARE TO LOOK AT NEXT VALUE
00B1 7E           235+        MOV     A,M     ;GET DURATION FROM TABLE
00B2 E6F0         236+        ANI     0F0H    ;LOOK AT FOUR MSBS
00B4 1F           237+        RAR             ;SHIFT RIGHT BY 4
00B5 1F           238+        RAR
00B6 1F           239+        RAR
00B7 1F           240+        RAR
00B8 D320         241+        OUT     EN4DUR  ;OUTPUT 4 BIT DURATION
00BA EB           242+        XCHG            ;RESTORE "HL"=CURRNS ADDR
                  243+
00BB C1           244+        POP     B
00BC C9           245+        RET
                  246+
                  247 EN5:    EN      5
                  248+
                  249+??0013:
00BD 1607         250+        MVI     D,7     ;SET UP BYTE COUNT IN "D"
00BF 7E           251+        MOV     A,M     ;LOAD ENVELOPE PARAMETER
                  252+
                  253+??0014:
00C0 17           254+        RAL             ;ROTATE MSB INTO CARY
00C1 47           255+        MOV     B,A     ;SAVE "A" NOT AFFECTING STATUS
00C2 7B           256+        MOV     A,E     ;MOVE INITIAL PIC INSTRUCTION INTO "A"
00C3 D2C700   E   257+        JNC     ??0015  ;TEST PARAMETER BIT
00C6 B1           258+        ORA     C       ;"C" CONTAINS MASK IF SENSE MUST BE CHANGED
                  259+
                  260+??0015:
00C7 D32F         261+        OUT     EN5CTL  ;PERFORM OUTPUT TO PIC CTL PORT
00C9 78           262+        MOV     A,B     ;RESTORE "A" (RECOVER ENVELOPE PARAMETER)
00CA 1D           263+        DCR     E       ;ALTER PIC INSTRUCTION PROTOTYPE
00CB 15           264+        DCR     D       ;DECREMENT BIT COUNT
00CC F2C000   C   265+        JP      ??0014  ;LOOP UNTIL WE COMPLETE A BYTE
                  266+
00CF 23           267+        INX     H       ;POINT "HL" AT NEXT ENVELOPE PARAMETER
00D0 AF           268+        XRA     A       ;REPLACE A WITH ZERO
00D1 BB           269+        CMP     E       ;CHECK IF ALL 24 UNITS HAVE BEEN OUTPUT
00D2 FAD000   C   270+        JM      ??0013  ;IF THEY HAVE NOT THEN LOOP
                  271+
00D5 EB           272+        XCHG            ;SAVE "HL" IN "DE"
00D6 2A0000   E   273+        LHLD    TBLPTR  ;GET MUSIC TABLE POINTER
00D9 23           274+        INX     H       ;PREPARE TO LOOK AT NEXT VALUE
00DA 7E           275+        MOV     A,M     ;GET DURATION FROM TABLE
00DB E6F0         276+        ANI     0F0H    ;LOOK AT FOUR MSBS
00DD 1F           277+        RAR             ;SHIFT RIGHT BY 4
00DE 1F           278+        RAR
00DF 1F           279+        RAR
00E0 1F           280+        RAR
00E1 D328         281+        OUT     EN5DUR  ;OUTPUT 4 BIT DURATION
00E3 EB           282+        XCHG            ;RESTORE "HL"=CURRNS ADDR
                  283+
00E4 C1           284+        POP     B
00E5 C9           285+        RET
                  286+
                  287 EN6:    EN      6
                  288+
                  289+??0016:
00E6 1607         290+        MVI     D,7     ;SET UP BYTE COUNT IN "D"
00E8 7E           291+        MOV     A,M     ;LOAD ENVELOPE PARAMETER
                  292+
                  293+??0017:
00E9 17           294+        RAL             ;ROTATE MSB INTO CARY
00EA 47           295+        MOV     B,A     ;SAVE "A" NOT AFFECTING STATUS
00EB 7B           296+        MOV     A,E     ;MOVE INITIAL PIC INSTRUCTION INTO "A"
00EC D2F000   C   297+        JNC     ??0018  ;TEST PARAMETER BIT
00EF B1           298+        ORA     C       ;"C" CONTAINS MASK IF SENSE MUST BE CHANGED
                  299+
                  300+??0018:
00F0 D337         301+        OUT     EN6CTL  ;PERFORM OUTPUT TO PIC CTL PORT
00F2 78           302+        MOV     A,B     ;RESTORE "A" (RECOVER ENVELOPE PARAMETER)
00F3 1D           303+        DCR     E       ;ALTER PIC INSTRUCTION PROTOTYPE
00F4 15           304+        DCR     D       ;DECREMENT BIT COUNT
00F5 F2E900   C   305+        JP      ??0017  ;LOOP UNTIL WE COMPLETE A BYTE
                  306+
00F8 23           307+        INX     H       ;POINT "HL" AT NEXT ENVELOPE PARAMETER
00F9 AF           308+        XRA     A       ;REPLACE A WITH ZERO
00FA BB           309+        CMP     E       ;CHECK IF ALL 24 UNITS HAVE BEEN OUTPUT
00FB FAF600   C   310+        JM      ??0016  ;IF THEY HAVE NOT THEN LOOP
                  311+
00FE EB           312+        XCHG            ;SAVE "HL" IN "DE"
00FF 2A0000   E   313+        LHLD    TBLPTR  ;GET MUSIC TABLE POINTER
0102 23           314+        INX     H       ;PREPARE TO LOOK AT NEXT VALUE
0103 7E           315+        MOV     A,M     ;GET DURATION FROM TABLE
0104 E6F0         316+        ANI     0F0H    ;LOOK AT FOUR MSBS
0106 1F           317+        RAR             ;SHIFT RIGHT BY 4
0107 1F           318+        RAR
0108 1F           319+        RAR
0109 1F           320+        RAR
010A D330         321+        OUT     EN6DUR  ;OUTPUT 4 BIT DURATION
010C EB           322+        XCHG            ;RESTORE "HL"=CURRNS ADDR
                  323+
010D C1           324+        POP     B
010E C9           325+        RET
                  326+
                  327
```

```
                    328
                    329          END

PUBLIC SYMBOLS
ENVLP  C 0000

EXTERNAL SYMBOLS
CURINS E 0000     TALPIN E 0000

USER SYMBOLS
CURINS E 0000  EN     + 0000  EN1    C 0019  EN1CTL A 000F  EN1DUR A 0008  EN2    C 0002  EN2CTL A 0017
EN2DUR A 0010  EN3    C 0008  EN3CTL A 001F  EN3DUR A 0018  EN4    C 0004  EN4CTL A 0027  EN4DUR A 0020
EN5    C 0000  EN5CTL A 002F  EN5DUR A 0028  EN6    C 00E6  EN6CTL A 0037  EN6DUR A 0030  ENVLP  C 0000
TALPIN E 0000

ASSEMBLY COMPLETE,  NO ERRORS

  LOC  OBJ          SEQ        SOURCE STATEMENT

                      1 $MACROFILE DEBUG
                      2
                      3          NAME    FILTER
                      4          PUBLIC  FILTER
                      5          EXTRN   CURINS
                      6
  0041                7 FI1PWR   EQU     41H
  0040                8 FI2PWR   EQU     40H
  0045                9 FI3PWR   EQU     45H
  0044               10 FI4PWR   EQU     44H
  0049               11 FI5PWR   EQU     49H
  004A               12 FI6PWR   EQU     48H
                     13
  0043               14 FI1CTL   EQU     43H
  0043               15 FI2CTL   EQU     43H
  0047               16 FI3CTL   EQU     47H
  0047               17 FI4CTL   EQU     47H
  004B               18 FI5CTL   EQU     4BH
  004B               19 FI6CTL   EQU     4BH
                     20
                     21
                     22          CSEG
                     23
                     24 FILTER:
  0000 4C            25          MOV     C,M
  0001 23            26          INX     H
  0002 E5            27          PUSH    H
  0003 78            28          MOV     A,B
  0004 87            29          ADD     A
  0005 80            30          ADD     B
  0006 214600     L  31          LXI     H,OUT6-3
  0009 1600          32          MVI     D,0
  000B 5F            33          MOV     E,A
  000C 19            34          DAD     D
  000D 111300     C  35          LXI     D,MAC
  0010 D5            36          PUSH    D
  0011 79            37          MOV     A,C
  0012 E9            38          PCHL
                     39
                     40 BAL:
  0013 111200        41          LXI     D,3*6   ;LENGTH OF CODE TIMES SIX LINES
  0016 19            42          DAD     D
  0017 220000     U  43          SHLD    OUTH
                     44
  001A 0E90          45          MVI     C,090H
  001C 78            46          MOV     A,B
  001D 1F            47          RAR
  001E DA2300     L  48          JC      NEXT
  0021 0E94          49          MVI     C,094H
                     50
                     51 NEXT:
  0023 E1            52          POP     H
  0024 1603          53          MVI     D,3
  0026 7E            54          MOV     A,M
                     55
                     56 AGAIN:
  0027 1F            57          RAR
  0028 F5            58          PUSH    PSW
  0029 DA5A00     C  59          JC      OUTYES
                     60
                     61 OUTNO:
  002C 3EBF          62          MVI     A,0BFH
  002E A1            63          ANA     C
                     64
                     65 SHIFT:
  002F CD4500     L  66          CALL    OUTCTL
  0032 F1            67          POP     PSW
  0033 15            68          DCR     D
  0034 FA4100     C  69          JM      RETURN
  0037 0C            70          INR     C
  0038 C32700     L  71          JMP     AGAIN
                     72
                     73 OUTYES:
  003A 3E40          74          MVI     A,040H
  003D B1            75          ORA     C
  003E C32F00     C  76          JMP     SHIFT
                     77
                     78
                     79 RETURN:
  0041 220000     E  80          SHLD    CURINS
  0044 C9            81          RET
                     82 OUTCTL:
  0045 2A0000     U  83          LHLD    OUTH
  0048 E9            84          PCHL
                     85 OUT6:
```

```
0049 D348          86          OUT     F16FWR
004A C9            87          RET
                   88
                   89 OUT5:
004C D349          90          OUT     F15FWR
004E C9            91          RET
                   92
                   93 OUT4:
004F D344          94          OUT     F14FWR
0051 C9            95          RET
                   96
                   97 OUT3:
0052 D345          98          OUT     F13FWR
0054 C9            99          RET
                  100
                  101 OUT2:
0055 D340         102          OUT     F12FWR
0057 C9           103          RET
                  104
                  105 OUT1:
0058 D341         106          OUT     F11FWR
005A C9           107          RET
                  108
                  109
005B D348         110          OUT     F16CTL
005D C9           111          RET
005E D348         112          OUT     F15CTL
0060 C9           113          RET
0061 D347         114          OUT     F14CTL
0063 C9           115          RET
0064 D347         116          OUT     F13CTL
0066 C9           117          RET
0067 D345         118          OUT     F12CTL
0069 C9           119          RET
006A D343         120          OUT     F11CTL
006C C9           121          RET
                  122
                  123          DSEG
                  124
                  125 OUTN:
0002              126          DB      2
                  127
                  128          END

PUBLIC SYMBOLS
FILTER C 0000

EXTERNAL SYMBOLS
CURINS E 0000

USER SYMBOLS
AGAIN  C 0027   NAC    C 0013   CURINS E 0000   F11CTL A 0043   F11FWR A 0041   F12CTL A 0043   F12FWR A 0040
F13CTL A 0047   F13FWR A 0045   F14CTL A 0047   F14FWR A 0044   F15CTL A 004B   F15FWR A 0049   F16CTL A 0046
F16FWR A 0048   FILTER C 0000   NEXT   C 0023   OUNNO  C 002C   OUT1   C 0058   OUT2   C 0055   OUT3   C 0052
OUT4   C 004F   OUT5   C 004C   OUT6   C 0049   OUTCTL C 0045   OUTN   D 0000   OUTYES C 003B   RETURN C 0041
SIFT   C 002F

ASSEMBLY COMPLETE,  NO ERRORS

 LOC  OBJ          SEQ          SOURCE STATEMENT

                    1 SNACKOFILE
                    2
                    3          NAME    STYLE
                    4          PUBLIC  STYLE
                    5
                    6          CSEG
                    7
0000 0200      C    8 STYLE:   DW      $+2
                    9
                   10
                   11          EXTRN   AU0X11,AU0X21,AU0X13,AU0X23
                   12          EXTRN   AU1X11,AU1X21,AU1X13,AU1X23
                   13          EXTRN   AU2X11,AU2X21,AU2X13,AU2X23
                   14          EXTRN   AU3X11,AU3X21,AU3X13,AU3X23
                   15
                   16          EXTRN   DI0X11,DI0X21,DI0X13,DI0X23
                   17          EXTRN   DI1X11,DI1X21,DI1X13,DI1X23
                   18          EXTRN   DI2X11,DI2X21,DI2X13,DI2X23
                   19          EXTRN   DI3X11,DI3X21,DI3X13,DI3X23
                   20
                   21          EXTRN   SE0X11,SE0X21,SE0X13,SE0X23
                   22          EXTRN   SE1X11,SE1X21,SE1X13,SE1X23
                   23          EXTRN   SE2X11,SE2X21,SE2X13,SE2X23
                   24          EXTRN   SE3X11,SE3X21,SE3X13,SE3X23
                   25
                   26          EXTRN   MA0X11,MA0X21,MA0X13,MA0X23
                   27          EXTRN   MA1X11,MA1X21,MA1X13,MA1X23
                   28          EXTRN   MA2X11,MA2X21,MA2X13,MA2X23
                   29          EXTRN   MA3X11,MA3X21,MA3X13,MA3X23
                   30
                   31          EXTRN   MI0X11,MI0X21,MI0X13,MI0X23
                   32          EXTRN   MI1X11,MI1X21,MI1X13,MI1X23
                   33          EXTRN   MI2X11,MI2X21,MI2X13,MI2X23
                   34          EXTRN   MI3X11,MI3X21,MI3X13,MI3X23
                   35
                   36
0002 0000      E   37 SEV:     DW      SE0X11
0004 0000      E   38          DW      SE0X21
0006 0000      E   39          DW      SE0X13
0008 0000      E   40          DW      SE0X23
000A 0000      E   41          DW      SE1X11
000C 0000      E   42          DW      SE1X21
000E 0000      E   43          DW      SE1X13
```

```
0010 0000    E    44          DW     SE1X23
0012 0000    E    45          DW     SE2X11
0014 0000    E    46          DW     SE2X21
0016 0000    E    47          DW     SE2X13
001R 0000    E    48          DW     SE2X23
001A 0000    E    49          DW     SE3X11
001C 0000    E    50          DW     SE3X21
001E 0000    E    51          DW     SE3X13
0020 0000    E    52          DW     SE3X23
0022 0000    E    53 AUG:     DW     AU0X11
0024 0000    E    54          DW     AU0X21
0026 0000    E    55          DW     AU0X13
0028 0000    E    56          DW     AU0X23
002A 0000    E    57          DW     AU1X11
002C 0000    E    58          DW     AU1X21
002E 0000    E    59          DW     AU1X13
0030 0000    E    60          DW     AU1X23
0032 0000    E    61          DW     AU2X11
0034 0000    E    62          DW     AU2X21
0036 0000    E    63          DW     AU2X13
0038 0000    E    64          DW     AU2X23
003A 0000    E    65          DW     AU3X11
003C 0000    E    66          DW     AU3X21
003E 0000    E    67          DW     AU3X13
0040 0000    E    68          DW     AU3X23
0042 0000    E    69 DIM:     DW     DI0X11
0044 0000    E    70          DW     DI0X21
0046 0000    E    71          DW     DI0X13
0048 0000    E    72          DW     DI0X23
004A 0000    E    73          DW     DI1X11
004C 0000    E    74          DW     DI1X21
004E 0000    E    75          DW     DI1X13
0050 0000    E    76          DW     DI1X23
0052 0000    E    77          DW     DI2X11
0054 0000    E    78          DW     DI2X21
0056 0000    E    79          DW     DI2X13
0058 0000    E    80          DW     DI2X23
005A 0000    E    81          DW     DI3X11
005C 0000    E    82          DW     DI3X21
005E 0000    E    83          DW     DI3X13
0060 0000    E    84          DW     DI3X23
0062 0000    E    85 MIN:     DW     MI0X11
0064 0000    E    86          DW     MI0X21
0066 0000    E    87          DW     MI0X13
0068 0000    E    88          DW     MI0X23
006A 0000    E    89          DW     MI1X11
006C 0000    E    90          DW     MI1X21
006E 0000    E    91          DW     MI1X13
0070 0000    E    92          DW     MI1X23
0072 0000    E    93          DW     MI2X11
0074 0000    E    94          DW     MI2X21
0076 0000    E    95          DW     MI2X13
0078 0000    E    96          DW     MI2X23
007A 0000    E    97          DW     MI3X11
007C 0000    E    98          DW     MI3X21
007E 0000    E    99          DW     MI3X13
0080 0000    E   100          DW     MI3X23
0082 0000    E   101 MAJ:     DW     MA0X11
0084 0000    E   102          DW     MA0X21
0086 0000    E   103          DW     MA0X13
0088 0000    E   104          DW     MA0X23
008A 0000    E   105          DW     MA1X11
008C 0000    E   106          DW     MA1X21
008E 0000    E   107          DW     MA1X13
0090 0000    E   108          DW     MA1X23
0092 0000    E   109          DW     MA2X11
0094 0000    E   110          DW     MA2X21
0096 0000    E   111          DW     MA2X13
0098 0000    E   112          DW     MA2X23
009A 0000    E   113          DW     MA3X11
009C 0000    E   114          DW     MA3X21
009E 0000    E   115          DW     MA3X13
00A0 0000    E   116          DW     MA3X23
                 117
                 118
                 119          END

PUBLIC SYMBOLS
STYLE  C 0000

EXTERNAL SYMBOLS
AU0X11 F 0000   AU0X13 E 0000   AU0X21 E 0000   AU0X23 E 0000   AU1X11 E 0000   AU1X13 E 0000   AU1X21 E 0000
AU1X23 E 0000   AU2X11 E 0000   AU2X13 E 0000   AU2X21 E 0000   AU2X23 E 0000   AU3X11 E 0000   AU3X13 E 0000
AU3X21 E 0000   AU3X23 E 0000   DI0X11 E 0000   DI0X13 E 0000   DI0X21 E 0000   DI0X23 E 0000   DI1X11 E 0000
DI1X13 E 0000   DI1X21 E 0000   DI1X23 E 0000   DI2X11 E 0000   DI2X13 E 0000   DI2X21 E 0000   DI2X23 E 0000
DI3X11 E 0000   DI3X13 E 0000   DI3X21 E 0000   DI3X23 E 0000   MA0X11 E 0000   MA0X13 E 0000   MA0X21 E 0000
MA0X23 E 0000   MA1X11 E 0000   MA1X13 E 0000   MA1X21 E 0000   MA1X23 E 0000   MA2X11 E 0000   MA2X13 E 0000
MA2X21 E 0000   MA2X23 E 0000   MA3X11 E 0000   MA3X13 E 0000   MA3X21 E 0000   MA3X23 E 0000   MI0X11 E 0000
MI0X13 E 0000   MI0X21 E 0000   MI0X23 E 0000   MI1X11 E 0000   MI1X13 E 0000   MI1X21 E 0000   MI1X23 E 0000
MI2X11 E 0000   MI2X13 E 0000   MI2X21 E 0000   MI2X23 E 0000   MI3X11 E 0000   MI3X13 E 0000   MI3X21 E 0000
MI3X23 E 0000   SE0X11 E 0000   SE0X13 E 0000   SE0X21 E 0000   SE0X23 E 0000   SE1X11 E 0000   SE1X13 F 0000
SE1X21 E 0000   SE1X23 E 0000   SE2X11 E 0000   SE2X13 E 0000   SE2X21 E 0000   SE2X23 E 0000   SE3X11 E 0000
SE3X13 E 0000   SE3X21 E 0000   SE3X23 E 0000

USER SYMBOLS
AU0X11 E 0000   AU0X13 E 0000   AU0X21 E 0000   AU0X23 E 0000   AU1X11 E 0000   AU1X13 E 0000   AU1X21 F 0000
AU1X23 E 0000   AU2X11 E 0000   AU2X13 E 0000   AU2X21 E 0000   AU2X23 E 0000   AU3X11 E 0000   AU3X13 E 0000
AU3X21 E 0000   AU3X23 E 0000   AUG    C 0022   DI0X11 E 0000   DI0X13 E 0000   DI0X21 E 0000   DI0X23 E 0000
DI1X11 E 0000   DI1X13 E 0000   DI1X21 E 0000   DI1X23 E 0000   DI2X11 E 0000   DI2X13 E 0000   DI2X21 E 0000
DI2X23 E 0000   DI3X11 E 0000   DI3X13 E 0000   DI3X21 E 0000   DI3X23 E 0000   DIM    C 0042   MA0X11 E 0000
MA0X13 E 0000   MA0X21 E 0000   MA0X23 E 0000   MA1X11 E 0000   MA1X13 E 0000   MA1X21 E 0000   MA1X23 E 0000
MA2X11 E 0000   MA2X13 E 0000   MA2X23 E 0000   MA3X11 E 0000   MA3X13 E 0000   MA3X21 E 0000   MA3X23 E 0000
MA3X23 E 0000   MAJ    C 0082   MI0X11 E 0000   MI0X13 E 0000   MI0X21 E 0000   MI0X23 E 0000   MI1X11 E 0000
MI1X13 E 0000   MI1X21 E 0000   MI1X23 E 0000   MI2X11 E 0000   MI2X13 E 0000   MI2X21 E 0000   MI2X23 E 0000
```

```
MI3X11 E 0000   MI3X13 E 0000   MI3X21 E 0000   MI3X23 E 0000   MIN    C 0062   SE0X11 E 0000   SE0X13 E 0000
SE0X21 E 0000   SE0X23 E 0000   SE1X11 E 0000   SE1X13 E 0000   SE1X21 E 0000   SE1X23 E 0000   SE2X11 E 0000
SE2X13 E 0000   SE2X21 E 0000   SE2X23 E 0000   SE3X11 E 0000   SE3X13 E 0000   SE3X21 E 0000   SE3X23 E 0000
SEV    C 0002   STYLE  C 0000

ASSEMBLY COMPLETE.  NO ERRORS

  LOC  OBJ        SEQ        SOURCE STATEMENT

                    1          NAME    MA0XXX
                    2          CSEG
                    3          PUBLIC  MA0X11
                    4          PUBLIC  MA0X13
                    5          PUBLIC  MA0X21
                    6          PUBLIC  MA0X23
                    7 MA0X11:
0000 C1             8          DB      0C1H,089H       ;C5,1,9,9
0001 89
0002 42             9          DB      042H,041H       ;E4,2,5,1
0003 41
0004 62            10          DB      062H,041H       ;C3,2,5,1
0005 41
0006 C1            11          DB      0C1H,089H       ;C6,1,9,9
0007 89
0008 42            12          DB      082H,041H       ;E5,2,5,1
0009 41
000A 62            13          DB      062H,041H       ;C4,2,5,1
000B 41
000C 89            14          DB      089H,014H       ;F4,1,2,4
000D 14
000E 71            15          DB      071H,014H       ;D3,1,2,4
000F 14
0010 89            16          DB      089H,014H       ;F5,1,2,4
0011 14
0012 71            17          DB      071H,014H       ;D4,1,2,4
0013 14
0014 99            18          DB      099H,074H       ;G4,1,8,4
0015 74
0016 81            19          DB      081H,074H       ;E3,1,8,4
0017 74
0018 99            20          DB      099H,074H       ;G5,1,8,4
0019 74
001A 81            21          DB      081H,074H       ;E4,1,8,4
001B 74
001C C1            22          DB      0C1H,023H       ;C5,1,3,3
001D 23
001E C1            23          DB      0C1H,023H       ;C6,1,3,3
001F 23
                   24 MA0X13:
0020 E2            25          DB      0E2H,041H       ;E5,2,5,1
0021 41
0022 9A            26          DB      09AH,041H       ;G4,2,5,1
0023 41
0024 61            27          DB      061H,065H       ;C3,1,7,5
0025 65
0026 E2            28          DB      0E2H,041H       ;E6,2,5,1
0027 41
0028 9A            29          DB      09AH,041H       ;G5,2,5,1
0029 41
002A 61            30          DB      061H,065H       ;C4,1,7,5
002B 65
002C D1            31          DB      0D1H,014H       ;D5,1,2,4
002D 14
002E 89            32          DB      089H,014H       ;F4,1,2,4
002F 14
0030 D1            33          DB      0D1H,014H       ;D6,1,2,4
0031 14
0032 89            34          DB      089H,014H       ;F5,1,2,4
0033 14
0034 C1            35          DB      0C1H,014H       ;C5,1,2,4
0035 14
0036 81            36          DB      081H,074H       ;E4,1,8,4
0037 74
0038 39            37          DB      039H,074H       ;G2,1,8,4
0039 74
003A C1            38          DB      0C1H,014H       ;C6,1,2,4
003B 14
003C 81            39          DB      081H,074H       ;E5,1,8,4
003D 74
003E 39            40          DB      039H,074H       ;G3,1,8,4
003F 74
0040 89            41          DB      089H,014H       ;B4,1,2,4
0041 14
0042 89            42          DB      089H,014H       ;B5,1,2,4
0043 14
                   43 MA0X21:
0044 C1            44          DB      0C1H,074H       ;C5,1,8,4
0045 74
0046 28            45          DB      028H            ;H,1,6,0
0047 28            46          DB      028H            ;H,1,6,0
0048 C1            47          DB      0C1H,074H       ;C6,1,8,4
0049 74
004A 28            48          DB      028H            ;H,1,6,0
004B 28            49          DB      028H            ;H,1,6,0
004C 81            50          DB      081H,032H       ;E4,1,4,2
004D 32
004E 71            51          DB      071H,032H       ;D3,1,4,2
004F 32
0050 81            52          DB      081H,032H       ;E5,1,4,2
0051 32
0052 71            53          DB      071H,032H       ;D4,1,4,2
0053 32
0054 C2            54          DB      0C2H,041H       ;C5,2,5,1
0055 41
```

```
0056 99          55          DB      099H,065H       ;G4,1,7,5
0057 65
0058 82          56          DB      082H,041H       ;E3,2,5,1
0059 41
005A C2          57          DB      0C2H,041H       ;C6,2,5,1
005B 41
005C 99          58          DB      099H,065H       ;G5,1,7,5
005D 65
005E 82          59          DB      082H,041H       ;E4,2,5,1
005F 41
0060 89          60          DB      089H,023H       ;H4,1,3,3
0061 23
0062 71          61          DB      071H,023H       ;D3,1,3,3
0063 23
0064 89          62          DB      089H,023H       ;B5,1,3,3
0065 23
0066 71          63          DB      071H,023H       ;D4,1,3,3
0067 23
                 64 MAOX23:
006B C1          65          DB      0C1H,074H       ;C5,1,8,4
006B 74
006A 81          66          DB      081H,023H       ;E4,1,3,3
006B 23
006C 61          67          DB      061H,023H       ;C3,1,3,3
006D 23
006E C1          68          DB      0C1H,074H       ;C6,1,8,4
006F 74
0070 81          69          DB      081H,023H       ;E5,1,3,3
0071 23
0072 61          70          DB      061H,023H       ;C4,1,3,3
0073 23
0074 89          71          DB      089H,023H       ;F4,1,3,3
0075 23
0076 71          72          DB      071H,023H       ;D3,1,3,3
0077 23
0078 89          73          DB      089H,023H       ;F5,1,3,3
0079 23
007A 71          74          DB      071H,023H       ;D4,1,3,3
007B 23
007C 99          75          DB      099H,074H       ;G4,1,8,4
007D 74
007E 61          76          DB      061H,074H       ;C4,1,8,4
007F 74
0080 81          77          DB      081H,074H       ;E3,1,8,4
0081 74
0082 99          78          DB      099H,074H       ;G5,1,8,4
0083 74
0084 61          79          DB      061H,074H       ;C5,1,8,4
0085 74
0086 81          80          DB      081H,074H       ;E4,1,8,4
0087 74
                 81          END

PUBLIC SYMBOLS
MAOX11 C 0000    MAOX13 C 0020    MAOX21 C 0044    MAOX23 C 006B

EXTERNAL SYMBOLS


USER SYMBOLS
MAOX11 C 0000    MAOX13 C 0020    MAOX21 C 0044    MAOX23 C 006B

ASSEMBLY COMPLETE,  NO ERRORS

  LOC  OBJ          SEQ          SOURCE STATEMENT

                     1           NAME    MAOXXX
                     2           CSEG
                     3           PUBLIC  MAOX11
                     4           PUBLIC  MAOX13
                     5           PUBLIC  MAOX21
                     6           PUBLIC  MAOX23
                     7 MAOX11:
  0000 61            8           DB      061H,038H       ;C5,1,4,8
  0001 36
  0002 00            9           DB      00H             ;H,1,1,0
  0003 49           10           DB      049H,038H       ;A3,1,4,8
  0004 38
  0005 00           11           DB      00H             ;R,1,1,0
  0006 39           12           DB      039H,038H       ;G2,1,4,8
  0007 38
  0008 61           13           DB      061H,092H       ;C2,1,10,2
  0009 92
  000A 99           14           DB      099H,037H       ;G4,1,4,7
  000B 37
  000C 81           15           DB      081H,037H       ;E3,1,4,7
  000D 37
  000E 58           16           DB      058H            ;H,1,12,0
  000F 58           17           DB      058H            ;R,1,12,0
  0010 58           18           DB      058H            ;R,1,12,0
  0011 58           19           DB      058H            ;R,1,12,0
  0012 58           20           DB      058H            ;R,1,12,0
  0013 C1           21           DB      0C1H,092H       ;C3,1,10,2
  0014 92
                    22 MAOX13:
  0015 58           23           DB      058H            ;H,1,12,0
  0016 58           24           DB      058H            ;R,1,12,0
  0017 58           25           DB      058H            ;R,1,12,0
  0018 58           26           DB      058H            ;R,1,12,0
  0019 58           27           DB      058H            ;R,1,12,0
  001A A9           28           DB      0A9H,092H       ;A2,1,10,2
  001B 92
  001C 58           29           DB      058H            ;H,1,12,0
  001D 58           30           DB      058H            ;R,1,12,0
```

```
001E 58          31          DB      058H            ;R,1,12,0
001F 58          32          DB      058H            ;R,1,12,0
0020 58          33          DB      058H            ;R,1,12,0
0021 99          34          DB      099H,052H       ;G2,1,6,2
0022 52
0023 C1          35          DB      0C1H,021H       ;C3,1,3,1
0024 21
                 36 MAOX21:
0025 28          37          DB      028H            ;W,1,6,0
0026 28          38          DB      028H            ;W,1,6,0
0027 30          39          DB      030H            ;R,1,7,0
0028 28          40          DB      028H            ;W,1,6,0
0029 30          41          DB      030H            ;R,1,7,0
002A 61          42          DB      061H,092H       ;C2,1,10,2
002B 92
002C 64          43          DB      064H,0D4H       ;C5,4,14,4
002D D4
002E 9C          44          DB      09CH,0D4H       ;G4,4,14,4
002F D4
0030 84          45          DB      084H,0D4H       ;E3,4,14,4
0031 D4
0032 4C          46          DB      04CH,0D3H       ;A3,4,14,3
0033 D3
0034 3C          47          DB      03CH,0D3H       ;G2,4,14,3
0035 D3
0036 71          48          DB      071H,092H       ;D2,1,10,2
0037 92
                 49 MAOX23:
0038 61          50          DB      061H,061H       ;C5,1,7,1
0039 61
003A 99          51          DB      099H,062H       ;G4,1,7,2
003B 62
003C 49          52          DB      049H,062H       ;A3,1,7,2
003D 62
003E 81          53          DB      081H,061H       ;E3,1,7,1
003F 61
0040 39          54          DB      039H,061H       ;G2,1,7,1
0041 61
0042 61          55          DB      081H,092H       ;E2,1,10,2
0043 92
0044 62          56          DB      062H,02DH       ;C5,2,3,13
0045 2D
0046 82          57          DB      082H,02DH       ;E3,2,3,13
0047 2D
0048 3A          58          DB      03AH,02DH       ;G2,2,3,13
0049 2D
004A 9A          59          DB      09AH,02CH       ;G4,2,3,12
004B 2C
004C 4A          60          DB      04AH,02CH       ;A3,2,3,12
004D 2C
004E B9          61          DB      0B9H,092H       ;F2,1,10,2
004F 92
                 62          END
                  1 $MACNOFILE DEBUG
                  2
                  3          CSEG
                  4
0000 00           5          DB      0
0001 01           6          DB      1
0002 02           7          DB      2
0003 03           8          DB      3
0004 04           9          DB      4
0005 05          10          DB      5
                 11
0006 06          12          DB      6
0007 07          13          DB      7
0008 08          14          DB      8
0009 09          15          DB      9
000A 0A          16          DB      10
000B 0B          17          DB      11
                 18
000C 0C          19          DB      12
000D 0D          20          DB      13
000E 0E          21          DB      14
000F 0F          22          DB      15
0010 10          23          DB      16
0011 11          24          DB      17
                 25
                 26          END
                  1 $MACNOFILE
                  2 $DEBUG
                  3
                  4          NAME    INBTBL
                  5          PUBLIC  INBTBL
                  6
                  7          CSEG
                  8
                  9 INBTBL:
                 10
                 11 INB1:
0000 1B          12          DB      27
0001 00          13          DB      00H
0002 F1          14          DB      11110001B
0003 27          15          DB      00100111B
0004 08          16          DB      00001000B
0005 05          17          DB      00000101B
0006 05          18          DB      00000101B
0007 00          19          DB      0
                 20 INB2:
0008 1B          21          DB      27
0009 00          22          DB      00H
000A F1          23          DB      11110001B
000B 27          24          DB      00100111B
000C 04          25          DB      00000100B
000D 05          26          DB      00000101B
```

```
000E 05          27          DB      00000101B
000F 00          28          DB      0
0010 0F          29 INB3:    DB      15
0011 00          30          DB      00H
0012 F1          31          DB      11110001B
0013 27          32          DB      00100111B
0014 04          33          DB      00000100B
0015 05          34          DB      00000101B
0016 05          35          DB      00000101B
0017 00          36          DB      0
                 37 INB4:
0018 27          38          DB      39
0019 00          39          DB      00H
001A F1          40          DB      11110001B
001B 27          41          DB      00100111B
001C 04          42          DB      00000100B
001D 05          43          DB      00000101B
001E 05          44          DB      00000101B
001F 00          45          DB      0
                 46 INB5:
0020 27          47          DB      39
0021 00          48          DB      00H
0022 F1          49          DB      11110001B
0023 27          50          DB      00100111B
0024 04          51          DB      00000100B
0025 05          52          DB      00000101B
0026 05          53          DB      00000101B
0027 00          54          DB      0
                 55
                 56 INB6:
0028 1B          57          DB      27
0029 00          58          DB      00H
002A F1          59          DB      11110001B
002B 27          60          DB      00100111B
002C 04          61          DB      00000100B
002D 05          62          DB      00000101B
002E 05          63          DB      00000101B
002F 00          64          DB      0
                 65
                 66
                 67 INB1B:
0030 1B          68          DB      27
0031 00          69          DB      00H
0032 F1          70          DB      11110001B
0033 E7          71          DB      11100111B
0034 04          72          DB      00000100B
0035 05          73          DB      00000101B
0036 05          74          DB      00000101B
0037 00          75          DB      0
                 76 INB2B:
0038 1B          77          DB      27
0039 00          78          DB      00H
003A F1          79          DB      11110001B
003B E7          80          DB      11100111B
003C 04          81          DB      00000100B
003D 05          82          DB      00000101B
003E 05          83          DB      00000101B
003F 00          84          DB      0
0040 0F          85 INB3B:   DB      15
0041 00          86          DB      00H
0042 F1          87          DB      11110001B
0043 E7          88          DB      11100111B
0044 04          89          DB      00000100B
0045 05          90          DB      00000101B
0046 05          91          DB      00000101B
0047 00          92          DB      0
                 93 INB4B:
0048 27          94          DB      39
0049 00          95          DB      00H
004A F1          96          DB      11110001B
004B E7          97          DB      11100111B
004C 04          98          DB      00000100B
004D 05          99          DB      00000101B
004E 05          100         DB      00000101B
004F 00          101         DB      0
                 102 INB5B:
0050 27          103         DB      39
0051 00          104         DB      00H
0052 F1          105         DB      11110001B
0053 E7          106         DB      11100111B
0054 04          107         DB      00000100B
0055 05          108         DB      00000101B
0056 05          109         DB      00000101B
0057 00          110         DB      0
                 111
                 112 INB6B:
0058 1B          113         DB      27
0059 00          114         DB      00H
005A F1          115         DB      11110001B
005B E7          116         DB      11100111B
005C 04          117         DB      00000100B
005D 05          118         DB      00000101B
005E 05          119         DB      00000101B
005F 00          120         DB      0
                 121 INB1C:
0060 1B          122         DB      27
0061 00          123         DB      00H
0062 F1          124         DB      11110001B
0063 87          125         DB      00001111B
0064 04          126         DB      00000100B
0065 05          127         DB      00000101B
0066 05          128         DB      00000101B
0067 00          129         DB      0
                 130 INB2C:
0068 1B          131         DB      27
```

```
0069 00          132          DB      00H
006A F1          133          DB      11110001B
006B 07          134          DB      00000111B
006C 04          135          DB      00000100B
006D 05          136          DB      00000101B
006E 05          137          DB      00000101B
006F 00          138          DB      0
0070 0F          139 INB3C:   DB      15
0071 00          140          DB      00H
0072 F1          141          DB      11110001B
0073 07          142          DB      00000111B
0074 04          143          DB      00000100B
0075 05          144          DB      00000101B
0076 05          145          DB      00000101B
0077 00          146          DB      0
                 147 INB4C:
0078 27          148          DB      39
0079 00          149          DB      00H
007A F1          150          DB      11110001B
007B 07          151          DB      00000111B
007C 04          152          DB      00000100B
007D 05          153          DB      00000101B
007E 05          154          DB      00000101B
007F 00          155          DB      0
                 156 INB5C:
0080 27          157          DB      39
0081 00          158          DB      00H
0082 F1          159          DB      11110001B
0083 07          160          DB      00000111B
0084 04          161          DB      00000100B
0085 05          162          DB      00000101B
0086 05          163          DB      00000101B
0087 00          164          DB      0
                 165
                 166 INB6C:
0088 1B          167          DB      27
0089 00          168          DB      00H
008A F1          169          DB      11110001B
008B 07          170          DB      00000111B
008C 04          171          DB      00000100B
008D 05          172          DB      00000101B
008E 05          173          DB      00000101B
008F 00          174          DB      0
                 175
                 176          END
```

PUBLIC SYMBOLS
INSTHL C 0000

EXTERNAL SYMBOLS

USER SYMBOLS

```
INB1   C 0000   INB1B  C 0030   INB1C  C 0060   INB2   C 0008   INB2B  C 0038   INB2C  C 0068   INB3   C 0010
INB3B  C 0040   INB3C  C 0070   INB4   C 0018   INB4B  C 0048   INB4C  C 0078   INB5   C 0020   INB5B  C 0050
INB5C  C 0080   INB6   C 0028   INB6B  C 0058   INB6C  C 0088   INBTBL C 0000
                  1 $          TITLE   ('**** FIXED RATE RHYTHM ROUTINE VER 3.0 5-13-78 ****')
                  2 $          MACROFILE
                  3 $          DEBUG
                  4
                  5 ;          THIS ROUTINE HAS BEEN MODIFIED (ON 5-13-78) TO INCLUDE
                  6 ;          THE RHYTHM INTERUPT PORTION. THE ORCHRESTRA PLUS CLOCK
                  7 ;          HAS BEEN CONNECTED TO THE RST 7.5 INTERUPT INPUT.
                  8
                  9            NAME    RHYCLK
                 10            PUBLIC  RHYCLK
                 11
00F0             12 PORCLK     EQU     0F0H            ; PORMAMENTO CLOCK DIVIDER
00F1             13 ORCLK      EQU     0F1H            ; ORCHRESTRA PLUS CLOCK DIVIDER
00F2             14 RHMCLK     EQU     0F2H            ; RHYTHM CLOCK DIVIDER
00F3             15 CNTL1      EQU     0F3H            ; CHIP # 1 CONTROL PORT
00F4             16 DBEAT      EQU     0F4H            ; DOWN BEAT DIVIDER
00F7             17 CNTL2      EQU     0F7H            ; CHIP # 2 CONTROL PORT
00FA             18 SWITCH     EQU     0FBH            ; SPEED SWITCH INPUT
0010             19 DTIME      EQU     10H             ; SWITCH FOR DOUBLE TIME
                 20
                 21
                 22            CSEG
                 23
0000 DBFB        24 RHYCLK:    IN      SWITCH          ; READ THE SWITCHES
0002 4F          25            MOV     C,A
0003 E610        26            ANI     DTIME
0005 CA1100   C  27            JZ      NORTIM
0008 212000   D  28            LXI     H,TABLE1
000B 224000   D  29            SHLD    TABPTR
000E C31700   C  30            JMP     SPEED1
0011 210000   D  31 NORTIM:    LXI     H,TABLE
0014 224000   D  32            SHLD    TABPTR
0017 79          33 SPEED1:    MOV     A,C
0018 E60F        34            ANI     0FH             ; LEAVE ONLY THE SPEED CODE
001A 110000      35            LXI     D,0
001D 2A4000   D  36            LHLD    TABPTR          ; POINT TO CORRECT TABLE
0020 5F          37            MOV     E,A             ; SET UP TO FIND ACTUAL RATE IN LOOK-UP TABLE
0021 19          38            DAD     D
0022 19          39            DAD     D
0023 7E          40            MOV     A,M
0024 D3F0        41            OUT     PORCLK
0026 23          42            INX     H
0027 7E          43            MOV     A,M
0028 D3F0        44            OUT     PORCLK
002A C9          45            RET
                 46
                 47            DSEG
                 48
```

```
0000 3A06          49 TABLE:  DW     1594          ; 49 BEATS PER MINUTE
0002 A705          50         DW     1447          ; 54 BEATS PER MINUTE
0004 2C05          51         DW     1324          ; 59 BEATS PER MINUTE
0006 B204          52         DW     1202          ; 65 BEATS PER MINUTE
0008 4C04          53         DW     1100          ; 71 BEATS PER MINUTE
000A F703          54         DW     1015          ; 77 BEATS PER MINUTE
000C 9703          55         DW     919           ; 85 BEATS PER MINUTE
000E 4603          56         DW     840           ; 93 BEATS PER MINUTE
0010 FE02          57         DW     766           ; 102 BEATS PER MINUTE
0012 C002          58         DW     704           ; 111 BEATS PER MINUTE
0014 8002          59         DW     640           ; 122 BEATS PER MINUTE
0016 0002          60         DW     567           ; 133 BEATS PER MINUTE
0018 1702          61         DW     535           ; 146 BEATS PER MINUTE
001A E001          62         DW     480           ; 160 BEATS PER MINUTE
001C BE01          63         DW     446           ; 175 BEATS PER MINUTE
001E 9001          64         DW     409           ; 191 BEATS PER MINUTE
                   65
0020 1D03          66 TABLE1: DW     797           ; 98 BEATS PER MINUTE
0022 D302          67         DW     723           ; 109 BEATS PER MINUTE
0024 9602          68         DW     662           ; 118 BEATS PER MINUTE
0026 5902          69         DW     601           ; 130 BEATS PER MINUTE
0028 2602          70         DW     550           ; 142 BEATS PER MINUTE
002A F401          71         DW     507           ; 154 BEATS PER MINUTE
002C CC01          72         DW     460           ; 170 BEATS PER MINUTE
002E A401          73         DW     420           ; 186 BEATS PER MINUTE
0030 7F01          74         DW     383           ; 204 BEATS PER MINUTE
0032 6001          75         DW     352           ; 222 BEATS PER MINUTE
0034 4001          76         DW     320           ; 244 BEATS PER MINUTE
0036 2601          77         DW     294           ; 266 BEATS PER MINUTE
0038 0C01          78         DW     268           ; 292 BEATS PER MINUTE
003A F400          79         DW     244           ; 320 BEATS PER MINUTE
003C DF00          80         DW     223           ; 350 BEATS PER MINUTE
003E CD00          81         DW     205           ; 382 BEATS PER MINUTE
                   82
                   83         ORG
                   84
0002               85 TABPTR: DS     2
                   86
                   87         END

PUBLIC SYMBOLS
MHYCLK C 0000

EXTERNAL SYMBOLS

USER SYMBOLS
CNTL1  A 00F3   CNTL2  A 00F7   DHEAT  A 00F4   DTIME  A 0010   NONTIM C 0011   DHCLK  A 00F1   PDHCLK A 00F0
MHMCLK A 00F2   MHYCLK C 0000   SPEED1 C 0017   SWITCH A 00F8   TABLE  D 0000   TABLE1 D 0020   TABPTR D 0040

ASSEMBLY COMPLETE.  NO ERRORS
```

What is claimed is:

1. Electronic musical apparatus for enabling a performer to control the production of at least first and second musical accompaniments including notes having an instrumentation pattern, said apparatus comprising in combination:

memory means for storing a first plurality of music signals defining at least in part the first musical accompaniment and a second plurality of music signals defining at least in part the second musical accompaniment;

selection means operative during the performance for generating a first selection signal in response to selection of the first musical accompaniment by the performer and for generating a second selection signal in response to selection of the second musical accompaniment by the performer;

harmony selection means for enabling the performer to select at least one harmony from a plurality of different harmonies;

processing means responsive to the generating of the first selection signal and one harmony for generating a first set of parameter signals based at least in part on the first plurality of music signals, said first set of said parameter signals defining a first segment of music including a plurality of pitched accompaniment notes arranged in the one harmony and having a first instrumentation pattern and for modifying the first set of parameter signals during the performance in response to the generating of the second selection signal and one harmony in order to generate a second set of parameter signals based at least in part on the second plurality of music signals, said second set of parameter signals defining a second segment of music having a second instrumentation pattern different from the first instrumentation pattern; and output means for converting the parameter signals to sound, whereby a performer of limited skill or musical knowledge can play a musically-variable accompaniment to a melody written in any one of a variety of musical keys.

2. Electronic musical apparatus for enabling a performer to control the production of a musical accompaniment including notes having one or more of the musical parameters of rhythm pattern, chord pattern and melodic contour, said accompaniment being produced during a musical performance, said apparatus comprising in combination:

harmony selection means for enabling the performer to select one harmony from a plurality of different harmonies and to change from the one harmony to a second harmony within the plurality of different harmonies during the performance, the plurality of different harmonies being defined by a plurality of different chord types having a plurality of different root notes and the one harmony having a defined chord type and a defined root note;

processing means responsive to the selection of the one harmony for generating parameter signals defining a first segment of music including a plurality of pitched accompaniment notes arranged in the one harmony and having a first chord pattern, for modifying the parameter signals during the performance in response to a change in the defined root note while retaining the defined chord type in order to define a second segment of music having a second chord pattern different from the first chord pattern and for modifying the parameter signals during the performance in response to a change in the defined chord type in order to harmonically modulate the second segment compared to the first segment; and output means for converting the parameter signals to sound, whereby a performer of limited skill or musical knowledge can play a musically-variable accompaniment to a melody written in any one of a variety of musical keys.

3. Electronic musical apparatus for enabling a performer to control the production of a musical accompaniment including notes having one or more of the musical parameters of rhythm pattern, chord pattern and melodic contour, said accompaniment being produced during a musical performance, said apparatus comprising in combination:

harmony selection means for enabling the performer to select one harmony from a plurality of different harmonies and to change from the one harmony to a second harmony within the plurality of different harmonies during the performance;

processing means responsive to the selection of the one harmony for generating parameter signals defining a first segment of music including a plurality of pitched accompaniment notes arranged in the one harmony and having a first rhythm pattern and for modifying the parameter signals during the performance in response to a change to the selected second harmony in order to generate parameter signals defining a second segment of music arranged in the second harmony and having a second rhythm pattern different from the first rhythm pattern; and output means for converting the parameter signals to sound, whereby a performer of limited skill or musical knowledge can play a musically-variable accompaniment to a melody written in any one of a variety of musical keys.

4. Electronic musical apparatus for enabling a performer to control the production of a musical accompaniment including notes having one or more of the musical parameters of rhythm pattern, chord pattern and melodic contour, said accompaniment being produced during a musical performance, said apparatus comprising in combination:

harmony selection means for enabling the performer to select one harmony from a plurality of different harmonies and to change from the one harmony to a second harmony within the plurality of different harmonies during the performance;

processing means responsive to the selection of the one harmony for generating parameter signals defining a first segment of music including a plurality of pitched accompaniment notes arranged in the one harmony and having a first melodic contour and for modifying the parameter signals during the performance in response to a change to the selected second harmony in order to generate parameter signals defining a second segment of music arranged in the second harmony and having a second melodic contour different from the first melodic contour; and output means for converting the parameter signals to sound, whereby a performer of limited skill or musical knowledge can play a musically-variable accompaniment to a melody written in any one of a variety of musical keys.

5. Apparatus, as claimed in claims 1, 2, 3, or 4, wherein the processing means includes means for generating parameter signals that enable the accompaniment notes to sound in a plurality of different timbres and prevent the accompaniment notes from lying outside the range of any instrument being simulated by the timbres.

6. Apparatus, as claimed in claims 1, 2 , 3, or 4, wherein the processing means includes means for generating parameter signals which define a counter melody related to the one selected harmony.

7. Apparatus, as claimed in claims 1, 2, 3, or 4, wherein the processing means includes means for generating paremeter signals which define accompaniment notes arranged in a contrapuntal form.

8. Apparatus, as claimed in claims 1, 2, 3, or 4, wherein the processing means comprises adjustable tempo means for generating clock pulses defining a time duration of a musical bar in which the accompaniment notes occur, said clock pulses dividing the bar into a predetermined number of musical beats.

9. Apparatus, as claimed in claim 8, wherein the tempo means generates first beat tempo clock pulses during a first beat of the bar and second beat tempo clock pulses during a second beat of the bar, and wherein the processing means includes means for dividing the parameter signals into a first group corresponding to the first beat and a second group corresponding to the second beat, for generating the first group during the first beat tempo clock pulses irrespective of the harmony selected, for generating the second group during the second beat tempo clock pulses in the event there is no change in the selected harmony between the first and second beats, and for generating the first group during the second beat tempo clock pulses in the event there is a change in the selected harmony between the first and second beats.

10. Apparatus, as claimed in claims 1, 2, 3, or 4, wherein the parameter signals define a first voice and a second voice for producing the segment of music and wherein the output means comprises:

first oscillator means associated with the first voice and second oscillator means associated with the second voice for generating tone pulses at a rate determined by the parameter signals;

filter means associated with the first and second oscillator means for filtering the tone signals in a manner determined by the parameter signals;

envelope means associated with the filter means for generating an attack-decay envelope signal in response to the parameter signals to form filtered tone signals;

modulator means for modulating the filtered tone signals with the attack-decay envelope signal to produce an audio signal; and transducer means for converting the audio signal to sound, whereby notes sounding with different voices can be produced simultaneously in order to simulate multiple instruments.

11. Apparatus, as claimed in claim 2, wherein the processing means also is responsive to the selection of the one harmony for generating parameter signals defining a first segment of music including a plurality of pitched accompaniment notes arranged in the one harmony and having a first rhythm pattern and for modifying the parameter signals during the performance in response to a change to the selected second harmony in order to generate parameter signals defining a second segment of music arranged in the second harmony and having a second rhythm pattern different from the first rhythm pattern.

12. Apparatus, as claimed in claim 11, wherein the processing means further is responsive to the selection of the one harmony for generating parameter signals defining a first segment of music including a plurality of pitched accompaniment notes arranged in the one harmony and having a first melodic contour and for modifying the parameter signals during the performance in response to a change to the selected second harmony in order to generate parameter signals defining a second segment of music arranged in the second harmony and having a second melodic contour different from the first melodic contour.

13. Apparatus, as claimed in claim 2, wherein the processing means also performs the function of modifying the parameter signals to produce at least one chord in the segment having a chord type different from the defined chord type.

14. Apparatus, as claimed in claim 2, wherein the processing means also performs the function of modifying the parameter signals to produce at least one chord in the segment having a root note different from the defined root note.

15. Apparatus, as claimed in claim 2, wherein the processing means also performs the function of modifying the parameter signals to produce at least one chord in the segment having a chord type and root note different from the defined chord type and the defined root note.

16. Apparatus, as claimed in claim 2, wherein the processing means also performs the function of modifying the parameter signals to produce a progression of different chords, each chord in the progression having a harmony different from the one harmony.

17. Apparatus, as claimed in claims 2 or 3, wherein the processing means also is responsive to the selection of the one harmony for generating parameter signals defining a first segment of music including a plurality of pitched accompaniment notes arranged in the one harmony and having a first melodic contour and for modifying the parameter signals during the performance in response to a change to the selected second harmony in order to generate parameter signals defining a second segment of music arranged in the second harmony and having a second melodic contour different from the first melodic contour.

18. Apparatus, as claimed in claims 3 or 4, wherein the harmony selection means further comprises means for enabling the performer to select one harmony having a defined chord type and a defined root note from a plurality of different harmonies defined by a plurality of different chord types having a plurality of different root notes.

19. Apparatus, as claimed in claim 18, wherein the harmony selection means comprises:

a keyboard including a plurality of playing keys operable by the performer, each playing key representing at least one note pitched in at least one octave position; and means for generating a playing key signal identifying each of the different notes represented by the playing keys operated by the performer, whereby the performer can select the defined chord type and defined root note.

20. Apparatus, as claimed in claim 19, wherein the processing means includes means responsive to the playing key signal for determing the defined chord type and defined root selected by the performer's operation of the keyboard, for generating a chord type signal corresponding to the defined chord type and for generating a root signal corresponding to the defined root.

21. Apparatus, as claimed in claim 18, wherein the plurality of different root notes is divided into a plurality of root groups and wherein the processing means comprises:

memory means for storing a separate set of music signals for each combination of chord type and root group, each set of music signals defining a unique segment of music; and central processor means for addressing the memory means in response to the selected chord type and root group for reading the addressed music signals from the memory means, for deriving the parameter signals from the music signals and for transmitting the parameter signals to the output means.

22. A process for enabling a performer to control the production of a musical accompaniment including notes having one or more of the musical parameters of rhythm pattern, chord pattern, and melodic contour, said accompaniment being produced during a musical performance, said process comprising the steps of:

enabling the performer to select one harmony from a plurality of different harmonies, the plurality of different harmonies being defined by a plurality of different chord types having a plurality of different root notes and the one harmony having a defined chord type and a defined root note;

generating parameter signals in response to the selection of the one harmony, said parameter signals defining a first segment of music including a plurality of pitched accompaniment notes arranged in the one harmony and having a first chord pattern;

modifying the parameter signals in response to a change in the defined root note while retaining the defined chord type during the performance in order to define a second segment of music having a second chord pattern different from the first chord pattern;

modifying the parameter signals in response to a change in the defined chord type during the performance in order to harmonically modulate the second segment compared to the first segment; and converting the parameter signals to sound, whereby a performer of limited skill or musical knowledge can play a musically-variable accompaniment to a melody written in any one of a variety of musical keys.

23. A process for enabling a performer to control the production of at least a first musical accompaniment and a second musical accompaniment including notes having an instrumentation pattern, said process comprising the steps of:

storing a first plurality of music signals defining at least in part the first musical accompaniment and a second plurality of music signals defining at least in part the second musical accompaniment;

enabling the performer during the performance to select one of said first and second musical accompaniments;

enabling the performer to select at least one harmony from a plurality of different harmonies;

generating parameter signals in response to the selection of the one musical accompaniment and one harmony, said parameter signals defining a first segment of music including a plurality of pitched accompaniment notes arranged in the one harmony and having a first instrumentation pattern;

modifying the parameter signals in response to a change in the selected musical accompaniment while retaining the one harmony during the performance in order to generate parameter signals defining a second segment of music having a second instrumentation pattern different from the first instrumentation pattern; and converting the parameter signals to sound, whereby a performer of limited skill or musical knowledge can play a musically variable accompaniment to a melody written in any one of a variety of musical keys.

24. A process for enabling a performer to control the production of a musical accompaniment including notes having one or more of the musical parameters of rhythm pattern, chord pattern, and melodic contour, said accompaniment being produced during a musical performance, said process comprising the steps of:

enabling the performer to select one harmony from a plurality of different harmonies;

generating parameter signals in response to the selection of the one harmony, said parameter signals defining a first segment of music including a plurality of pitched accompaniment notes arranged in the one harmony and having a first rhythm pattern;

modifying the parameter signals in response to a change to the selected second harmony during the performance in order to generate parameter signals defining a second segment of music arranged in the second harmony and having a second rhythm pattern different from the first rhythm pattern; and converting the parameter signals to sound, whereby a performer of limited skill or musical knowledge can play a musically-variable accompaniment to a melody written in any one of a variety of musical keys.

25. A process for enabling a performer to control the production of a musical accompaniment including notes having one or more of the musical parameters of rhythm pattern, chord pattern, and melodic contour, said accompaniment being produced during a musical performance, said process comprising the steps of:

enabling the performer to select one harmony from a plurality of different harmonies;

generating parameter signals in response to the selection of the one harmony, said parameter signals defining a first segment of music including a plurality of pitched accompaniment notes arranged in the one harmony and having a first melodic contour;

modifying the parameter signals in response to a change to the selected second harmony during the performance in order to generate parameter signals defining a second segment of music arranged in the second harmony and having a second melodic contour different from the first melodic contour; and converting the parameter signals to sound, whereby a performer of limited skill or musical knowledge can play a musically-variable accompaniment to a melody written in any one of a variety of musical keys.

26. A process, as claimed in claim 27, wherein the step of modifying the parameter signals comprises the step of producing at least one chord in the segment having a chord type different from the defined chord type.

27. A process as claimed in claim 27, wherein the step of generating the parameter signals comprises the step of producing at least one chord in the first segment having a root note different from the defined root note.

28. A process, as claimed in claim 27, wherein the step of generating the parameter signals comprises the step of producing at least one chord in the first segment having a chord type and root note different from the defined chord type and the defined root note.

29. A process, as claimed in claim 27, wherein the step of generating the parameter signals comprises the step of producing a progression of different chords, each chord in the progression having a harmony different from the one harmony.

30. A process, as claimed in claim 27, wherein the pitched accompaniment notes have a first melodic contour and wherein the steps of modifying the parameter signals in response to a change in the defined root note and modifying the parameter signals in response to a change in the defined chord type each further comprise defining the second segment of music to have a second melodic contour different from the first melodic contour.

31. A process as claimed in claim 30, wherein the pitched accompaniment notes have a first rhythm pattern and wherein the steps of modifying the parameter signals in response to a change in the defined root note and modifying the parameter signals in response to a change in the defined chord type each further comprise defining the second segment of music to have a second rhythm pattern different from the first rhythm pattern.

32. A process as claimed in claim 27, wherein the pitched accompaniment notes have a first rhythm pattern and wherein the steps of modifying the parameter signals in response to a change in the defined root note and modifying the parameter signals in response to a change in the defined chord type each further comprise defining the second segment of music to have a second rhythm pattern different from the first rhythm pattern.

33. A process, as claimed in claim 24 wherein the pitched accompaniment notes also have a first melodic contour, and wherein the step of modifying the parameter signals comprises defining the second segment of music to have a second melodic contour different from the first melodic contour.

34. A process, as claimed in claims 23, 24, 25 or 27, wherein the step of generating parameter signals includes the step of generating parameter signals that enable the accompaniment notes to sound in a plurality of different timbres and prevent the accompaniment notes from lying outside the range of any instrument being simulated by the timbres.

35. A process, as claimed in claims 23, 24, 25 or 27, wherein the step of generating parameter signals includes the step of generating parameter signals which define a counter melody related to the one selected harmony.

36. A process, as claimed in claims 23, 24, 25 or 27, wherein the step of generating parameter signals includes the step of generating parameter signals which define accompaniment notes arranged in a contrapuntal form.

37. A process, as claimed in claims 23, 24, 25 or 27 and further comprising the step of generating clock pulses defining a time duration of a musical bar in which the accompaniment notes occur and dividing the bar into a predetermined number of musical beats.

38. A process, as claimed in claim 37, wherein the step of generating clock pulses comprises the steps of generating first beat tempo clock pulses during a first beat of the bar and second beat tempo clock pulses during a second beat of the bar, dividing the parameter signals into a first group corresponding to the first beat and a second group corresponding to the second beat, generating the first group during the first beat tempo clock pulses irrespective of the harmony selected, generating the second group during the second beat tempo clock pulses in the event there is no change in the selected harmony between the first and second beats, and for generating the first group during the second beat tempo clock pulses in the event there is a change in the selected harmony between the first and second beats.

39. Electronic musical apparatus for enabling a performer to control the production of at least first and second different musical accompaniments during a musical performance, said apparatus comprising in combination:

memory means for storing a first plurality of digital music signals defining musical parameter information including at least timbre and envelope for the first musical accompaniment, for storing a second plurality of digital music signals defining musical parameter information including at least timbre and envelope for the second musical accompaniment and for storing instructions for processing the music signals according to the selected musical accompaniment and a selected harmony;

harmony selection means for enabling the performer to select one harmony from a plurality of different harmonies;

accompaniment selection means operative during the performance for generating a first selection signal in response to selection of the first musical accompaniment by the performer and for generating a second selection signal in response to selection of the second musical accompaniment by the performer;

output means for generating a first sequence of time-spaced musical notes controlled in pitch, amplitude, timbre and envelope in response to a first set of digital parameter signals and for generating a second sequence of time-spaed musical notes controlled in pitch, amplitude, timbre, and envelope in response to a second set of digital parameter signals; and processing means responsive to the selected selection signal and selection of the one harmony for reading the music signals corresponding to the selected musical accompaniment from the memory means and for processing the music signals according to said instructions to generate the values of both the first and second sets of digital parameter signals during the same time period, whereby a performer of limited skill or musical knowledge can play an accompaniment to a melody written in any one of a variety of musical keys.

40. Apparatus, as claimed in claim 39, wherein the processing means comprises means for changing the digital parameter signals corresponding to at least timbre in response to a change in musical accompaniment selected by the performer and for changing the parameter signals corresponding to at least pitch in response to a change in harmony selected by the performer.

41. Apparatus, as claimed in claim 34, wherein the memory means comprises means for storing signals defining information about the musical parameters of instrumentation, duration and pitch.

42. Apparatus, as claimed in claim 39, wherein the parameter signals define a first voice line and a second voice line for producing a segment of music and wherein the output means comprises:

first oscillator means associated with the first voice line and second oscillator means associated with the second voice line for generating tone pulses at a rate determined by the parameter signals;

filter means associated with the first and second oscillator means for filtering the tone signals in a manner determined by the parameter signals;

envelope means associated with the filter means for generating an attack-decay envelope signal in response to the parameter signals to form filtered tone signals;

modulator means for modulating the filtered tone signals with the attack-decay envelope signal in response to the parameter signals;

modulator means for modulating the filtered tone signals with the attack-decay envelope signal to produce an audio signal; and transducer means for converting the audio signal to sound, whereby notes sounding with different voices can be produced simultaneously in order to simulate multiple instruments.

43. A process for providing a four beat bar of musical accompaniment related to a predetermined harmony selected from a plurality of harmonies by a performer, said process being practiced by use of a memory and comprising the steps of:

generating a harmony signal representing the predetermined harmony selected by the performer from the plurality of harmonies;

generating first beat tempo clock pulses, second beat tempo clock pulses, third beat tempo clock pulses and fourth beat tempo clock pulses that divide the bar into first, second, third and fourth beats;

storing in the memory with respect to each harmony in said plurality of harmonies orchestration signals representing a unique musical accompaniment for each of the first, second, third and fourth beats;

reading from the memory the orchestration signals corresponding to the first beat during the generation of the first beat tempo clock pulses irrespective of the harmony selected by the performer;

reading from the memory the orchestration signals corresponding to the second beat during the generation of the second beat tempo clock pulses in the event there is no change in harmony selection by the performer between the first beat and the second beat;

reading from the memory the orchestration signals corresponding to the first beat during the generation of the second beat tempo clock pulses in the event there is a change in harmony selection by the performer between the first beat and second beat; and converting the orchestration signals to sound, whereby an appropriate accompaniment can be played even though a musician fails to follow proper musical phrasing by changing harmony between the first beat and second beat of a musical bar.

44. A process, as claimed in claim 23, wherein the predetermined harmony comprises a predetermined chord type based on a predetermined root, wherein the plurality of harmonies comprises a plurality of chord types and a plurality of roots, and wherein the step of generating a harmony signal comprises the steps of:

generating a chord type signal representing the predetermined chord type; and generating a root signal representing the predetermined root.

45. A process, as claimed in claim 44, wherein the step of reading from the memory is responsive to a change in the chord type signal, but is unresponsive to a change in the root signal.

46. A process, as claimed in claim 43, and further comprising the steps of:

reading from the memory the orchestration signals corresponding to the third beat during the generation of the third beat tempo clock pulses irrespective of the harmony selected by the performer;

reading from the memory the orchestration signals corresponding to the fourth beat during the generation of the fourth beat tempo clock pulses in the event there is no change in harmony selection by the performer between the third beat and fourth beat; and reading from the memory the orchestration signals corresponding to the first beat during the generation of the fourth beat tempo clock pulses in the event there is a change in harmony selection by the performer between the third beat and fourth beat.

47. Electronic musical apparatus for enabling a performer to control the production of at least first and second musical accompaniments during a musical performance, said apparatus comprising the combination of:

first memory means for storing a first plurality of music signals defining at least in part the first musical accompaniment and a second plurality of music signals defining at least in part the second musical accompaniment and for storing with respect to at least portions of said first and second accompaniments information about the musical parameters of instrumentation pattern, duration, and pitch;

accompaniment selection means operative during the performance for generatng a first selection signal in response to selection of the first musical accompaniment by the performer and for generating a second selection signal in response to selection of the second musical accompaniment by the performer;

harmony selection means for enabling a performer to select one harmony from a plurality of different harmonies;

second memory means for storing digital instructions for processing the music signals during the performance according to the one harmony;

central processor means responsive to the selected selection signal and to selection of the one harmony for reading the music signals corresponding to the selected musical accompaniment from the first memory means and for processing the music signals corresponding to the selected musical accompaniment according to said instructions to form time-spaced digital parameter signals having changing digital values which define a segment of music including a plurality of pitched accompaniment notes arranged to express the selected musical accompaniment in the one harmony; and output means for converting the changing values of the parameter signals to sound, whereby a performer of limited skill or musical knowledge can play an orchestrated accompaniment to a variety of melodies.

48. Apparatus, as claimed in claim 47, and further comprising means responsive to a change in the selected harmony for changing at least one of the following musical parameters of the notes:

(a) rhythm pattern, (b) chord pattern, (c) melodic contour.

49. Apparatus, as claimed in claim 47, wherein the first memory means comprises means for storing with respect to at least some of the signals defining information about instrumentation a table of instrument signals defining information about at least the parameters of envelope and timbre.

50. Apparatus, as claimed in claim 47, wherein the parameter signals define a first voice line and a second voice line for producing a segment of music and wherein the output means comprises:

first oscillator means associated with the first voice and second oscillator means associated with the second voice for generating tone pulses at a rate determined by the parameter signals;

filter means associated with the first and second oscillator means for filtering the tone signals in a manner determined by the parameter signals to produce filtered tone signals;

envelope means associated with the filter means for generating an attack-decay envelope signal in response to the parameter signals;

modulator means for modulating the filtered tone signals with the attack-decay envelope signal to produce an audio signal; and transducer means for converting each audio signal to sound, whereby notes sounding with different voices can be produced simultaneously in order to simulate multiple instruments.

51. Apparatus, as claimed in claim 47, wherein the output means comprises latch means for storing the value of the parameter signals during the duration of the notes and wherein the processor means comprises means for monitoring the duration of the notes, whereby the processor means needs to provide information to the output means only at the end of a note.

52. Apparatus, as claimed in claim 47, and further comprising means responsive to a change in the selected musical accompaniment for changing at least one of the following musical parameters of the notes:

(a) instrumentation pattern, (b) chord pattern, (c) melodic contour.

* * * * *